US010669065B2

(12) United States Patent
May et al.

(10) Patent No.: US 10,669,065 B2
(45) **Date of Patent: *Jun. 2, 2020**

(54) DISPENSER AND PROCESS

(71) Applicant: James Alexander Corporation, Blairstown, NJ (US)

(72) Inventors: Richard James May, Saylorsburg, PA (US); Jeffrey Rendano, Kunkletown, PA (US)

(73) Assignee: James Alexander Corporation, Blairstown, NJ (US)

( * ) Notice: Subject to any disclaimer, the term of this patent is extended or adjusted under 35 U.S.C. 154(b) by 33 days.

This patent is subject to a terminal disclaimer.

(21) Appl. No.: 15/681,973

(22) Filed: Aug. 21, 2017

(65) Prior Publication Data

US 2018/0050858 A1 Feb. 22, 2018

Related U.S. Application Data

(60) Provisional application No. 62/377,821, filed on Aug. 22, 2016.

(51) Int. Cl.
*B65D 17/50* (2006.01)
*B65D 25/08* (2006.01)
(Continued)

(52) U.S. Cl.
CPC ..... *B65D 17/50* (2013.01); *B05C 1/04* (2013.01); *B05C 1/06* (2013.01);
(Continued)

(58) Field of Classification Search
CPC ... A61M 35/003; A61M 35/006; B65D 25/08; B65D 35/28; B65D 47/2037
(Continued)

(56) References Cited

U.S. PATENT DOCUMENTS 3,567,061 A 3/1971 Song
3,684,136 A 8/1972 Baumann
(Continued)

FOREIGN PATENT DOCUMENTS

WO 0246089 A2 6/2002
WO 2002046089 A3 8/2002
(Continued)

*Primary Examiner* — David P Angwin
*Assistant Examiner* — Bradley S Oliver
(74) *Attorney, Agent, or Firm* — Schacht Law Office, Inc.; Paul J. Nykaza

(57) ABSTRACT

A dispenser (10) for dispensing a flowable material M has a container (12) having an outer wall (20) and membrane (14) collectively defining a first chamber (22) configured to contain the flowable material M. The membrane (14) has a thickness and a weld seam (40) wherein the weld seam (40) has a thickness less than the thickness of the membrane (14). A fracturing mechanism (16) is operably connected to the container (12). The fracturing mechanism (16) has an extending member (64) projecting from the outer wall (20) of the container (12). The extending member (64) has a projection (66) positioned proximate the membrane (14), wherein in response to deflection of the extending member (64), the projection (66) deflects the outer wall (20) proximate the membrane (14) wherein the weld seam (40) fractures creating an opening (41) through the membrane (14) configured to allow the flowable material M to pass therethrough and from the dispenser (10).

31 Claims, 28 Drawing Sheets

(51) Int. Cl.

| | |
|---|---|
| ***B65D 81/32*** | (2006.01) |
| ***B65D 35/24*** | (2006.01) |
| ***B05C 1/06*** | (2006.01) |
| ***B05C 17/005*** | (2006.01) |
| ***B65D 83/00*** | (2006.01) |
| ***B05C 1/04*** | (2006.01) |
| ***B65D 35/36*** | (2006.01) |
| ***B65D 47/20*** | (2006.01) |

(52) U.S. Cl.
CPC .. *B05C 17/00553* (2013.01); *B05C 17/00583* (2013.01); *B65D 25/08* (2013.01); *B65D 35/242* (2013.01); *B65D 35/36* (2013.01); *B65D 47/2037* (2013.01); *B65D 81/3244* (2013.01); *B65D 81/3266* (2013.01); *B65D 83/00* (2013.01); *B65D 83/0005* (2013.01); *B65D 47/2031* (2013.01)

(58) Field of Classification Search
USPC ..... 401/132–135, 158, 165
See application file for complete search history.

(56) References Cited

U.S. PATENT DOCUMENTS

| | | | | |
|---|---|---|---|---|
| 4,457,962 | A | 7/1984 | Jaffe et al. | |
| 4,784,506 | A | 11/1988 | Koreska et al. | |
| 5,169,030 | A | 12/1992 | Lewin | |
| 5,409,736 | A | 4/1995 | Leiner et al. | |
| 5,538,353 | A | 7/1996 | DeHavilland | |
| 5,664,705 | A | 9/1997 | Stolper | |
| 5,690,958 | A | 11/1997 | McGrath | |
| 5,772,346 | A | 6/1998 | Edwards | |
| 5,791,801 | A | 8/1998 | Miller | |
| 6,315,165 | B1 | 11/2001 | Regan | |
| 6,379,069 | B1 * | 4/2002 | May | B65D 25/08 401/132 |
| 6,536,975 | B1 | 3/2003 | Tufts | |
| 6,641,319 | B2 | 11/2003 | May | |
| 6,729,786 | B1 | 5/2004 | Tufts et al. | |
| 6,779,657 | B2 * | 8/2004 | Mainwaring | B65D 25/08 206/15.3 |
| 6,991,394 | B2 | 1/2006 | Tufts et al. | |
| 7,182,536 | B2 | 2/2007 | Tufts et al. | |
| 7,516,872 | B2 | 4/2009 | Boone et al. | |
| 7,581,899 | B2 | 9/2009 | May et al. | |
| 7,631,645 | B2 | 12/2009 | Gayton et al. | |
| 7,824,122 | B2 | 11/2010 | Flores et al. | |
| 7,909,808 | B2 | 3/2011 | Stenton | |
| 7,976,234 | B2 | 7/2011 | May | |
| D651,339 | S | 12/2011 | Kirk et al. | |
| 8,100,294 | B2 | 1/2012 | May et al. | |
| 8,342,765 | B2 * | 1/2013 | Stenton | A61B 17/00491 222/213 |
| 8,403,178 | B2 | 3/2013 | May et al. | |
| 8,518,076 | B2 | 8/2013 | Stenton | |
| 8,702,751 | B2 | 4/2014 | Stenton | |
| 8,794,858 | B2 | 8/2014 | Kirk et al. | |
| 8,801,312 | B2 | 8/2014 | Guzman et al. | |
| 8,864,399 | B2 | 10/2014 | Guzman et al. | |
| 8,910,830 | B2 | 12/2014 | May | |
| 9,119,946 | B2 | 9/2015 | Dokken et al. | |
| 9,265,923 | B2 | 2/2016 | Boone et al. | |
| 9,675,787 | B2 | 6/2017 | Guzman | |
| 2002/0012563 | A1 | 1/2002 | May | |
| 2003/0106905 | A1 | 6/2003 | Chan et al. | |
| 2003/0209561 | A1 | 11/2003 | Thomas et al. | |
| 2004/0155059 | A1 | 8/2004 | Harper | |
| 2007/0131713 | A1 | 6/2007 | Hill | |
| 2007/0253761 | A1 | 11/2007 | May | |
| 2008/0046004 | A1 * | 2/2008 | Stenton | A61M 35/003 606/214 |
| 2009/0196675 | A1 | 8/2009 | May et al. | |
| 2009/0311030 | A1 | 12/2009 | Stenton | |
| 2014/0227019 | A1 * | 8/2014 | May | B65D 47/2031 401/133 |
| 2017/0354406 | A1 | 12/2017 | Miller et al. | |

FOREIGN PATENT DOCUMENTS

| | | | |
|---|---|---|---|
| WO | 2009097428 | A1 | 8/2009 |
| WO | 2015042021 | A1 | 3/2015 |

* cited by examiner

DISPENSER AND PROCESS

CROSS-REFERENCE TO RELATED APPLICATIONS

The present application claims the benefit of U.S. Patent Application No. 62/377,821, filed on Aug. 22, 2016, which application is incorporated by reference herein.

FEDERALLY SPONSORED RESEARCH OR DEVELOPMENT

None.

TECHNICAL FIELD

The invention relates generally to a dispenser for a flowable material or substance and more particularly, to a dispenser having a membrane having enhanced fracturing characteristics for allowing a flowable substance to be contained and dispensed as desired.

BACKGROUND OF THE INVENTION

Containers capable of dispensing contents stored in the containers are known in the art. In certain applications, a dispenser may have a membrane that is selectively rupturable wherein upon rupture, a flowable substance can be dispensed from the container. For example, U.S. Pat. Nos. 5,490,746 and 5,664,705 disclose containers having rupturable membranes. The disclosed membranes, however, are made rupturable via score lines in the membranes. As are known in the art, score lines are weakened areas, typically formed by the removal of material. The membranes are ruptured by creating hydraulic pressure within the container where the membranes rupture along the score lines. Furthermore, in the membrane disclosed in U.S. Pat. No. 5,664,705, portions of the membrane overlap one another and the membrane is not integral with the dispenser but rather separately affixed to the dispenser wall. The use of score lines provides less control over the manner in which the membrane will rupture. In addition, separately attaching a membrane to a container adds to the complexity of the manufacturing process and cost. In other embodiments, the membrane may be generally flat or planar and have a weld seam that provides for the rupturability of the membrane. Limitations in the structural configuration of the prior art rupturable membranes can restrict the operability of the membrane and the type of flowable substances that can be suitably contained and dispensed from the container.

The dispensers having rupturable membranes are often formed in a plastic injection molding process. Various types of thermoplastic materials can be used. For example, the plastic material could be polyethylene or polypropylene. The various types of thermoplastic materials often limit the type of flowable materials that can be contained and dispensed from the dispenser because of chemical incompatibilities or other constraints. For example, one potential particular use for the dispenser is containing and dispensing topical antiseptics for surgical preparation of patients, sometimes referred to as surgical prep solutions. One such antiseptic is chlorohexadine gluconate (CHG) and is typically contained in glass ampoules because of difficulties in adequately storing CHG material in thermoplastic containers. Attempting to store CHG material in a thermoplastic container has proven to be unworkable because the CHG material reacts unfavorably with the thermoplastic material and no longer properly functions as an antiseptic as it loses its strength. For example, it has been found that potential shelf-life of CHG material stored in a thermoplastic container is too short to be commercially feasible and acceptable in a medical setting. The material may also permeate through the dispenser material. Because storing CHG in glass ampoules presents a separate set of problems (e.g., glass shards, premature opening of containers), a thermoplastic-based dispenser capable of containing and dispensing a CHG material would be desirable. Such a container would also be desirable for use with other types of surgical prep solutions or other acetone or alcohol-based solutions. Challenges have also been experienced with thermoplastic-based dispensers used to container acetone-based solutions or solutions with high concentrations of alcohol. Such solutions will leach through the dispenser materials including any weld seams incorporated into the rupturable membrane. Further challenges have been experienced in that the thermoplastic material of the dispenser must also be capable of forming a member that can be manually ruptured by a user. For example, a dispenser made from a particular thermoplastic may possess good chemical resistance properties but be too stiff to allow a user to fracture or rupture the dispenser via finger pressure.

While such containers according to the prior art, provide a number of advantageous features, they nevertheless have certain limitations. The present invention is provided to overcome certain of these limitations and other drawbacks of the prior art, and to provide new features not heretofore available. A full discussion of the features and advantages of the present invention is deferred to the following detailed description, which proceeds with reference to the accompanying drawings.

SUMMARY OF THE INVENTION

The present invention provides a dispenser that contains a flowable material wherein the dispenser has a membrane and a fracturing mechanism to fracture the membrane and dispense the flowable material.

According to a first aspect of the invention, a dispenser for dispensing a flowable material has a container having an outer wall and membrane collectively defining a first chamber configured to contain the flowable material. The membrane has a thickness and a weld seam wherein the weld seam has a thickness less than the thickness of the membrane. A fracturing mechanism is operably connected to the container. The fracturing mechanism has an extending member projecting from the outer wall of the container. The extending member has a projection positioned proximate the membrane, wherein in response to deflection of the extending member, the projection deflects the outer wall proximate the membrane wherein the weld seam fractures creating an opening through the membrane configured to allow the flowable material to pass therethrough and from the dispenser.

According to another aspect of the invention, the projection is spaced from the outer wall prior to deflection of the extending member.

According to a further aspect of the invention, the projection depends from an underside of the extending member.

According to another aspect of the invention, the projection has a length that extends beyond the membrane.

According to yet another aspect of the invention, the projection has a contoured surface. The contoured surface deflects the outer wall in response to the deflection of the extending member. The projection can be dimensioned such that in response to deflection of the extending member, a central portion of the projection engages and deflects the outer wall proximate where the membrane meets the outer wall.

According to another aspect of the invention, the extending member has a cut-out portion proximate an end of the extending member that projects from the outer wall. The cut-out portion defines a hinge wherein the extending member deflects about the hinge. In an embodiment, the cut-out portion is in an underside of the extending member. The cut-out portion can be a notch in an exemplary embodiment.

According to a further aspect of the invention, the extending member has a base, the base connected to the outer wall of the container. The extending member has a first segment and a second segment wherein the first segment projects from the outer wall. The dispenser has a longitudinal axis, and the second segment extends generally parallel to the longitudinal axis.

According to yet another aspect of the invention, the second segment has a rib depending therefrom. The depending rib is capable of further deflecting the outer wall of the container to force the flowable material through the membrane.

According to a further aspect of the invention, an interface area is defined between the first segment and the second segment wherein the interface area has a second cut-out portion defining a second hinge wherein the second segment is capable of pivoting about the second hinge towards the outer wall. The second cut-out portion has a contoured shape in an exemplary embodiment. The cut-out portion is on an underside of the extending member in one exemplary embodiment. In another exemplary embodiment, the cut-out portion is in an exterior surface of the extending member. The cut-out portion is a notch in one embodiment.

According to another aspect of the invention, the fracturing mechanism comprises a first fracturing mechanism and a second fracturing mechanism. The first fracturing mechanism and the second fracturing mechanism are positioned on the container in opposed relation.

According to a further aspect of the invention, the membrane has a generally conically-shaped configuration. In another embodiment, the membrane has a generally planar configuration.

According to a further aspect of the invention, the outer wall defines a second chamber positioned adjacent to the membrane. The second chamber defines an opening, wherein the flowable material passes through the membrane and into and from the second chamber. An applicator is positioned in the opening of the second chamber, and the flowable material is dispensed onto a receiving surface from the applicator. The applicator can be a porous member.

According to another aspect of the invention, a dispenser is provided for dispensing flowable material. The dispenser has a container having an outer wall and a membrane collectively defining a chamber configured to contain a flowable material. The membrane extends from the outer wall at an angle. The membrane has a thickness and a weld seam. The weld seam has a thickness less than the thickness of the membrane.

According to another aspect of the invention, the membrane is generally conically-shaped. In one exemplary embodiment, the membrane has a peripheral edge and an apex spaced from the peripheral edge. The peripheral edge is integral with the outer wall.

According to another aspect of the invention, the angle the membrane extends from the outer wall is in the range from approximately 19° to 25°. In a further exemplary embodiment, the angle is in the range from approximately 20° to 22.5°. In still a further exemplary embodiment, the angle is approximately 22.5°. These angles may be referred to as cone angles.

According to another aspect of the invention, the weld seam has a thickness in the range of approximately 0.003 inches to 0.015 inches. In an exemplary embodiment, the weld seam has a thickness in the range of approximately 0.010 inches to 0.014 inches. In other exemplary embodiments, the weld seam has a thickness of approximately 0.012 inches.

According to a further aspect of the invention, the membrane converges to an apex and has a plurality of weld seams converging to the apex.

According to yet another aspect of the invention, the dispenser is formed by an injection-molding process. In one exemplary embodiment, the dispenser is formed of various thermoplastic materials and various combinations thereof.

According to a further aspect of the invention, the dispenser is formed from polyvinylidene fluoride. In other embodiments, the dispenser is formed from nylon, polypropylene or polyethylene.

According to another aspect of the invention, a membrane has a web of material that is generally conically-shaped. The web has a thickness and a weld seam wherein the weld seam has a thickness less than the thickness of the web.

According to other aspects of the invention, methods of dispensing are disclosed using the dispenser as well as a method of forming the dispenser.

According to another aspect of the invention, a container assembly is provided wherein a first container is positioned within a second container. Each container may have an angled or conically-shaped membrane. The membranes are ruptured wherein flowable substances contained within the containers mix to form a mixture. The mixture can then be dispensed from the container assembly.

According to a further aspect of the invention, the dispenser may have multiple chambers and multiple conically-shaped membranes.

According to a further aspect of the invention, the dispenser may define a chamber for containing a surgical prep solution. The dispenser has a rupturable membrane and in one exemplary embodiment, the membrane has a weld seam. The membrane could be generally planar or have an angled or conical configuration. In one exemplary embodiment, the dispenser is made from a combination of thermoplastic materials.

According to a further aspect of the invention, the dispenser is formed of a material formulation having a predetermined amount of polyvinylidene fluoride.

According to a further aspect of the invention, the dispenser has a fracturing mechanism or rupturing mechanism operably associated with the fracturable or rupturable membrane.

According to a further aspect of the invention, an injection-molded dispenser for dispensing a flowable material has a container defining a chamber configured to contain the material. A membrane encloses the container and has a weld seam rupturable in response to a force applied proximate the weld seam wherein the material is configured to be dispensed from the container. The dispenser is formed from a blend of thermoplastic materials that includes a predetermined amount of polyvinylidene fluoride.

According to another aspect of the invention, a one-piece injection molded dispenser for dispensing a flowable material has a container. The container has a container having a first chamber and a second chamber wherein the first chamber is adapted to contain the material. A membrane is disposed within the container separating the first chamber and the second chamber. The membrane has a thickness and a weld seam, the weld seam having a thickness less than the thickness of the membrane. The dispenser is formed of entirely of polyvinylidene fluoride. In further embodiments, the dispenser could be made entirely from polypropylene or the dispenser could be made entirely from nylon.

According to additional aspects of the invention, dispensers are disclosed having rupturing mechanisms or fracturing mechanisms having various structural modifications as disclosed herein.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION OF THE PREFERRED EMBODIMENT

Figure 1:
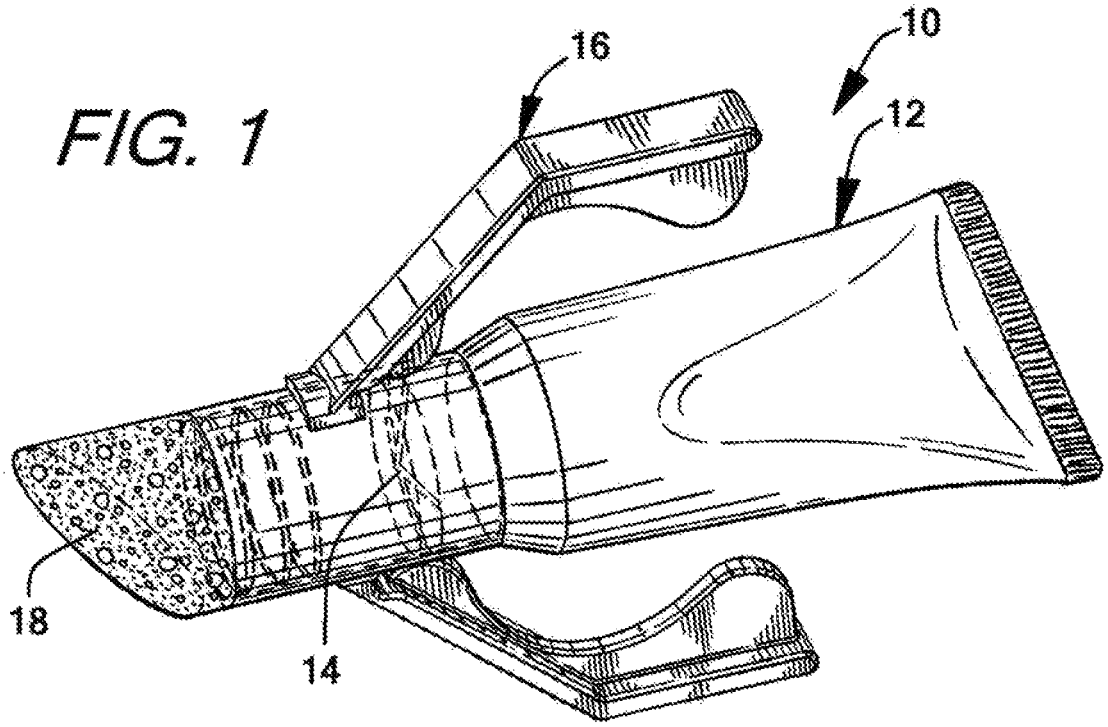
FIG. 1 is a perspective view of a dispenser according to the present invention.

While this invention is susceptible of embodiments in many different forms, there are shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIGS. 1-39 disclose exemplary embodiments of dispensers of the present invention. Various structures of the dispensers will be described in detail. Particular materials and material combinations used to form the dispensers will also be discussed. As will be discussed in greater detail below, particular thermoplastic materials and combinations thereof for the dispensers will allow the dispensers to contain certain flowable materials that until the present invention were not previously possible. For example, the dispensers made from the unique thermoplastic materials or combinations will be ideal for containing particular surgical prep solutions in commercial applications, or other pharmaceutically active agents. Such thermoplastic materials or combinations will also result in even more potential uses for the dispensers of the present invention. In addition, the dispensers of the present invention have various fracturing mechanism structures that further expand the applications for the dispensers. Certain other structures and combinations of structures will further enhance the applications possible with the dispensers of the present invention.

Referring to the drawings, FIG. 1 discloses a dispenser according to the present invention generally designated by the reference numeral 10. The dispenser 10 generally includes a container 12 or container assembly 12, a fracturable membrane 14 or rupturable membrane 14, a fracturing mechanism 16 or rupturing mechanism 16, and an applicator 18. It is understood that the dispenser 10 can function without the use of an applicator 18 if desired wherein the benefits of the invention are still realized.

Figure 2:
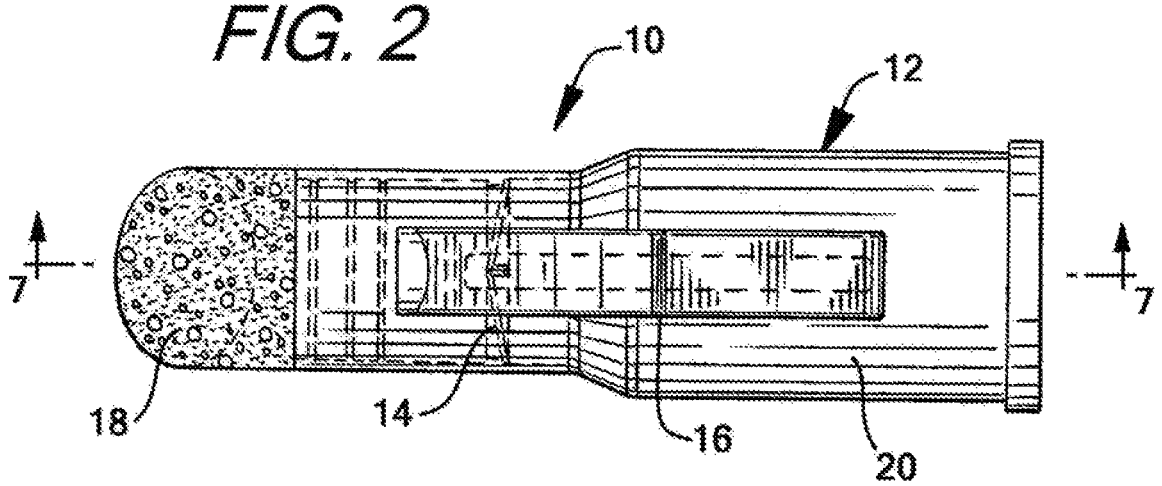
FIG. 2 is a top plan view of the dispenser of FIG. 1 prior to sealing a distal end of the dispenser.
Figure 3:
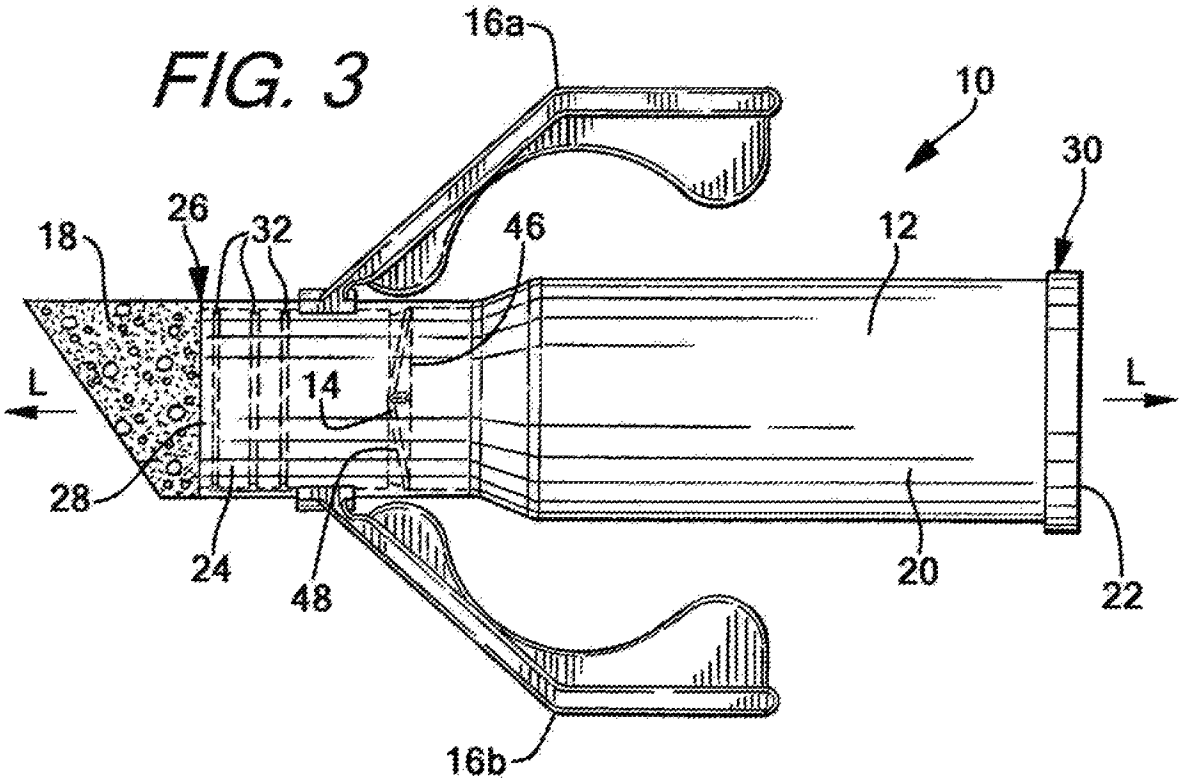
FIG. 3 is a side elevation view of the dispenser of FIG. 1 prior to sealing the distal end of the dispenser.

FIGS. 2 and 3 show the container 12 prior to having one end sealed as will be described in greater detail below. As shown in FIGS. 2 and 3, the container 12 has an elongated, longitudinal axis L having a peripheral wall 20, or outer wall 20. In one preferred embodiment, the container 12 is cylindrical. However, the container 12 can be molded in numerous shapes, including an elliptical shape, rectangular shape or other various cross-sectional shapes. As will be described in greater detail below, in one exemplary embodiment, the dispenser 10 is generally an integral, one-piece structure formed by an injection-molding process. It is understood that the length of the container 12 can vary depending generally on the desired volume capacity.

As further shown in FIGS. 2 and 3, the container 12 has the outer wall 20 that is operably associated with the rupturable or fracturable membrane 14 or web 14. The outer wall 20 and the membrane 34 are preferably integral. As explained in greater detail below, the outer wall 20 and the membrane 14 are operably connected to cooperatively define a chamber 22 or first chamber 22. As will be explained, the container assembly 12 of the dispenser 10 can have a single chamber 22 or multiple chambers can also be defined within the container assembly 12. In one exemplary embodiment, the membrane 14 is located along the longitudinal axis L of the container 12 at a location connected to the outer wall 20 to define the first chamber 22 and a second chamber 24. The second chamber 24 may also be referred to as a mixing chamber 24. The second chamber 24 defines a proximal end 26 that further defines an opening 28 to receive the applicator 18 as will be described in greater detail below. Opposite to the proximal end 26, the container 12 has a distal end 30 that is subsequently sealed as described in greater detail below. It is understood that the membrane 14 could be positioned at an end of the outer wall 16 wherein the second chamber 24 is eliminated and an outer surface of the membrane 14 defines an end of the container 12 and is open to an atmosphere.

Figure 4:
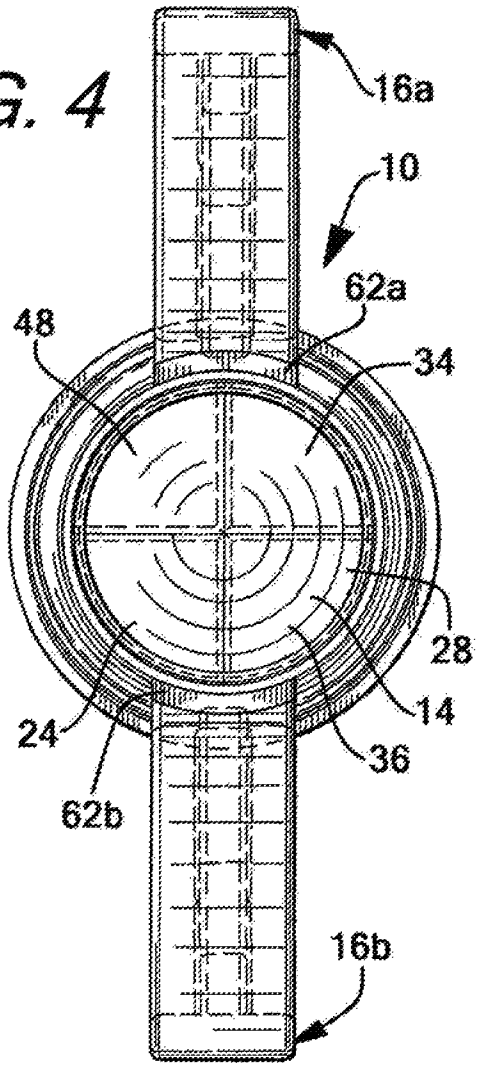
FIG. 4 is an end view of the dispenser of FIG. 1 and having an applicator removed.

As shown in FIGS. 3 and 4, an interior surface 28 of the outer wall 20 at the second chamber 24 may include ribs 32. In one preferred embodiment, the ribs 32 may take the form of circumferential ribs 32. As shown in an alternative embodiment of FIG. 5, the interior surface of the second chamber 24 has a plurality of longitudinal ribs 32 that extend longitudinally along the interior surface. The ribs 32 are thus oriented axially in the second chamber 24 and can be of varying length. The ribs 32 could be shortened and extend radially inwardly. The ribs 32 assist to secure different applicators 18 as described in greater detail below.

As further shown in FIGS. 3-8, the membrane 14 in the exemplary embodiment is positioned along the longitudinal axis L between the proximal end 26 and distal end 30 to define the first chamber 22 between the membrane 14 and the distal end 30. The second chamber 24 is also defined between the membrane 14 and the proximal end 26, and may also be referred to as the mixing chamber 24 or dispensing chamber 24. After a filling operation to be described, the outer wall 20 is sealed together at the distal end 30 by any number of known sealing methods, including heat or adhesive sealing (See FIG. 18). Alternatively, the distal end 30 can receive a cap to close the first chamber 22. When the distal end 30 is sealed, and in cooperation with the membrane 14, the first chamber 22 is a closed chamber for holding a flowable material or flowable substance. As also shown in FIG. 3, the container 12 can be necked down wherein the second chamber 24 and, if desired, a portion of the first chamber 22 can have a smaller diameter than the majority of the first chamber 22. Alternatively, the container 12 can have a constant diameter along its longitudinal axis L.

Figure 5:
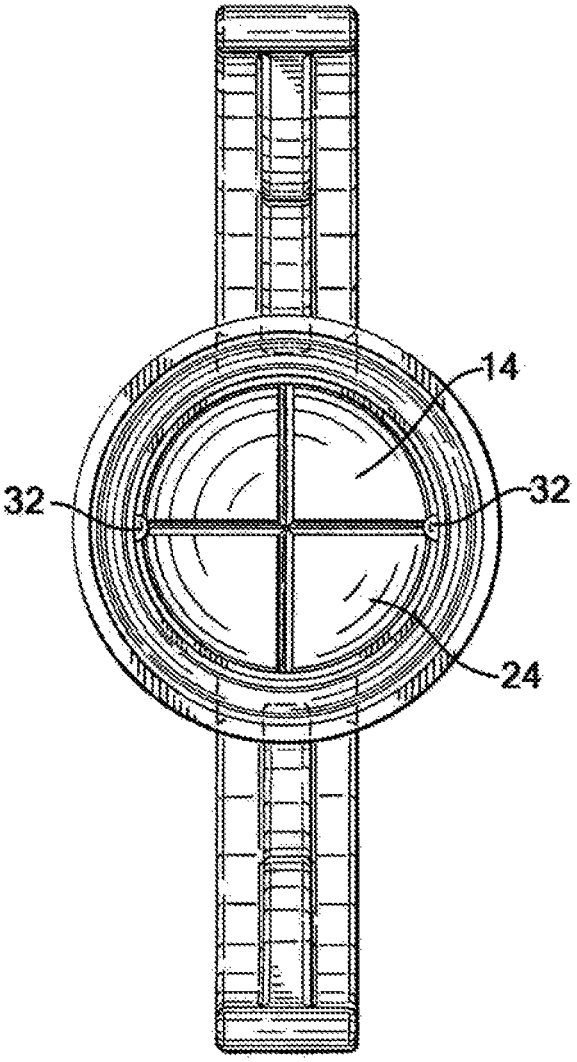
FIG. 5 is an end view of an alternative embodiment of the dispenser that has longitudinal ribs.
Figure 6:
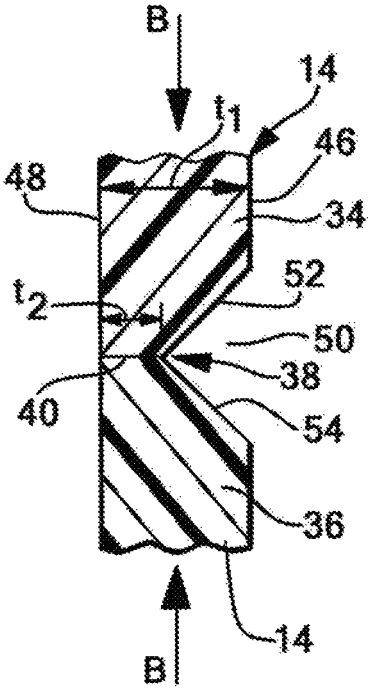
FIG. 6 is a partial cross-sectional view of a fracturable membrane of the dispenser of FIG. 1 and showing a mold line, knit line or weld seam.

In one exemplary embodiment, the membrane 14 can be formed extending from the outer wall 20 at an angle. In particular, the membrane 14 can be in a conical or spherical shape. As explained in greater detail below, this configuration provides certain unexpected results and benefits. In the disclosed configuration, the membrane 14 extends from the outer wall 20 of the container 12 at an angle, which may be referred to as a cone angle. The angle of the membrane 14 may also be considered from a straight or vertical axis, and, for example, is designated an angle A in FIG. 8. The membrane 14 is formed in a configuration that is generally not flat or planar in one exemplary embodiment. As depicted in FIGS. 3-8, the membrane 14 is formed with abutting mold segments 34,36. As shown in FIG. 6, the membrane 14 may have a membrane thickness $t_1$. As explained in greater detail below, the mold segments 34, 36 are formed together that abut to form a weld seam 40, with a thickness $t_2$ (shown in FIG. 6). The thickness $t_2$ may be increased over prior designs and can be set at approximately 0.006 inches or be set at a traditional 0.003 to 0.004 inches but wherein such thickness requires less force for rupture as explained in greater detail below. As further described below, use of the fracturing mechanism 16 allows for the thickness $t_2$ to be set even larger such as up to 0.015 inches wherein a range can include approximately 0.003 inches to approximately 0.015 inches. The mold segments 34,36 are formed at the angle A as shown in FIGS. 3 and 4 and also FIGS. 7 and 8. Testing including finite element analysis has shown that the angle A can be at various angle ranges and in certain exemplary embodiments, the angle A is 20° or 22.5° as shown measured in FIG. 8. The angle can be measured from a vertical axis passing through an end or apex of the membrane. This angle is also the angle that the membrane 14 extends forward from the outer wall 20 of the container 12. Other ranges are also possible such as between 20° to 25° or 5° to 40°. Broader ranges are also possible. Thus, the overall shape of the membrane 14 may be considered conical in one exemplary embodiment rather than generally flat, planar or straight as in prior designs. Described somewhat differently and shown in FIG. 7, the membrane 14 has a peripheral edge 42 and an apex 44. The apex 44 is spaced from the peripheral edge 42. Thus, the peripheral edge 42 of the membrane 14, which is integral with the outer wall 20 in an exemplary embodiment, is positioned at one location along the longitudinal axis L of the container 12 while the apex 44 is positioned at another location along the longitudinal axis L of the container 12, thus spaced linearly away from the peripheral edge 42. The mold segments 34,36 or membrane sections, extend from the peripheral edge 42 and converge to the apex 44. It is also understood that the membrane 14 can be angled but wherein the membrane segments 34,36 do not converge to an apex. The apex 44 could also be positioned at a location other than a general center of the membrane 14 if desired. In an exemplary embodiment, the apex 44 is positioned at a center of the membrane 14. Alternatively, the membrane 14 can have a curvilinear shape such as a dome shape (not shown).

As further shown in FIG. 6, the membrane 14 contains a plurality of rupturable members in the form of weld seams 40, which can be arranged in a number of configurations including but not limited to a cross, star, or asterisk. It is understood, further, that the benefits of the invention can be realized with a single weld seam 40 in the membrane 14. In a preferred embodiment, the weld seams 40 are collectively arranged in a plus-shaped configuration wherein the membrane generally has a pie-shape. As shown in FIGS. 4-7, adjacent mold segments 34,36 from an injection molding process abut with one another to form the weld seams 40. Due to the configuration of the mold to be described below, the weld seams 40 are formed to have a lesser thickness $t_2$ than the membrane thickness $t_1$. As further shown in FIG. 4, the plurality of weld seams 40 extend radially from substantially a center of the membrane 14 (which may correspond to the apex 44) on the membrane 14 completely to an outer edge or the peripheral edge 42 of the membrane 14, and to the interior surface of the container 12. It is understood, however, that the weld seams 40 do not need to extend to the peripheral edge 42 of the membrane 14. While a membrane containing weld seams 40 is preferred, it is understood that the rupturable members can take other forms to otherwise form a weakened member. Weakened members can take various forms including frangible members, thinned members, or members formed by other processes, such as scoring.

Figure 7:
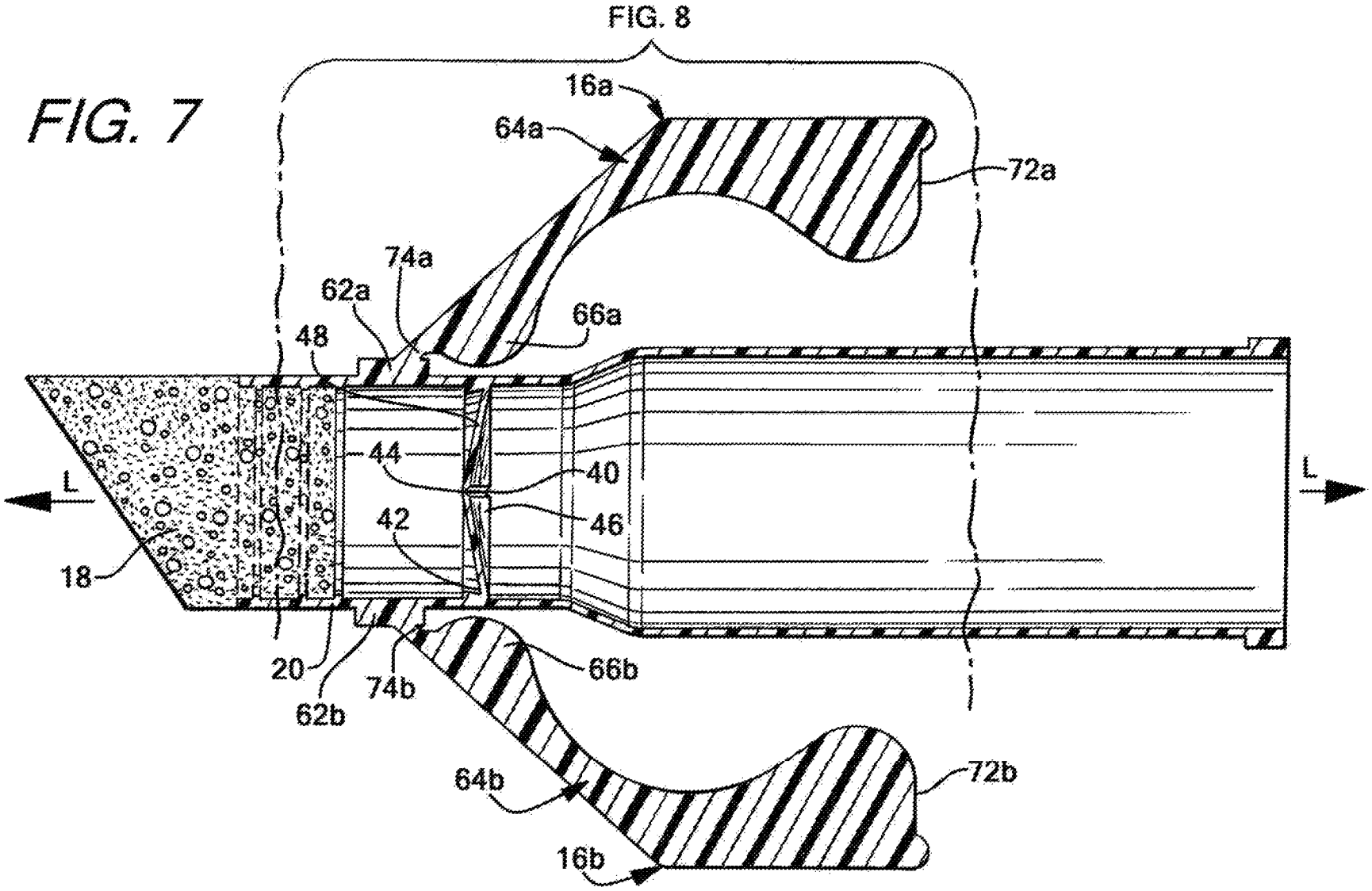
FIG. 7 is a cross-sectional view of the dispenser taken along lines 7-7 in FIG. 2.
Figure 8:
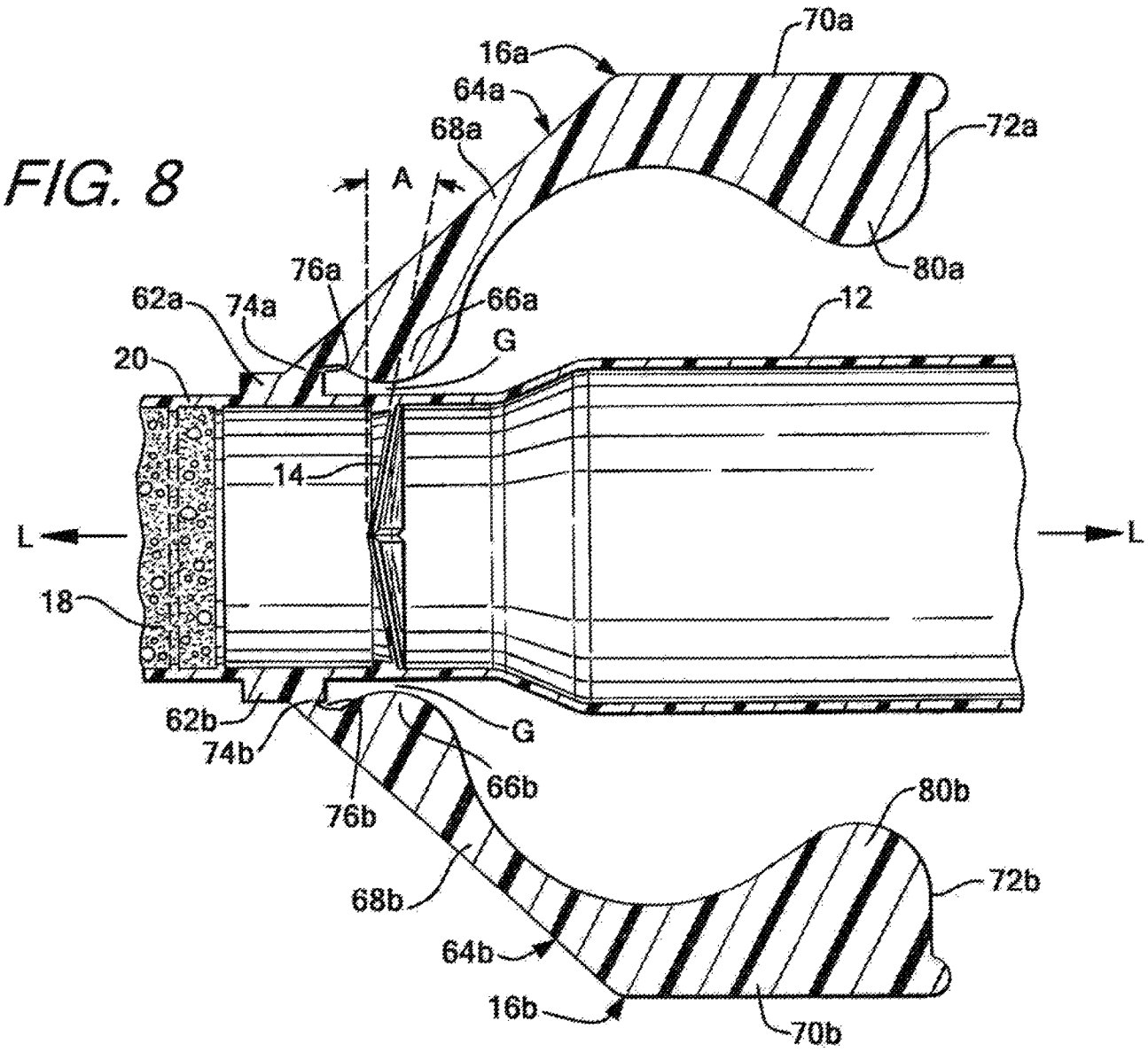
FIG. 8 is a partial enlarged cross-sectional view of a portion of the dispenser and of the area indicated in FIG. 7.
Figure 16A:
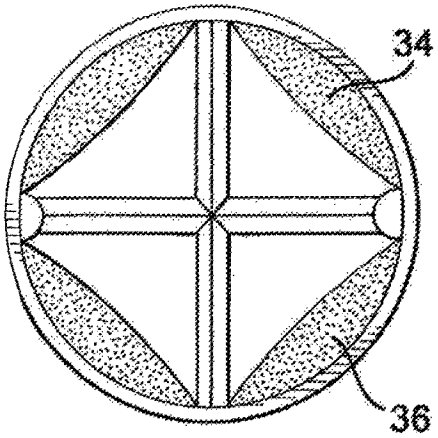
FIG. 16A-16F are a series of views showing the injection molding process of the membrane wherein adjacent mold segments abut to form mold lines, knit lines or weld seams.
Figure 16B:
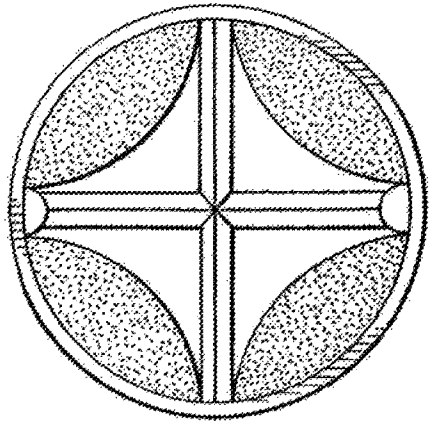
Figure 16C:
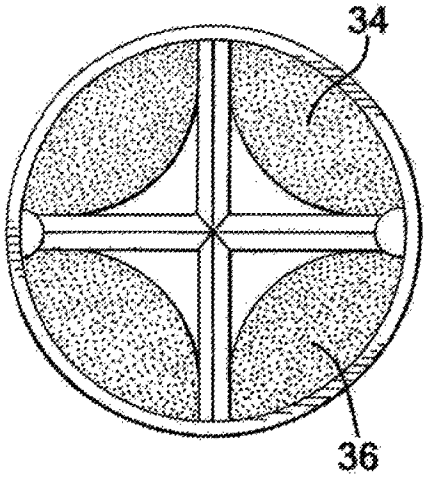
Figure 16D:
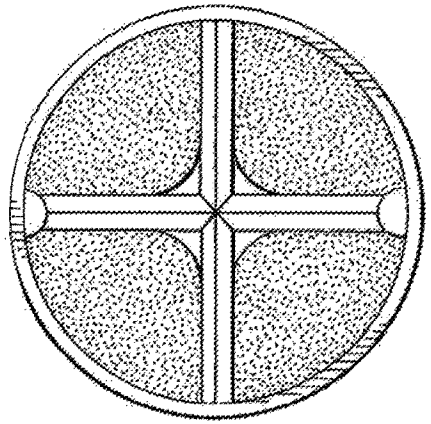
Figure 16E:
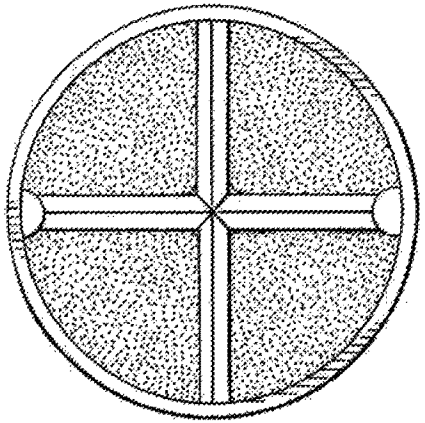
Figure 16F:
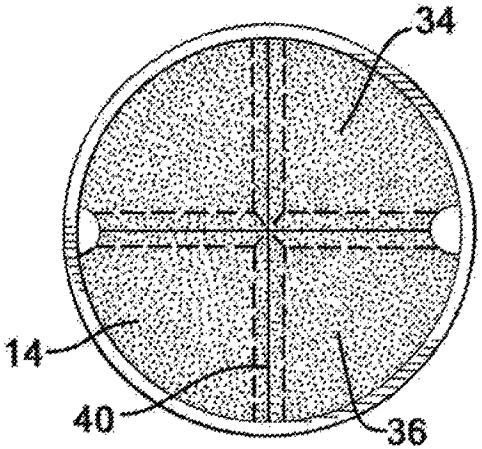

The membrane 14 is similar to the membrane structure disclosed in U.S. Pat. No. 6,641,319, which is incorporated herein by reference. In a most preferred embodiment, the membrane 14 has four mold segments and wherein the weld seams 40 generally form a cross or + shape (FIGS. 4-5). As shown in FIG. 16A, the process is controlled such that the adjacent mold segments 34,36 each meet at the separate interface areas 38. Each weld seam 40 has a thickness less than the thicknesses of the segments 34,36. The thicknesses of the mold segments 34,36 are considered to be the membrane thickness $t_1$ and the weld seams 40 are referred to with the thickness $t_2$ (FIG. 6). It is understood that the membrane 14 having the weld seams 40 is formed in the conical or tapered shape as shown in FIGS. 3, 7 and 8.

Compression of the container 12 proximate the membrane 14, such as by finger pressure on the fracturing mechanism 16 to be described, causes the membrane 34 to break, rupture, or fracture only along the radial depressions or weld seams 40 forming a series of finger-like projections which are displaced from one another (FIG. 20) and upon sufficient force can be in overlapping fashion to create membrane openings 41 for release of the material from the first chamber 18 into the second chamber 20, which may also be referred to as a mixing chamber 20. Because of the structure of the weld seams 40, squeezing the container 12 at or towards the distal end to create hydraulic pressure against the membrane 34 will not break or rupture the weld seams 40. Since the projections are "pie-shaped" and widest at their outer edges, the center section of the membrane 14 breaks open the widest. The amount of material that can be dispensed through the web 34 is controlled by the degree of the opening 41. The size of the opening 41 is controlled by the configuration of the weld seams 40 and the pressure of the fingers of the user pressing on fracturing mechanism 16 of the container assembly 12 to assert pressure on the membrane 14. Fracturing or rupturing of the membrane 14 will be described in greater detail below. The resiliency of the material of the dispenser 10 allows the membrane 14 to return substantially to a closed position when force is removed from the dispenser 10. The angled configuration of the membrane 14 provides a rupturing force to be less than prior designs. This provides certain advantages as described in greater detail below.

As further shown in FIGS. 3-8, the membrane 14, or web 14, partitions the container 12 to separate the first chamber 22 from the second chamber 24 or dispensing or mixing chamber 24. Although FIG. 3 shows the membrane 14 closer to the proximal end 26 than the distal end 30, the placement of the membrane 14 is a function of the desired volume capacity of the respective chambers. As such, the membrane 14 could be located at numerous locations in the container 12. In one embodiment, the membrane 14 could be positioned at an end of the dispenser 10 whereby the second chamber 24 or mixing chamber 24 is eliminated.

As shown in FIGS. 3-4 and 7-8, the membrane 14 has a first surface 46 and a second surface 48. The first surface 46 faces towards the first chamber 22, while the second surface 48 faces towards with the second chamber 24. The second surface 48 is angled but has a generally smooth surface. The first surface 46, however, has a plurality of bands or depressions thereon formed by the weld seams 40. As will be described in greater detail below, and as generally shown in FIGS. 5-6, and 14-16, a first segment 34 of injected molded material abuts a second segment 36 of injected molded material to form the weld seam 40. As can be further seen in FIG. 6, the membrane 14 has a base thickness "$t_1$" between the first membrane surface 46 and the second membrane surface 48. The thickness $t_1$ is generally referred to as the membrane thickness. The weld seam 40 has a thickness $t_2$ that is less than the membrane thickness $t_1$. This facilitates rupture of the membrane 14 as described below. The first mold segment 34 and the second mold segment 36 abut to form the weld seam 40. During the molding process, the mold segments 34,36 move toward the interface area 38 in the directions of arrows B (FIG. 6). Furthermore, the mold segments 34,36 meet substantially at the interface area 38 at the lesser thickness $t_2$. This forms the weld seam 40 at the lesser thickness facilitating rupture of the membrane 14. If the mold segments 34,36 did not meet at the interface area 38 but, for example, substantially further to either side of the interface area 38, the weld seam 40 would be too thick and would not be able to rupture. Whichever mold segment 34,36 moved past the interface area 38, the segment would merely flex and not rupture as desired. Thus, as described below, the molding process is controlled to insure that the mold segments 34,36 abut substantially at the interface area 38 to form the weld seam 40 having a thickness $t_2$ less than the membrane thickness $t_1$. With the angled membrane 14, the thickness $t_2$ can be increased over previous designs while still providing for easy selective rupture by a user as discussed further below. As also described further below, whether a conical membrane 14 or a planar membrane 14 is formed in the dispenser 10, the weld seam thickness $t_2$ can be increased over previous designs when the fracturing mechanism 16 is utilized. The fracturing mechanism 16 allows a user to provide more leverage via finger pressure and, therefore, more force to the membrane 14 wherein the weld seam thickness $t_2$ can be increased over prior designs.

As further shown in FIG. 6, the first surface 46 of the membrane 14 has a channel 50 formed therein. The weld seam 40 confronts the channel 50. The channel 50 is formed by a first wall 52 adjoining a second wall 54. In a preferred embodiment, the first wall 52 adjoins the second wall 54 at substantially a 90 degree angle. Acute angles or obtuse angles are also possible. Thus, in one preferred embodiment, the channels are V-shaped.

In another preferred embodiment, the membrane 14 forms four narrow spokes of substantially uniform width extending from substantially the center of the membrane 14 to the interior surface of the container assembly 12, or towards the inner surface of the outer wall 20. Each spoke extends at a certain angle from the adjacent spokes on either side. In other embodiments, the number of spokes can be increased or decreased as desired.

Figure 9:
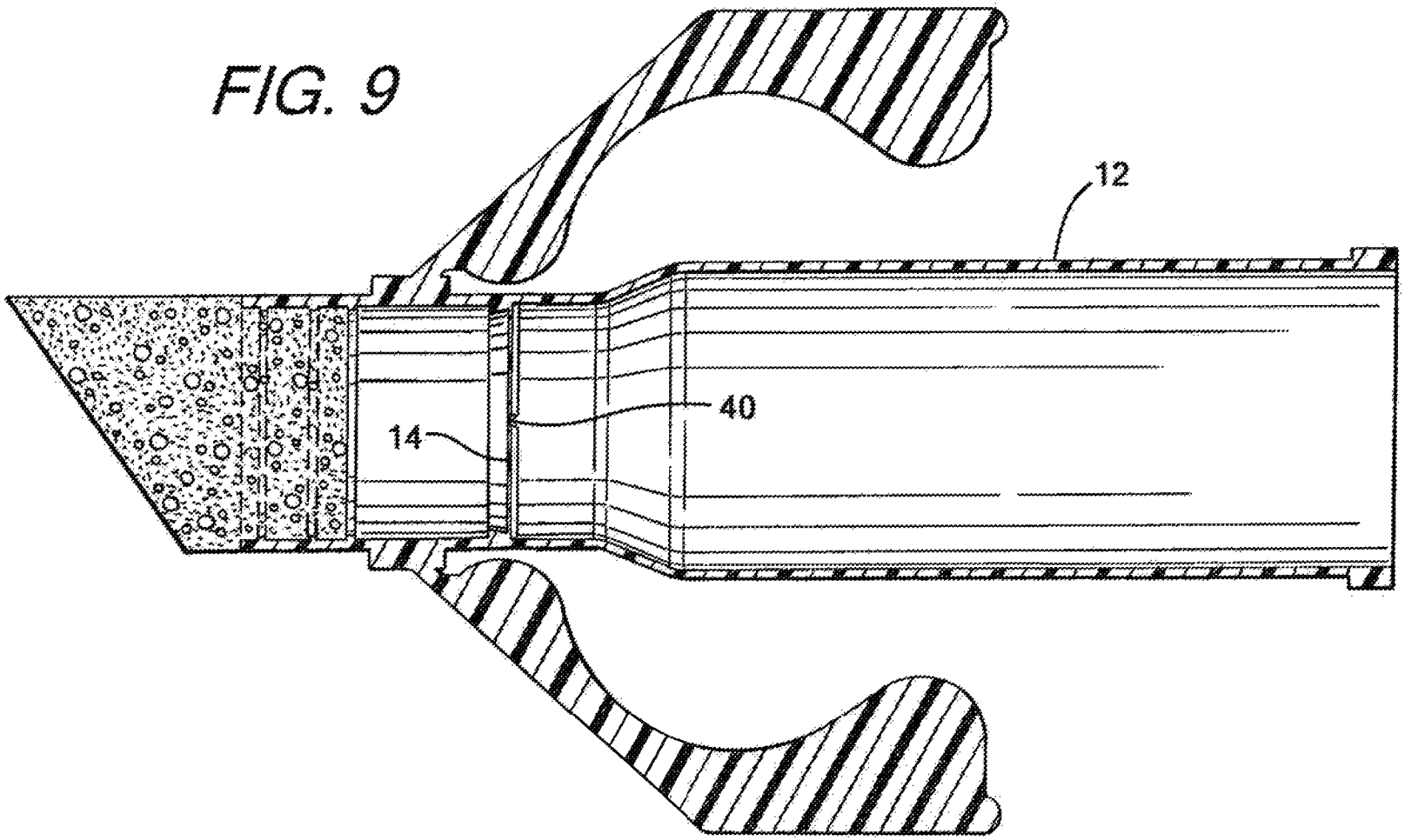
FIG. 9 is a cross-sectional view of an alternative embodiment of the dispenser and having a generally planar fracturable membrane.
Figure 13:
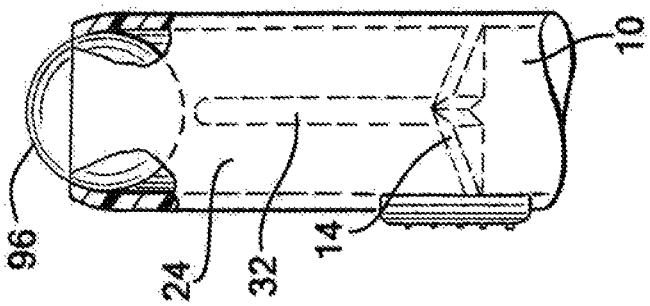
FIG. 13 is a partial elevation view of the dispenser supporting a roller assembly.
Figure 12:
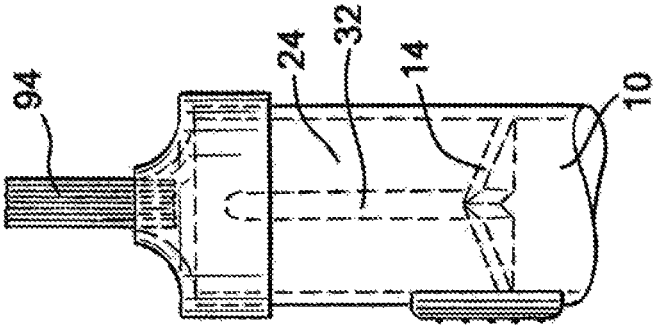
FIG. 12 is a partial elevation view of the dispenser supporting a brush assembly.

FIGS. 3 and 7-8 show the dispenser 10 having the rupturable membrane 14 in an angled configuration. In this exemplary embodiment, the membrane 14 has a weld seam 40 and has a generally conical configuration. It is understood that the rupturable membrane 14 can take other forms. For example as shown in FIG. 9, the dispenser 10 can be formed having the rupturable membrane 14 in a generally planar or flat configuration. It is understood that other structures and operation of the dispenser 10 are generally identical as described herein.

FIGS. 1-5 and 7-8 disclose the fracturing mechanism 16 of the dispenser 10. The fracturing mechanism is operably connected and associated with the container 12 and membrane 14 and functions to rupture the membrane 14. As will be described in greater detail below, a user can activate the fracturing mechanism 16 to fracture the membrane 14 of the dispenser 10 and dispense the contained flowable material M from the dispenser 10.

In an exemplary embodiment, the fracturing mechanism 16 includes a first fracturing mechanism 16*a* and a second fracturing mechanism 16*b*. The first fracturing mechanism 16*a* has a first base 62*a*, a first extending member 64*a* and a first projection 66*a*. The second fracturing mechanism 16*b* has a second base 62*b*, a second extending member 64*b* and a second projection 66*b*. The components of the first fracturing mechanism 16*a* and the second fracturing mechanism 16*b* are generally symmetrical and similar in structure. The structures of the first fracturing mechanism 16*a* will be described with the understanding that the description also applies to the second fracturing mechanism 16*b*.

As further shown in FIGS. 7-8, the first base 62*a* is positioned on the outer wall 20 adjacent to but proximate the membrane 14. The first base 62*a* extends from the outer wall 20 and preferably follows the curved contour of the outer wall 20 (FIG. 4). The first base 62*a* is preferably integral with the container 12. The first base 62*a* is dimensioned to provide sufficient support for the first extending member 64*a*. As discussed, the above description applies to the second base 62*b*. The first base 62*a* provides a foundation for support of the extending member 64*a*.

FIGS. 7-8 further show the first extending member 64*a* and the second extending member 64*b*. The first extending member 64*a* and the second extending member 64*b* are generally symmetrical and similar in structure. The structures of the first extending member 64*a* will be described with the understanding that the description also applies to the second extending member 64*b*. The first extending member 64*a* has a generally elongated length as will be described in greater detail below. The first extending member 64*a* defines a first segment 68*a* and a second segment 70*a*. The first segment 68*a* extends away from the first base 62*a* and generally at an angle from the central longitudinal axis L defined by the container 12. The second segment 70*a* extends from the first segment 68*a* and extends generally parallel to the longitudinal axis L. The first segment 68*a* and the second segment 70*a* have generally smooth planar surfaces to define a platform for a user's thumb and/or fingers during operation as described in greater below. The length of the first segment 68*a* and the second segment 70*a* are dimensioned such that a distal end 72*a* of the second segment 70*a* extends to and is proximate a midportion of the overall length of the dispenser 10. The length of the first segment 68*a* and the second segment 70*a* could vary as necessary to achieve desired operation of the dispenser. As discussed, the description of the first extending member 64*a* applies to the second extending member 64*b* as the members 64*a*,64*b* are similar in structure.

As further shown in FIGS. 7-8, the first projection 66*a* is positioned generally between an inner surface of the first extending member 64*a* and the container 12. The first projection 66*a* depends from an underside of the first segment 68*a*. The first projection 66*a* thus occupies a space defined between the container 12 and the first segment 68*a* of the first extending member 64*a*. The first projection 66*a* is a finger-like member positioned between the first extending member 64*a* and the container 12. The first projection 66*a* extends in a direction generally parallel to the longitudinal axis L of the dispenser 10. The first projection 66*a* has a length wherein portions of the first projection 66*a* extend on both sides of the membrane 14, and thus extends beyond the membrane 14. The first projection 66*a* further has a contoured surface in an exemplary embodiment. In an exemplary embodiment, the first projection 66*a* depends from the first segment 68*a* and is spaced from the container 12 to define a gap G when the first extending member 64*a* is in a first or neutral position, e.g., prior to deflection of the extending member 64*a*. The gap G is thus initially maintained when the dispenser is in a neutral position prior to fracturing of the membrane 14. The gap G assists in minimizing inadvertent fracturing of the membrane 14 as there is a distance (the gap G) that the extending member 64*a*,64*b* can move before the outer wall 20 is engaged at the membrane 14. Thus, fracturing the membrane 14 requires a more deliberate action by the user. As will be described in further detail below, the projection 66*a*,66*b* is dimensioned such that a central portion of the projection 66*a*,66*b*, in response to deflecting the extending member, engages and deflects the outer wall 20 of the container 12 proximate where the peripheral edge of the membrane 14 meets the outer wall 20 of the container 12. The description of the first projection 66*a* applies to the second projection 66*b* of the second extending member 64*b*.

As further shown in FIGS. 7-8, a first hinge 74*a* is defined in an underside of the first segment 68*a*. The first hinge 74*a* is positioned generally adjacent the first base 62*a* and adjacent the first projection 66*a*. The first hinge 74*a* is positioned generally between the first base 62*a* and the first projection 66*a*. The first hinge 74*a* assists in activating the dispenser 10 as further described below. The first hinge 74*a* is defined by a cut-out portion 76*a* generally proximate an end of the first segment 68*a* of the first extending member 64*a*. In an exemplary embodiment as shown, the cut-out portion 76*a* may be in the form of a notched structure including a generally v-shaped notch. Other structures are possible such as a more cut-out portion 76*a* defining a more contoured inner surface. Additional hinge structures will be described below. As discussed, the first hinge 74*a* of the first ending member 64*a* and the first hinge 74*b* of the second extending member 64*b* are similar in structure and this description applies to the first hinge 74*b* of the second extending member 64*b*. In an alternative embodiment, the first hinge 74*a*,74*b* could be positioned on an outer surface of the first segment 68*a*,68*b*. The first hinge 74*a*,74*b* could also be formed from cut-out portions in an outer surface and an underside surface of the first segment 68*a*,68*b*. The first hinge 74*a*,74*b* provides for enhanced pivoting of the first extending member 64*a* and the second extending member 64*b*.

As further shown in FIGS. 7-8, the second segment 70*a* has a first depending rib 80*a* that extends from an inside surface of the second segment 70*a*. The first depending rib 80*a* has a contoured surface and a greater length towards the distal end 72*a* of the second segment 70*a*. The first depending rib 80*a* cooperates with the outer wall 20 of the container 12 during activation as will be described in greater detail below. As can be appreciated from FIGS. 1, 7 and 8, the contoured surface of the first depending rib 80*a* may gradually meet with an additional intermediate contoured surface that joins with the contoured surface of the first projection 66*a*. As explained in greater detail herein, the depending ribs 80*a*,80*b* can have varying alternative structures as desired to enhance operability of the dispenser 10. For example, the depending ribs 80*a*,80*b* could have a greater amount of material that depends at proximate a distal end of the ribs 80*a*,80*b* wherein the ribs 80*a*,80*b* taper towards their respective first segments of the extending members.

As further shown in FIGS. 1, 3-4 and 7-8, the first fracturing mechanism 16*a* is positioned proximate the membrane 14 and at a first position on the container 12. The second fracturing mechanism 16*b* is positioned proximate the membrane 14 and at a second location on the container 12. In an exemplary embodiment, the second fracturing mechanism 16*b* is positioned generally opposite the first fracturing mechanism 16*a* (FIG. 4). The first fracturing mechanism 16*a* is positioned generally 180° from the second fracturing mechanism 16*b*. The first fracturing mechanism 16*a* and the second fracturing mechanism 16*b* may also be positioned and spaced at other radial locations about the container 12.

FIGS. 1-3 and 7-8 show the applicator 18, which can take various forms as described herein. In one exemplary embodiment, the applicator 18 is generally a porous member or sponge-type member. The applicator 18 may be considered to be a swab member. The applicator 18 generally has a cylindrical configuration and dimensioned to be cooperatively received in the opening 28 defined by the proximal opening 26 of the container 12. The applicator 18 is received within the opening 28 of the container 12 in an interference fit in an exemplary embodiment. As discussed above, the container 12 may have ribs 32 to cooperate in securing the applicator 18 to the container 12. The applicator 18 is in communication with the second chamber 24. A distal end of the applicator 18 may have an angled or tapered configuration to enhance desired dispensing characteristics.

A porous element applicator 18 may be made from a variety of different materials. The applicator 18 can be made of polyester, laminated foamed plastic, cotton or the like. In one exemplary embodiment, the porous element applicator 18 is made from medical grade polyurethane foam, especially useful in medical related applications such as for applying a surgical prep solution as further described below. Other materials that can be used for the applicator 18 include polyolefins, porous polyethylene, wool, gauze or other similar absorbent materials. Based on more viscous types of flowable materials M that could be used as described in greater detail below, the porous element can have certain modified features to enhance accommodation of more viscous materials. For example, the porous member may have a channel or hole defined through the applicator 18.

In certain exemplary embodiments, the porous element applicator 18 may contain or be impregnated with an additional material such as a colorant or dye. As the flowable material M contacts and passes through the porous element applicator 18, the colorant transfers a hue to the flowable material M wherein a user can tell where the flowable material has been applied to a surface. Such applications will be further described below. It is further understood that a filter member could be employed with the applicator 18, and the filter member could have a colorant associated therewith. The colorant selected will be compatible with contact with human skin in certain applications. It is further understood that the applicator 18 could incorporate other structures to assist and/or enhance dispensing of the flowable material M.

As will be described in greater detail below, once the membrane 14 is fractured as described, the applicator 18 receives and absorbs the material M as it is dispensed from the first chamber 22 and enters the dispensing chamber 24. The applicator 18 has a contact surface that is used to dab a desired area such as a skin surface having an insect bite. The dispenser 10 can be inverted and squeezed until the applicator 18 is wet. The dispenser 10 can then be held in a vertical position with the applicator 18 pointed upwardly. Alternatively, the porous element applicator 18 can be made of a material of relatively large porosity for passing droplets through the applicator 18 by gravity and for dispensing droplets from its exterior surface.

Figure 11:
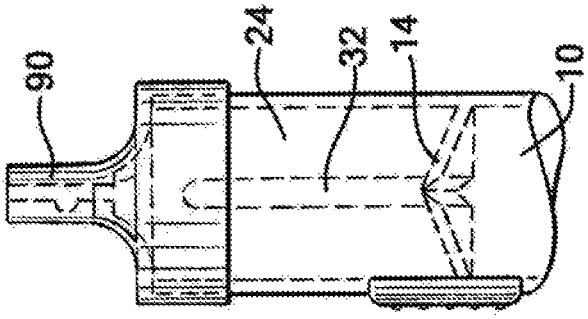
FIG. 11 is a partial elevation view of the dispenser supporting a dropper assembly.
Figure 10:
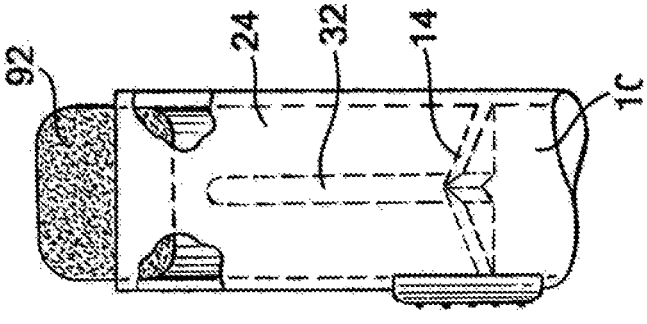
FIG. 10 is a partial elevation view of the dispenser supporting a swab assembly.

The applicator 18 could take various forms other than a porous member. For example, FIG. 11 shows the dispenser 10 having a dropper attachment 90. The second chamber 24 has the dropper attachment 90 attached thereto. The dropper 90 has an elongated spout with a passageway for dispensing droplets of the material. The dropper 90 has a cup-like portion that overlaps a portion of the outer surface of the proximal end. Once the membrane 14 is ruptured as described and material passes from the first chamber 22 to the dispensing chamber 24, droplets of the material can be dispensed through the spout. The dispenser 10 can be similarly manipulated to dispense the flowable material using the different applicators of FIGS. 10-13. In further examples, the applicator 18 could be a swab 92 (FIG. 10), a brush assembly 94 (FIG. 12), or a roller assembly 96 (FIG. 13) which can be used to apply the dispensed liquid or solid flowable material. The different applicators 18 may form an interference fit with the ribs 32 if desired while certain other applicators 18 will not cooperate with the ribs 32. The different applicators 18 are in communication with the second chamber 24 or dispensing chamber 24 as shown in FIGS. 10-13. Other types of applicators can also be used such as a sponge, foam member, cotton member, fabric member, gauze member, pen member or other types of members capable of transporting flowable materials. The applicator member could also be a flocked tip. A flocked tip could be used that is chemically reactive to various flowable materials used with the dispenser as well as other materials used for the applicator.

In an exemplary embodiment, the dispenser 10 is made of thermoplastic material. The material could be transparent, translucent or opaque. The preferred plastic material is polyethylene or polypropylene but a number of other plastic materials can be used. For example, low-density polyethylene, polyvinyl chloride or nylon copolymers can be used. In a preferred embodiment, a mixture of polypropylene and polyethylene copolymer or thermoplastic olefin elastomer is used. In another preferred embodiment, a mixture of polypropylene and Flexomer® (very low density polyethylene resins—VLDPE), available from Dow Chemical, is utilized. In addition, low density polyethylene with linear low density polyethylene can be used. It is essential that the dispenser be made of material which is flexible enough to allow sufficient force to rupture the membrane 14. Also, in a preferred embodiment, the dispenser is a one-piece integrally molded member.

Due to the enhanced features of the conical membrane 14, additional blends of polyethylene and polypropylene can be used that could not previously be used due to limitations such as in the molding capabilities of the materials in forming the dispenser or rupturability of the weld seams once the membrane is formed. For example, blends with an increased amount of polypropylene can be used with the angled or conical membrane as the membrane can be readily ruptured, and such blends further provide increased chemical resistant properties. With increased chemical resistance, the dispenser can be used to contain a wider variety of flowable substances. In prior designs utilizing such percentages of polypropylene, the membrane was not capable of being ruptured via finger pressure. A dispenser made solely of nylon is also possible.

The dispensers of the present invention could further be formed from other material formulations or compositions. In one particular exemplary embodiment, the dispenser is formed in the injection molding process wherein the process utilizes a further unique thermoplastic formulation. In particular, the process utilizes a unique formulation of polyethylene, polypropylene and polyvinylidene fluoride (PVDF) resin. The polyvinylidene fluoride provides for increased chemical resistance which allows the dispenser to contain a surgical prep solution (antiseptic solution) such as a chlorhexidine gluconate based solution, or CHG-based solution. In one exemplary embodiment, the formulation used for the dispenser 10 is a certain predetermined proportion of polyethylene, a certain predetermined proportion of polypropylene and a certain predetermined proportion of polyvinylidene fluoride. In another exemplary embodiment, the formulation used for the dispenser 10 is a certain predetermined proportion of polypropylene and a certain predetermined proportion of polyvinylidene fluoride. In other exemplary embodiments, the dispenser can be made entirely from polypropylene or the dispenser can be made entirely from polyvinylidene fluoride. It is understood that other components or additives could be incorporated depending on desired applications for the dispensers. It is further understood that these potential material formulations can be incorporated for any of the dispenser embodiments disclosed herein.

Still further materials can be used to form the dispenser in exemplary embodiments of the present invention. For example, the dispenser can be made from 100% nylon including 100% medical grade nylon. The dispenser could also be made from 100% polypropylene. The dispenser could also be made from 100% high density polyethylene or 100% polyethylene. In a further exemplary embodiment, the dispenser can be made from 100% polyvinylidene fluoride. Prior testing by the inventor showed that these materials are all highly chemically-resistant and suitable for containing certain types of surgical prep solutions such as CHG. Testing of dispensers made from such materials and holding CHG showed that they could meet the required shelf-life requirements for commercial distribution and sale. These materials, however, are more stiff and typically could not be used in an injection molded container using a membrane with a weld seam. With the present invention, however, a thicker weld seam is possible and even with a more stiff material, the fracturing mechanism allows the user to put more force onto the membrane to fracture the membrane than forces from squeezing via hand pressure directly on the container wall such as in prior embodiments.

It is understood that the dispensers of the present invention could be formed from yet other thermoplastic material formulations and compositions. Other additives could also be incorporated or blended into the formulations based on desired characteristics for a particular application of the dispenser.

Certain exemplary embodiments of the preferred dispenser 10 has a length of about 1.5 to about 3.0 inches, although larger containers can be utilized, with 2 to about 2.5 inches being preferred for certain embodiments. In other exemplary embodiments, the dispenser could have a length of about 6 to about 8 inches. The outside diameter of the container assembly 12 is about 0.30 to about 1.0 inches. The second chamber 20 is preferably about 0.20 to about 1.5 inches and preferably 0.75 inches in length. The overall size of the dispenser 10 can vary depending on the application for the dispenser 10. The membrane 14 preferably has a thickness of about 0.02 to about 0.0625 inches. The weld seams 40 have a preferable thickness of about 0.003 to about 0.008 inches and preferably about 0.003 to 0.004 inches. In another exemplary embodiment the weld seam 40 thickness may be 0.006 inches. The above dimensions can be varied depending upon overall dispenser size. As discussed, the fracturing mechanism 16 on the dispenser 10 allows a user to provide more force to membrane 14 to fracture the weld seams 40. Accordingly, the weld seams 40 can have an even thicker dimension in certain exemplary embodiments. The weld seam 40 thickness $t_2$ can be increased to a range of approximately 0.006 inch to 0.015 inch. In a particular exemplary embodiment, the weld seam 40 thickness $t_2$ is in the range of approximately 0.010 inch to 0.014 inch, and a in a further exemplary embodiment 0.014 inch to 0.015 inch, or a thickness of 0.014 inch. It is further understood that the fracturing mechanism 16 can be used with membranes 14 having thinner weld seam thicknesses such as in the 0.003 to 0.008 inch range wherein the membrane 14 is easier to fracture for the user. Accordingly, the weld seam thicknesses can be in the range of approximately 0.003 inch to 0.015 inch in some exemplary embodiments. In additional exemplary embodiments, the weld seam thicknesses can in the range of approximately 0.008 inch 0.012 inch. In still further embodiments, the weld seam thicknesses may be in the range of approximately 0.012 inch to 0.014 inch. Thus, the embodiments of the present invention significantly increase the range of weld seam thicknesses that can be utilized in the dispensers. This has not been possible until the present invention. With thicker weld seam thicknesses, the overall thickness of the membrane structure can also increase. In certain exemplary embodiments and without limitation, the membrane thickness could be 0.01 inch or greater. It is further understood that the length of the extending members can vary, and in many embodiments, the extending members do not extend past a sealed distal end of the container body. In a particular embodiment explained in greater detail below, a portion of the extending members can extend past the distal end of the container to provide for greater leverage or mechanical advantage.

It is understood that the dispenser of FIGS. 1-39 is made in an injection molding process wherein the dispenser is of an integral one-piece construction in an exemplary embodiment. The dispenser 10 may be filled with a flowable material M and sealed as described herein. It is understood that the flowable material M may be a surgical prep solution such as a CHG-based solution. It is further understood that in this embodiment, the flowable material M may be a more viscous material.

Figure 14:
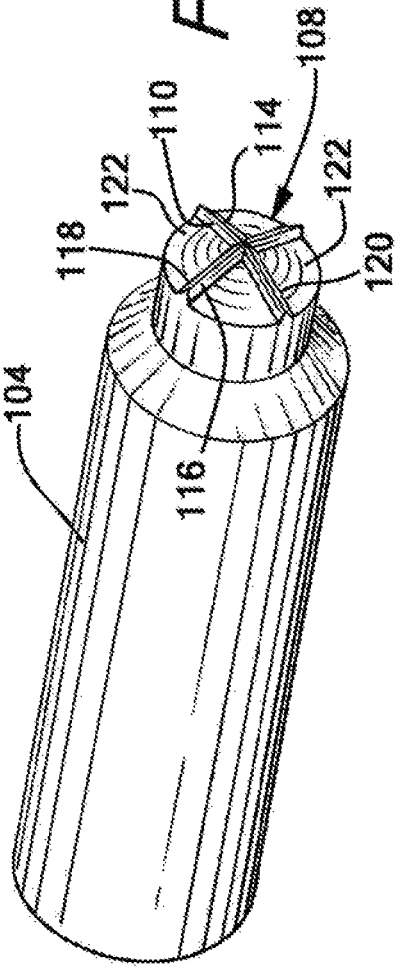
FIG. 14 is a perspective view of a core pin having an end face with a raised structure.
Figure 15:
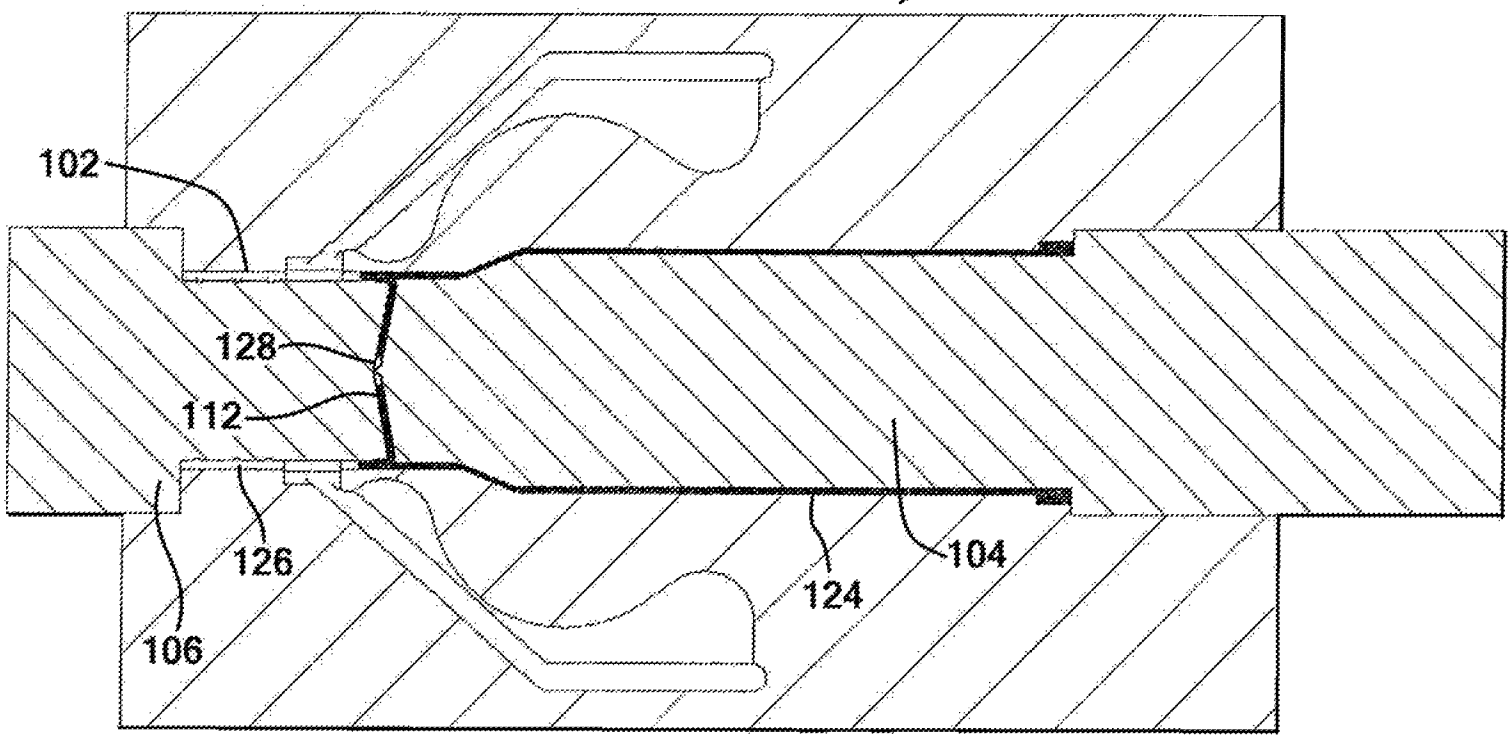
FIG. 15 is a schematic cross-sectional view of a mold and a portion of the material for forming the dispenser of FIG. 1.

The method of making the dispenser 10 is generally illustrated in FIGS. 14-16 and is similar to the process described in U.S. Pat. No. 6,641,319. The dispenser 10 is preferably produced in a single molding operation thus providing a one-piece injected-molded part. As shown in FIG. 15, a mold 100 is provided having a mold cavity 102 therein. The mold cavity 102 is dimensioned to correspond to the exterior surface of the dispenser 10. A first core pin 104 and a second core pin 106 are provided. The first core pin 104 is dimensioned to correspond to the interior surface of the dispenser 10. It is understood that the core pin could have a shoulder to form the tapered portion, or necked-down portion of the dispenser 10. Alternatively, the core pin could have a constant diameter if there is to be no tapered portion.

As shown in FIGS. 14 and 15, the first core pin 102 has an end face 108 that is angled or conically-shaped. The end face 108 also has raised structures 110 thereon. The second core pin 106 has an end face 112 that is generally recessed. The raised structures 110 on the first core pin 84 are in the form of a ridge 114. The ridge 114 is what provides for the depressions or weld seams 40 at the certain thickness in the membrane 14. In a preferred embodiment, the ridge 114 has a first wall 116 adjoining a second wall 118 to form a line 120.

Furthermore, in an exemplary embodiment, the ridge 114 comprises a plurality of ridges 114 radially extending substantially from a center point of the end face 108. The ridges 114 define a plurality of membrane segments, or mold gaps 122, between the ridges 114. Thus, it can be understood that the raised structure 110 in the form of the ridges 114 provides the corresponding structure of the membrane 14. Although shown as triangular, the ridges 114 can be formed in a number of shapes. In addition, the ridges 114 can be arrayed in a multitude of shapes, including a single line, a cross, a star, or an asterisk. Varying the shape of the ridges 114 will affect the shape of the channels 50 in the membrane 14.

The first core pin 104 is inserted into the mold 100 with the raised structure 110 facing into the mold cavity 102. A first space 124 is maintained between the mold 80 and the length of the first core pin 84. The second core pin 106 is also inserted into the mold cavity 102 wherein a second space 126 is maintained between the mold 80 and the second core pin 86. The core pins 104,106 are generally axially aligned wherein the end face 108 of the first core pin 104 confronts the end face 112 of the second core pin 106 in spaced relation. Thus, a membrane space 128 is defined between the respective end faces 108,112 of the core pins 104,106. End plates may be installed on end portions of the mold 100 to completely close the mold. From the figures, it can be appreciated that the mold is configured to also define cavities to form the fracturing mechanisms as well during the injection molding process.

As shown in FIG. 15, molten thermoplastic material is injected into the mold cavity 102 through an inlet. The material flows into the first space 124, second space 126, and membrane space 128. The plastic injection is controlled such that the plastic enters the membrane space 128 simultaneously in the circumferential direction. The raised structures 110 separate the material into separate mold segments 34,36 that flow into the mold gaps. As shown in FIGS. 15-16, the mold segments 34,36 flow first into the wider portions of the mold gaps 93 as this is the area of least resistance. The material continues to flow into the membrane space 128 and then the adjacent mold segments 34,36 abut at the interface area 38 to form the weld seams 40. As can be appreciated from FIG. 15, the weld seams 40 have a lesser thickness than the membrane thickness. The mold segments 34,36 meet and abut at the interface area 38 to form the weld seam 40. It is understood that the membrane space 128 is angled thus forming the angled membrane 14. In addition, the molten plastic further travels into the cavity portions of the mold to form the respective extending members 64*a*,64*b* of the fracturing mechanism 16. During this process, air is vented from the mold cavity 102 as is conventional.

Once the plastic injection is complete, the material is allowed to cool. A cold water cooling system could be utilized wherein cold water is pumped into the mold 100 outside of the cavity 102 if desired. Once cooled, the dispenser 10 can be removed from the mold 100.

Figure 18:
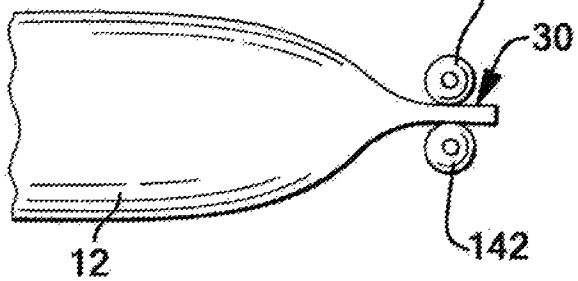
FIG. 18 is a partial schematic view of a sealing apparatus for sealing a distal end of the dispenser to contain the flowable substance.
Figure 17:
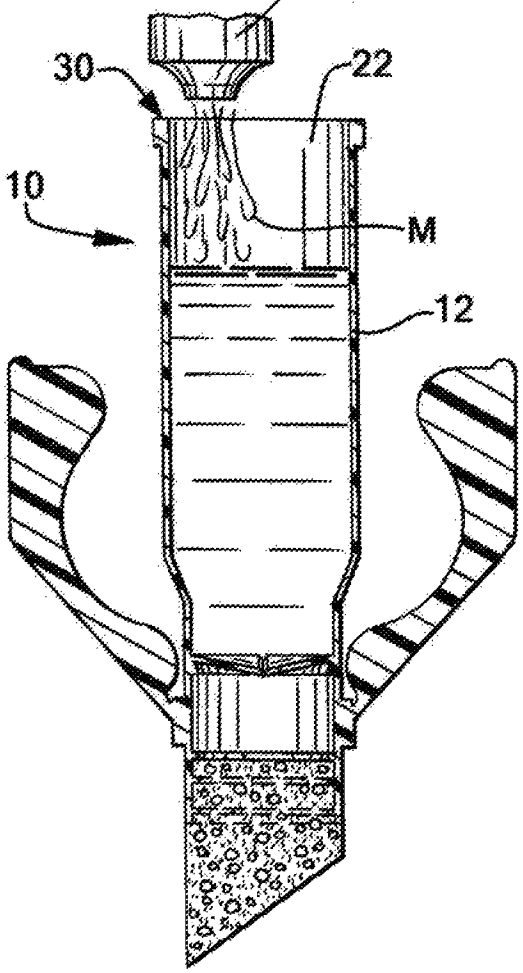
FIG. 17 is a schematic view of the dispenser being filled with a flowable substance or flowable material by a filling apparatus.

As shown in FIG. 17, the dispenser 10 can be passed on to a filling apparatus 140. The dispenser 10 is then filled with flowable material M. As shown in FIG. 18, the distal end 30 of the dispenser 10 is sealed by heat sealing dies 142. The excess end portion can then be cut-off and discarded. It is understood that heat sealing is one preferred seal while other sealing methods could also be utilized.

Thus, a one-piece injection molded dispenser is provided. The one-piece construction provides a more repeatable part and at greater manufacturing efficiency than providing a separate piece that is secured into a container assembly. If desired, however, the membrane 14 could be separately molded and affixed into a container assembly 12. Similarly, the components of the fracturing mechanism 16 could be separately molded and affixed to the container assembly 12. A one-piece molding process, however, is preferred. In addition, because the membrane 14 is molded to have the weld seams, radial depressions, or bands, an additional manufacturing step such as scoring to create a weakened rupturable member is unnecessary. This allows the manufacture of dispensers having relatively small diameters since there is no need to allow sufficient clearance for a scoring tool. In such small configurations, it is difficult to control the scoring operation. By forming the depressions by injection molding, the desired thicknesses can be closely controlled. The membrane 14 also resists fracture or rupture from hydraulic pressure while being easily fracturable or rupturable when forces are applied to the membrane. Also, the construction of the membrane 14 allows for the precise control of material to be dispensed by controlling the amount of force on the membrane 14. It is further understood that the depressions or channels could be formed on both sides of the membrane 14 if desired. In such configuration, however, the ability of the membrane 14 to also function as a check valve is lessened. In a preferred embodiment, however, the membrane 14 has the depressions molded on only one side. It is further understood while certain dimensions are preferred for certain embodiments, dispensers of all sizes having similar relative dimensions can be formed according to the present invention. It is also understood that in certain embodiments of the multi-chambered dispenser, the rupturable member could be other than a weld seam if desired. For example, a scored line could be provided, a frangible seam, or other rupturable member.

Figure 19:
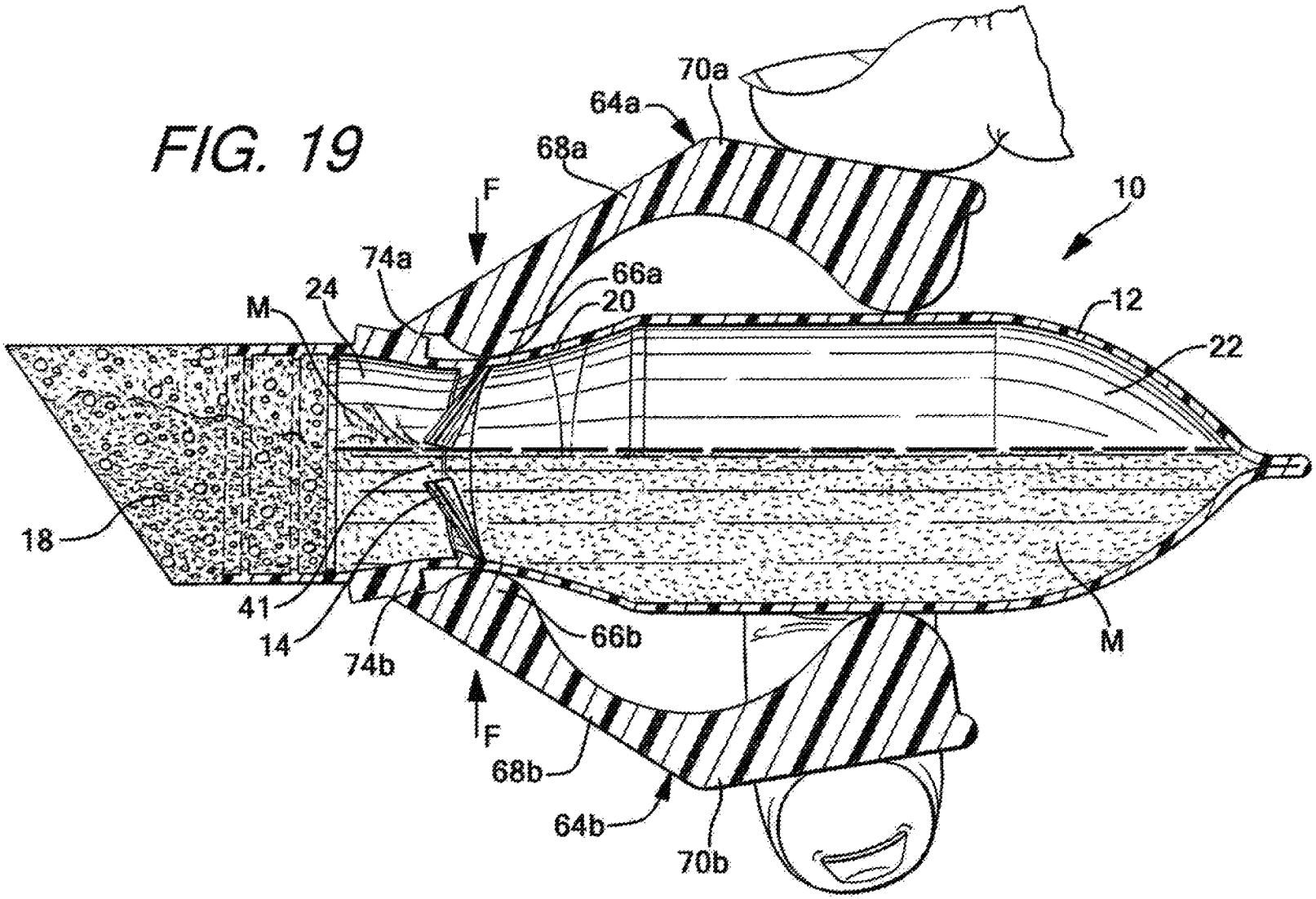
FIG. 19 is a cross-sectional view of the dispenser of the present invention holding a flowable material and showing a user fracturing the membrane of the dispenser.

FIGS. 19-22 disclose operation of the dispenser 10 after being filled and sealed as shown in FIGS. 17-18. In operation, a user applies a selective force F on the dispenser 10 at desired locations on the dispenser 10. As shown in FIG. 19, the user grasps the dispenser 10 where a thumb is positioned on the first extending member 64*a* and a finger such as a forefinger is positioned on the second extending member 64*b*. The user squeezes the thumb and forefinger to apply force to the membrane 14. In particular, the user may place a thumb on the first extending member 64*a* and a finger is positioned on the second extending member 64*b*. It is understood that the user can place the thumb and finger on the respective first segments 68*a*,68*b* or the second segments 70*a*,70*b* or a combination. FIG. 19 shows the user engaging the second segments 70*a*,70*b*. In response to the squeezing motion of the user, the first projection 66*a* and the second projection 66*b* move towards one another to a second position wherein the outer wall 20 is deflected, and wherein a force F is applied to the membrane 14 wherein the weld seams 40 rupture to provide the opening 41 through the membrane 14. The first hinge 74*a* assists in the pivoting motion of the first segment 68*a* of the first extending member 64*a*, and the first hinge 74*b* assists in the pivoting motion of the first segment 68*b* of the second extending member 64*b*.

Figure 20:
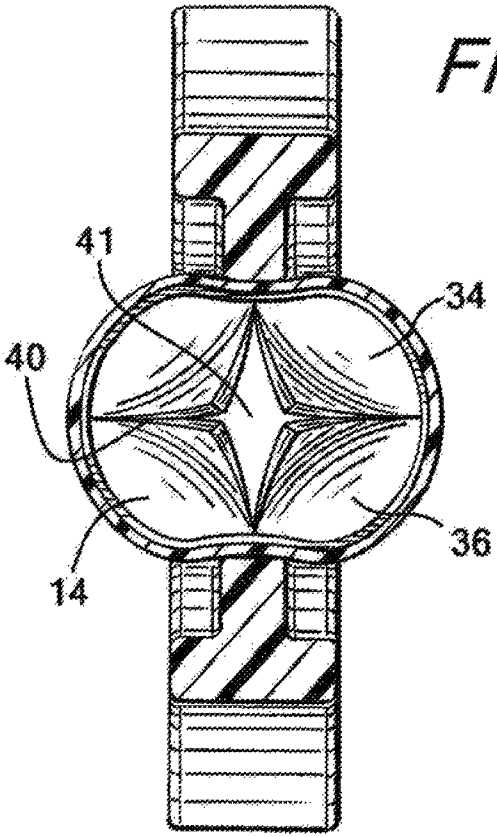
FIG. 20 is an end view of the dispenser having forces applied thereto wherein the membrane is fractured along weld seams defining an opening through the membrane.
Figure 22:
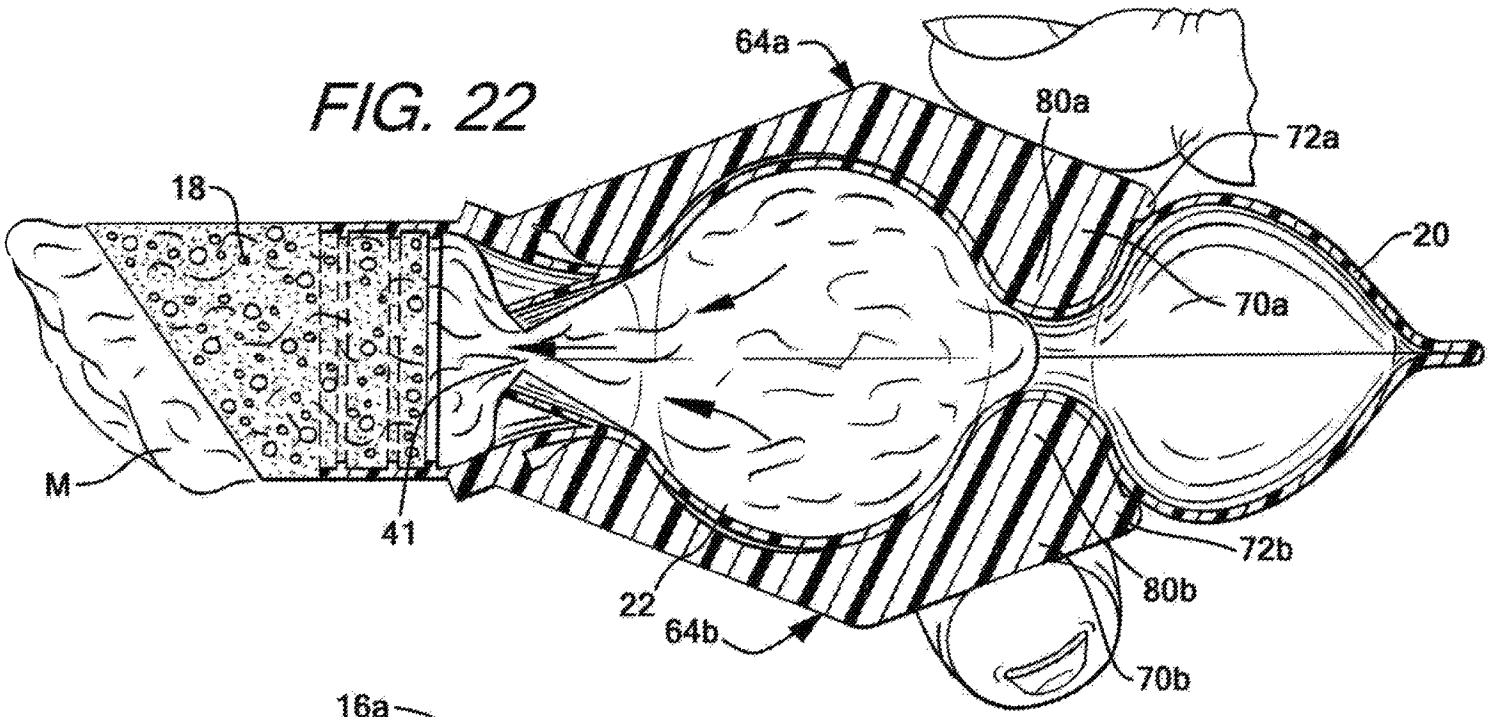
FIG. 22 is a cross-sectional view of the dispenser of the present invention and showing a user further manipulating the flowable material through the membrane.

With deflection of the first extending member 64*a* and the second extending member 64*b* as shown in FIG. 19, sufficient force F is applied to deflect the outer wall 20 wherein force F is transmitted to the membrane 14 causing the membrane 14 to fracture, rupture or shear along the weld seams 40. The membrane 14 ruptures only along the weld seams 40 to create the membrane openings 41 such as shown in FIG. 20. The projection 66*a* is dimensioned such that the central portion of the projection engages and deflects the outer wall at a location proximate where the peripheral edge of the membrane meets and connects with the outer wall of the container. The angled membrane 14 provides a distinct audible "popping" sound when fracturing along the weld seams 40. It has further been found that the angled membrane 14 with the weld seam 40 provides a more distinct audible sound. Upon rupture of the membrane 14, material passes from the first chamber 22 through the membrane 14 and into the second chamber 24 or dispensing chamber 24. The material flow rate through the membrane 14 and into the dispensing chamber 24 is controlled by the degree of membrane opening 41 which is directly related to the amount of force F applied to the membrane 14 by the user. Therefore, the user can precisely regulate the flow of material after rupture of the membrane 14. In addition, the membrane 14 can preferably have elastic characteristics wherein when force F is removed, the membrane 14 returns substantially to its original position. While the weld seams 40 may be fractured, the segments 34,36 can form a close enough fit to prevent material from flowing past the membrane 14 without additional pressure on the material. Thus, the membrane 14 can act as a check valve to prevent unwanted flow of the material back into the first chamber 22.

Figure 21:
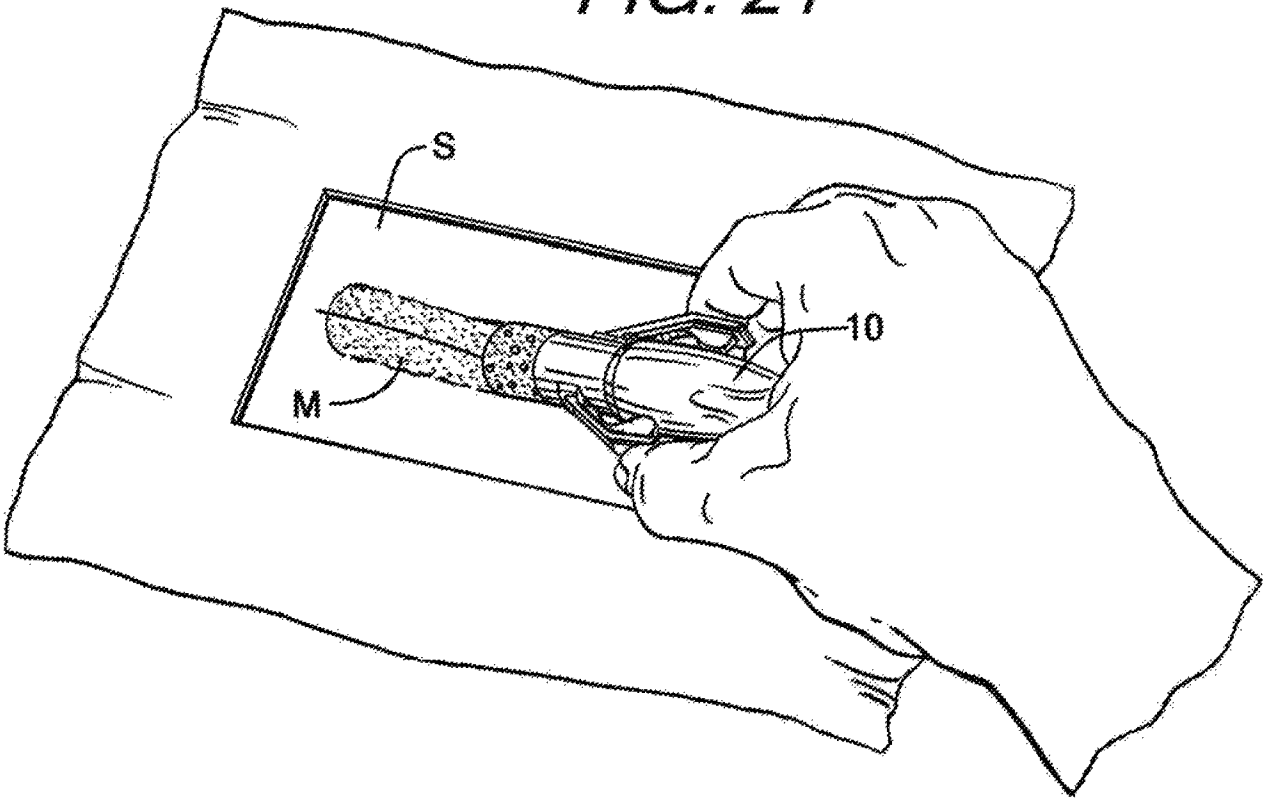
FIG. 21 is a perspective view of a user dispensing the flowable material onto a receiving surface.

As the flowable material M continues to pass through the membrane 14, the flowable material M saturates the applicator 18 wherein the flow material M can be dispensed from the dispenser and where the user can apply the flowable material M to a desired location. FIG. 21 shows the user dispensing the flowable material M from the dispenser 10 and on to a receiving surface. It is understood that the user could use the entire hand to perform the squeezing action on the dispenser 10 to dispense the flowable material M.

It is understood that the dispenser 10 may be used to dispense various flowable materials in the form of liquids such as surgical prep solutions as described herein. The structures of the first extending member 64*a* and the second extending member 64*b* provide for enhanced operation such as when the flowable material M is a more viscous material that may not freely flow past the membrane 14 and through the applicator 18. The second segment 70*a* of the first extending member 64*a* and the second segment 70*b* of the second extending member 64*b* can be used to assist in forcing the flowable material M from the first chamber 22 and ultimately through the applicator 18. As can be appreciated from FIG. 22, the user can further press on the second segments 70*a*,70*b* such as proximate the distal ends 72*a*,72*b* of the extending members 64*a*,64*b*. As the user presses the second segments 70*a*,70*b* towards one another, the first depending rib 80*a* and the second depending rib 80*b* contact opposite portions of the outer wall 20 of the container 12 and deflect the outer wall portions inwards towards one another. In such movements, the first depending rib 80*a* of the first extending member 64*a* and the first depending rib 80*b* of the second extending member 64*b* engage the outer wall 20 of the container 12 to deflect portions of the outer wall 20 toward one another. Such deflection of the outer wall 20 reduces the volume of a segment of the first chamber 22 proximate the membrane 14 thus forcing the flowable material M past the membrane 14 and through the applicator 18. The user can continue to press on the extending members 64*a*,64*b* to manipulate the outer wall 20 of the container 12 and force the flowable material M from the dispenser 10. It is also understood that the first extending member 64*a* and the second extending member 64*b* can have structures to assist in promoting straight movement towards the container outer wall 20 to assure proper fracturing of the membrane 14 and to minimize the chances for the members 64*a*,64*b* to become offset and deflect on sides of the container 12 rather than right onto the container 12. In one exemplary embodiment, the depending ribs 80*a*,80*b* may have an extended width to be capable of having a greater surface to surface engagement with the outer wall 20 of the container 12 in a lateral direction. It is understood that the first depending rib 80*a* and the second depending rib 80*b* can also have alternative configurations based on the desired operability of the dispenser 10. Such other rib configurations can depend on the type of flowable material M that is being contained and dispensed from the dispenser. Additional rib configurations will be further described herein.

Figure 23:
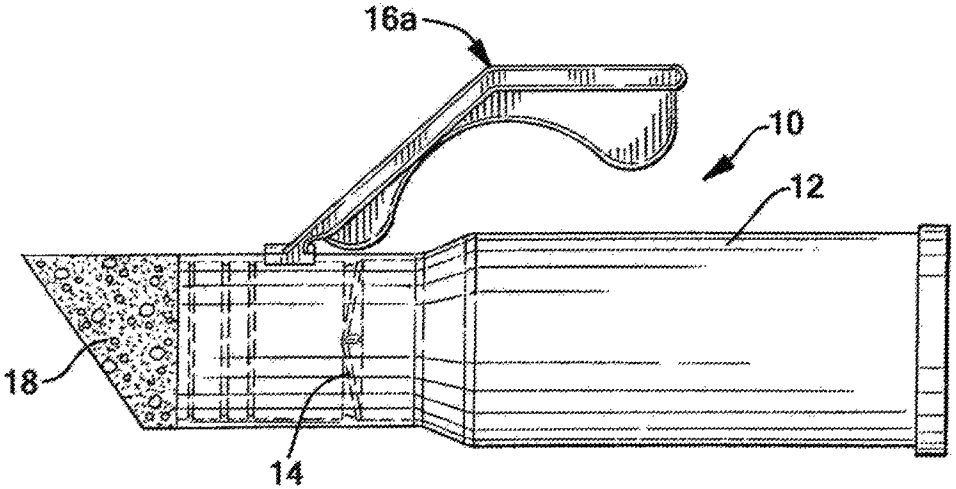
FIG. 23 is a side elevation view of an alternative embodiment of the dispenser.
Figure 24:
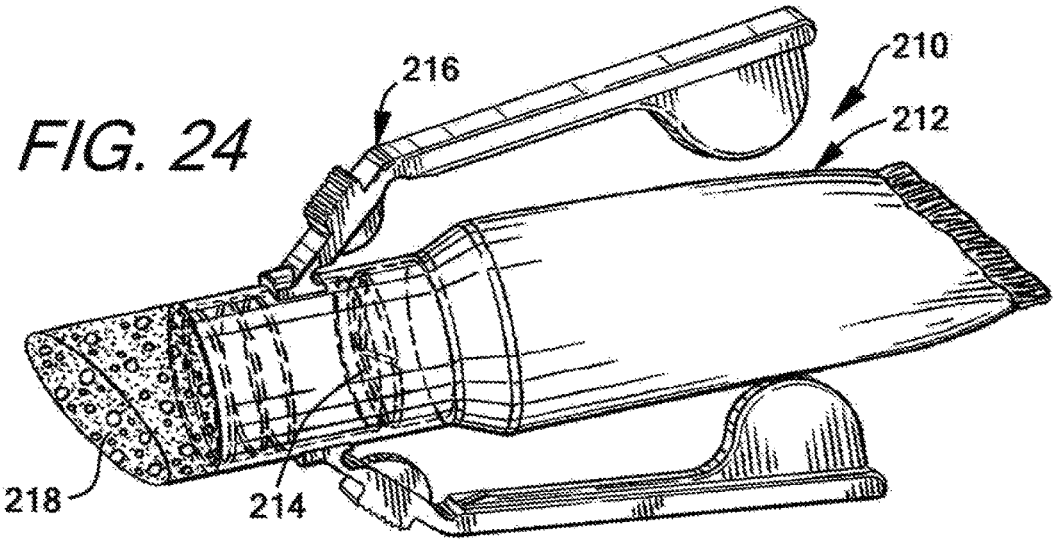
FIG. 24 is a perspective view of another embodiment of a dispenser according to the present invention.
Figure 25:
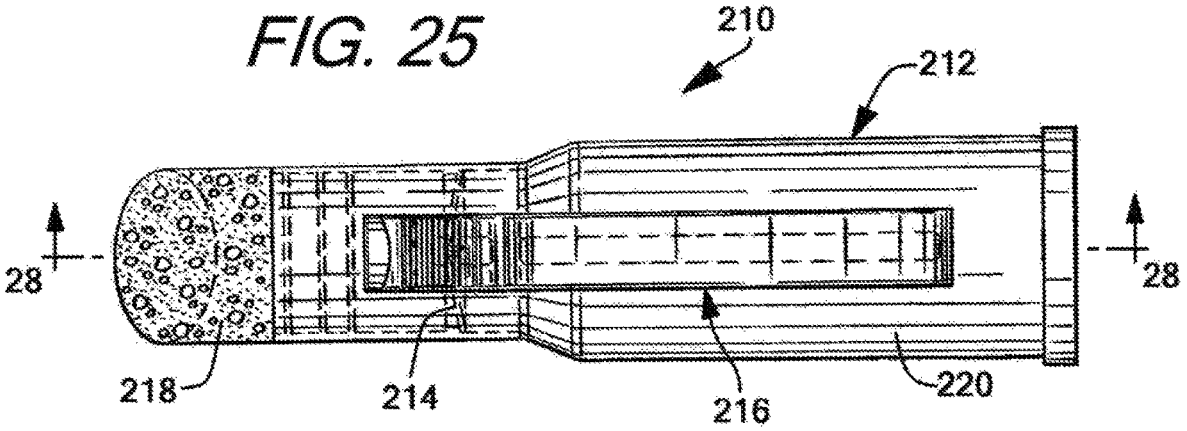
FIG. 25 is a top view of the dispenser of FIG. 24.

FIGS. 1-22 disclose the dispenser 10 having the first rupturing mechanism 16*a* and the second rupturing mechanism 16*b*. The dispenser 10 could also have an alternative configuration utilizing a single rupturing mechanism 16. For example as shown in FIG. 23, the dispenser 10 has only the first rupturing mechanism 16*a*. Other structures are generally identical. In operation, it is understood that a user would press the first rupturing mechanism 16*a* with a thumb while fingers or other portions of the hand wrap around a bottom portion of the container 12 opposite the first rupturing mechanism 16*a*. This pressing action results in fractionating the membrane 14 wherein the flowable material M can be dispensed from the dispenser 10.

FIGS. 24-39 disclose another embodiment of the dispenser according to an exemplary embodiment of the present invention. The dispenser of FIGS. 24-39 is similar to the dispensers shown in FIGS. 1-23 and is designated with the reference numeral 210. The descriptions above regarding the dispenser 10 of FIGS. 1-23 are generally applicable to the identical components of the dispenser 210 of FIGS. 24-39. The dispenser 210 generally includes a container 212 or container assembly 212, a rupturable membrane 214 or fracturable membrane 214, a rupturing mechanism 216 or fracturing mechanism 216, and an applicator 218. It is understood that the dispenser 210 can function without the use of an applicator 218 if desired wherein the benefits of the invention are still realized.

With the dispenser 210 of FIGS. 24-39, the container 212, the fracturable membrane 214 and the applicator 218 structures are generally similar to the corresponding structures of the dispenser 10 in FIGS. 1-23. The description above applies to these structures, and these structures will not be further described for this exemplary embodiment. The fracturing mechanism 216 has additional features and will be described in further detail below.

Figure 26:
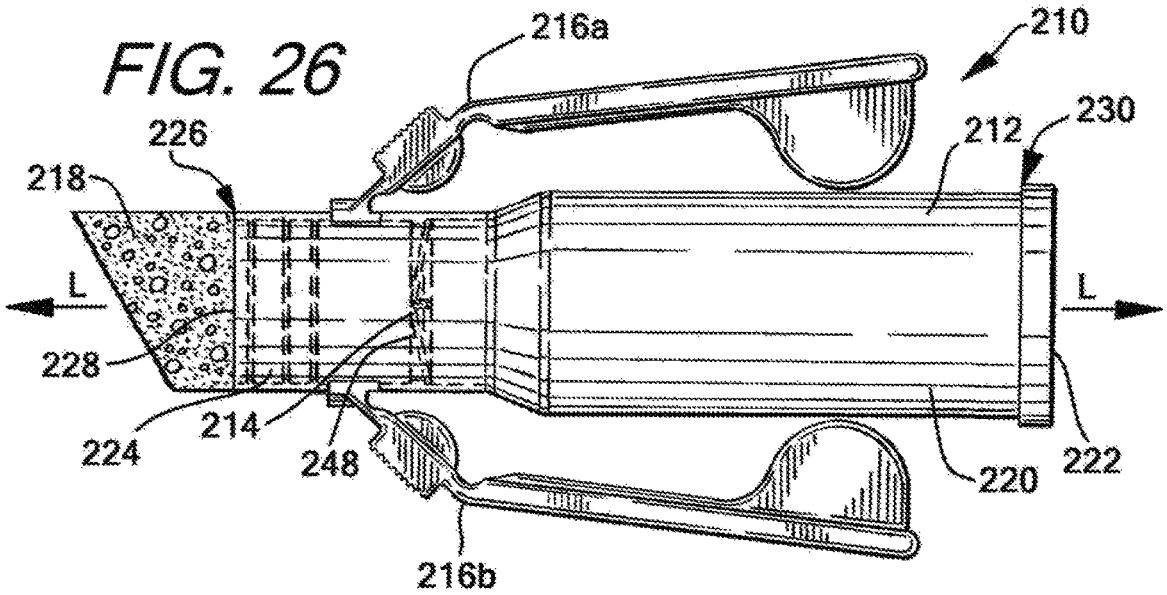
FIG. 26 is a side elevation view of the dispenser of FIG. 24.
Figure 28:
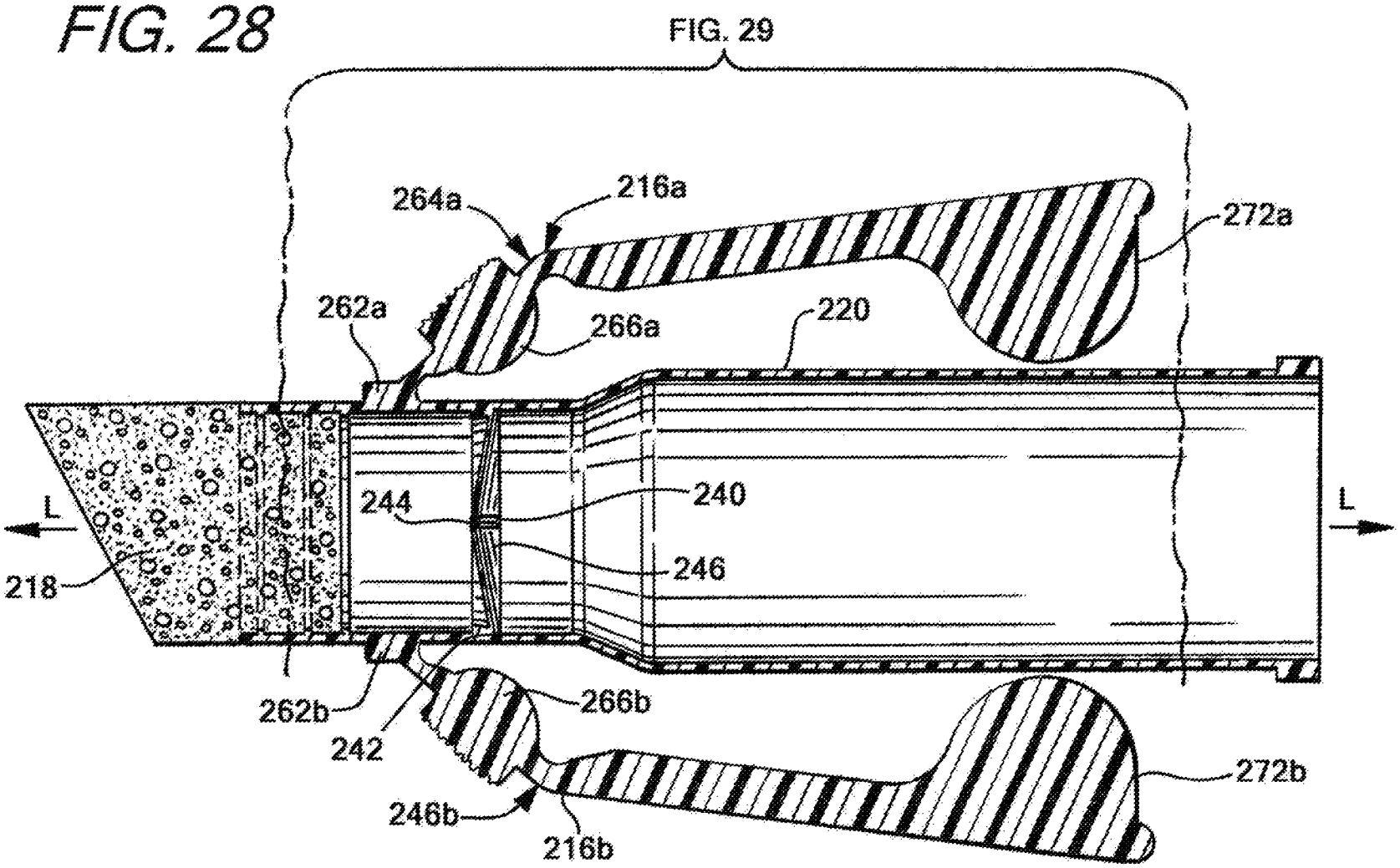
FIG. 28 is a cross-sectional view of the dispenser taken along lines 28-28 in FIG. 25.
Figure 29:
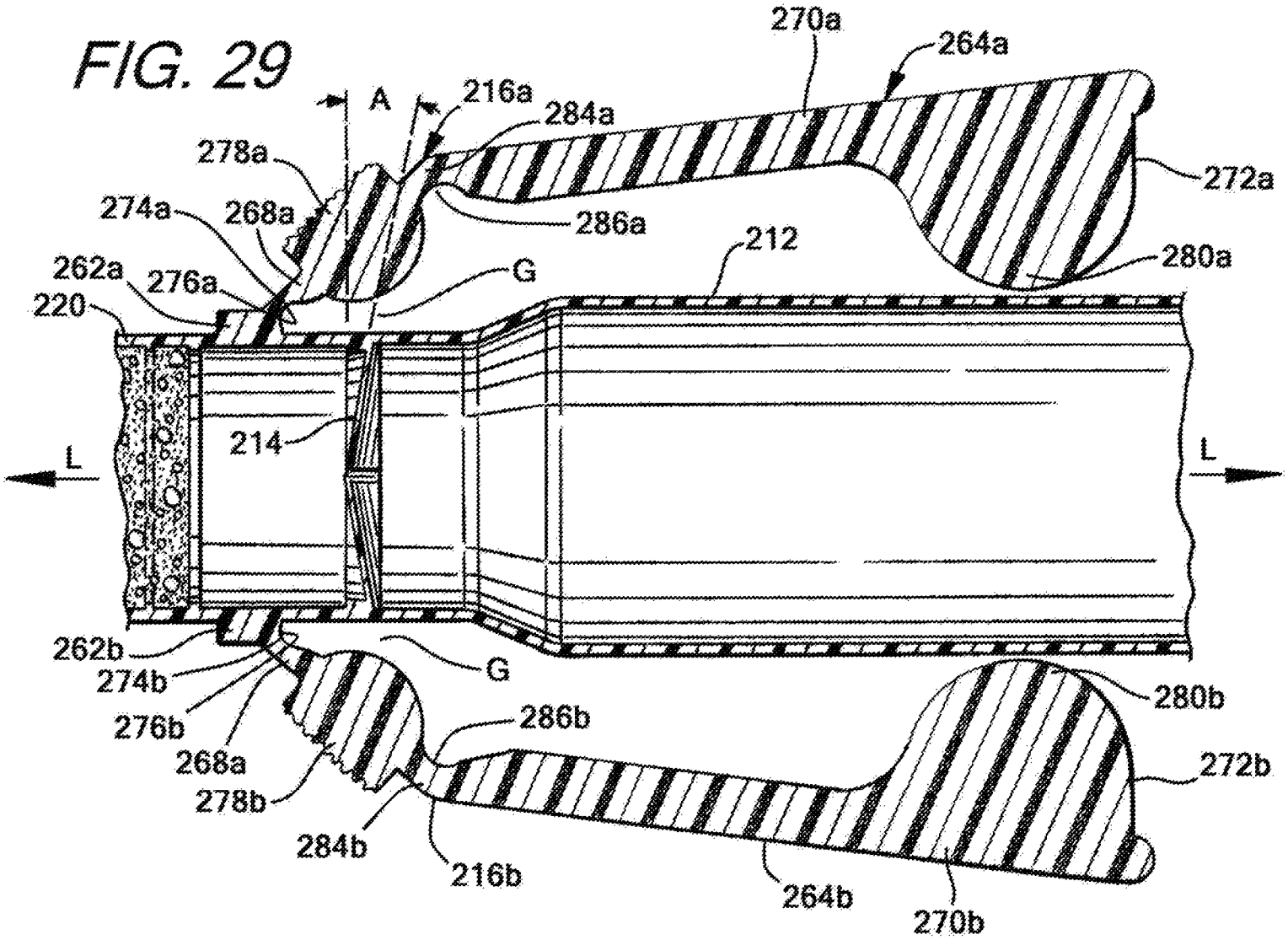
FIG. 29 is a partial enlarged cross-sectional view of a portion of the dispenser and of the area indicated in FIG. 28.

As shown in FIGS. 26, 28 and 29, the fracturing mechanism 216 or rupturing mechanism 216 includes a first rupturing mechanism 216*a* and a second rupturing mechanism 216*b*. The first rupturing mechanism 216*a* has a first base 262*a*, a first extending member 264*a* and a first projection 266*a*. The second rupturing mechanism 216*b* has a second base 262*b*, a second extending member 264*b* and a second projection 266*b*. The first base 262*a* and the second base 262*b* are generally identical to the embodiment above.

FIGS. 28 and 29 further show the first extending member 264*a* and the second extending member 264*b*. The first extending member 264*a* and the second extending member 264*b* are generally symmetrical and similar in structure. The structures of the first extending member 264*a* will be described with the understanding that the description also applies to the second extending member 264*b*. The first extending member 264*a* has a length that extends along the length of the container 212. The first extending member 264*a* defines a first segment 268*a* and a second segment 270*a*. The first segment 268*a* extends away from the first base 262*a* and generally at an angle from a central longitudinal axis L defined by the container 212. The second segment 270*a* extends from the first segment 268*a* and extends generally at an angle from the first segment 268*a* as well as the longitudinal axis L. It is understood that the second segment 270*a* could also be structured to extend generally parallel to the longitudinal axis L. The first segment 268*a* and the second segment 270*a* can have generally smooth planar surfaces to define a platform for a user's thumb and/or fingers during operation as described in greater below. The length of the first segment 268*a* and the second segment 270*a* are dimensioned such that a distal end 272*a* of the second segment 270*a* extends to and is proximate at least a midportion of the overall length of the dispenser 210, and may further extend past the midportion.

As further shown in FIGS. 28 and 29, the first extending member 264*a* may have an engagement pad to indicate where a user should engage the member during activation. The first extending member 264*a* has a first engagement pad 278*a* positioned proximate a midportion of the first segment 268*a*. The first engagement pad 278*a* is generally opposite the first projection 266*a*. The first engagement pad 278*a* has a plurality of ridges but could also have other structures to facilitate engagement with a user's thumb/fingers. As discussed further below, the first engagement member 264*a* may have the engagement pad positioned at other locations or include additional engagement pads. It is understood that the above description regarding the first extending member 264*a* and the engagement pad 278*a* also applies to the second extending member 264*b*. The engagement pad 278*a* could be positioned only on one of the extending members 264*a*,264*b*.

As further shown, the first projection 266*a* is positioned generally between an inner surface of the first extending member 264*a* and the container 212. The first projection 266*a* depends from the extending member and thus occupies a space defined between the container 212 and the first segment 268*a* of the first extending member 264*a*. The first projection 266*a* is a finger-like member positioned between the first extending member 264*a* and the container 212. The first projection 266*a* extends in a direction generally parallel to the longitudinal axis L of the dispenser 210. The first projection 266*a* has a length wherein portions of the first projection 266*a* extend on both sides of the membrane 214. The first projection 266*a* further has a contoured surface in an exemplary embodiment. In an exemplary embodiment, the first projection 266*a* depends from the first segment 268*a* and is spaced from the container 212 to define a gap G when the first extending member 264*a* is in a first or neutral position, e.g., prior to deflection of the extending member. The gap G is thus initially maintained.

As further shown in FIGS. 28-29, a first hinge 274*a* is defined in an underside of the first segment 268*a* by a cut-out portion 276*a*. The cut-out portion 276*a* defines a generally smoothly contoured surface in the underside of the first segment 268*a*. The first hinge 274*a* is positioned generally adjacent the first base 262*a* and adjacent the first projection 266*a*. The first hinge 274*a* is positioned generally between the first base 262*a* and the first projection 266*a*. The first hinge 274*a* assists in activating the dispenser 210 as further described below.

Figure 32:
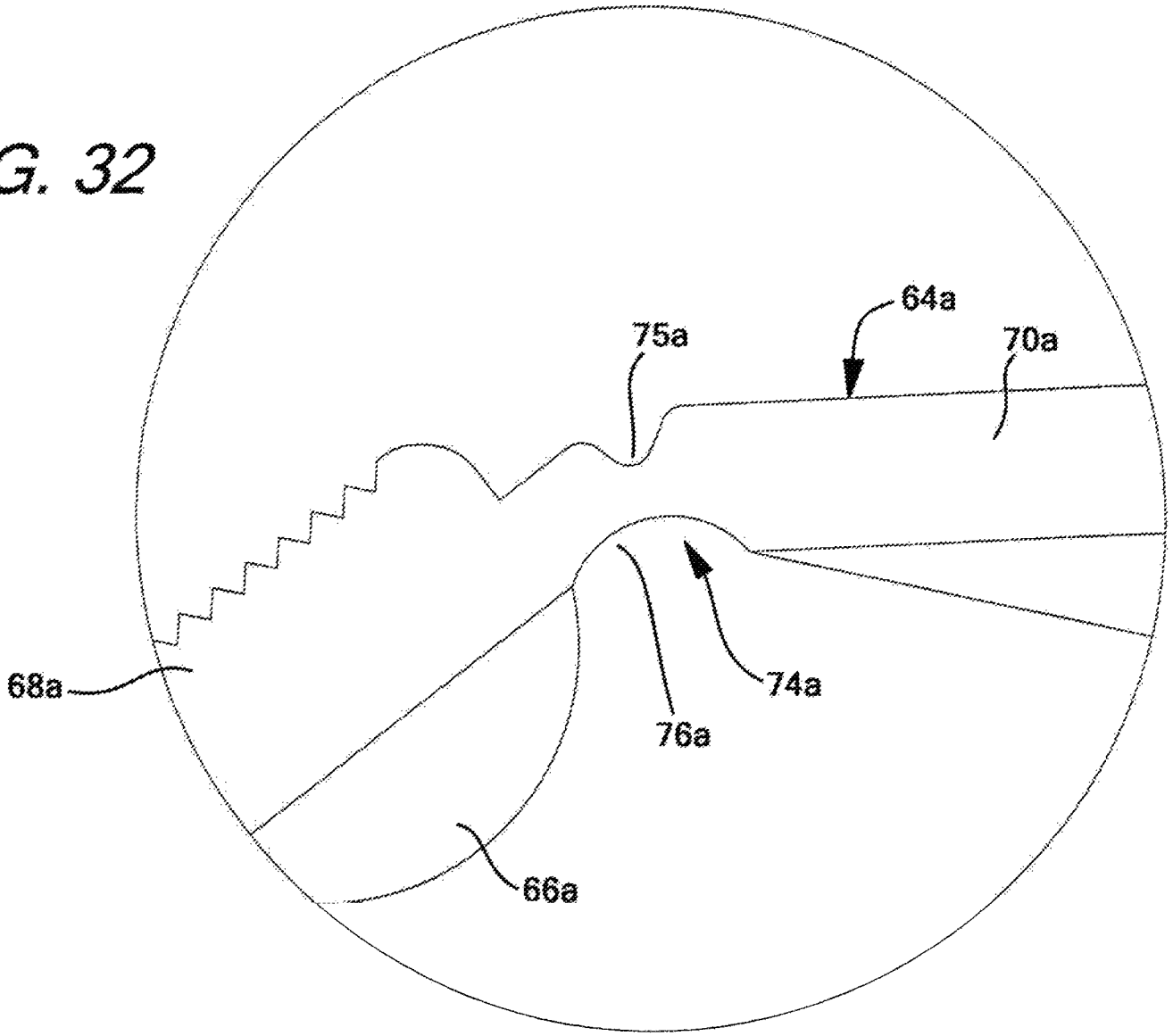
FIG. 32 is a partial enlarged view of an alternative hinge structure for the dispenser of the present invention.

As further shown in FIGS. 28-29, the second segment 270*a* has a first depending rib 280*a* that extends from an inside surface of the second segment 270*a*. The first depending rib 280*a* has a contoured surface and a greater length towards the distal end 272*a* of the second segment 270*a*. The first depending rib 280*a* cooperates with the outer wall 220 of the container 212 during activation as will be described in greater detail below. As further shown in FIGS. 28-29, a second hinge 284*a* is defined in the first extending member 264*a*. The second hinge 284*a* is positioned proximate an interface area between the first segment 268*a* and the second segment 270*a*. A second cut-out portion 286*a* is defined at this interface area to define the second hinge 284*a*. The second cut-out portion 286*a* defines a smoothly contoured surface on the inner surface of the first segment 268*a*. The second hinge 284*a* assists in activating the dispenser 210 as further described below. Thus, the first segment 268*a* has thinned out portions at its respective distal ends wherein a central portion of the first segment 268*a* has a thicker more robust dimension at the locations of the first finger pad and the first projection 266*a*. The second hinge 284*a* also has a thinner dimension than the second segment 270*a* of the first extending member 264*a*. As shown in FIG. 32, it is further understood that in an alternative embodiment, the second hinge 284*a*,284*b* can be formed on an outer surface of the first extending member 264*a*,264*b*. In one embodiment, the second hinge could be a generally v-shaped notch 75*a* in an outer surface of the extending member. Similar to the first hinge, the second hinge 284*a*,284*b* could also be formed by a cut-out portion in both the underside and outer surface of the first extending member (FIG. 32). The hinges could also include only a cut-out portion on the outer surface of the extending member. It is further understood that the respective first hinges 274*a*,274*b* and second hinges 284*a*,284*b* can be dimensioned or structured to possess a directed flexibility.

For example, it may be desirable for the first hinges 274*a*, 274*b* to be somewhat less flexible than the second hinges 284*a*,284*b* in certain exemplary embodiments. A user will need to apply a more deliberate increased force on the first segments 268*a*,268*b* to fracture the membrane, which minimizes inadvertent fracturing the membrane 214. Having the second hinges 284*a*,284*b* possess more flexibility can assist in the user's ability to more easily manipulate the flowable material from the dispenser 210 using the depending ribs 280*a*,280*b* of the second segments 270*a*,270*b* against the outer wall 220 of the container 212. The flexibility of the respective hinges 274*a*,274*b*,284*a*,284*b* can also be reversed. Flexibility can also be varied between the first fracturing mechanism 216*a* and the second fracturing mechanism 216*b*. It is understood that the variable flexibility can be achieved by dimensional characteristics of the hinges 274*a*,274*b*,284*a*,284*b* or by the injection molding characteristics such as by materials used and for example two-shot molding and the like.

Figure 27:
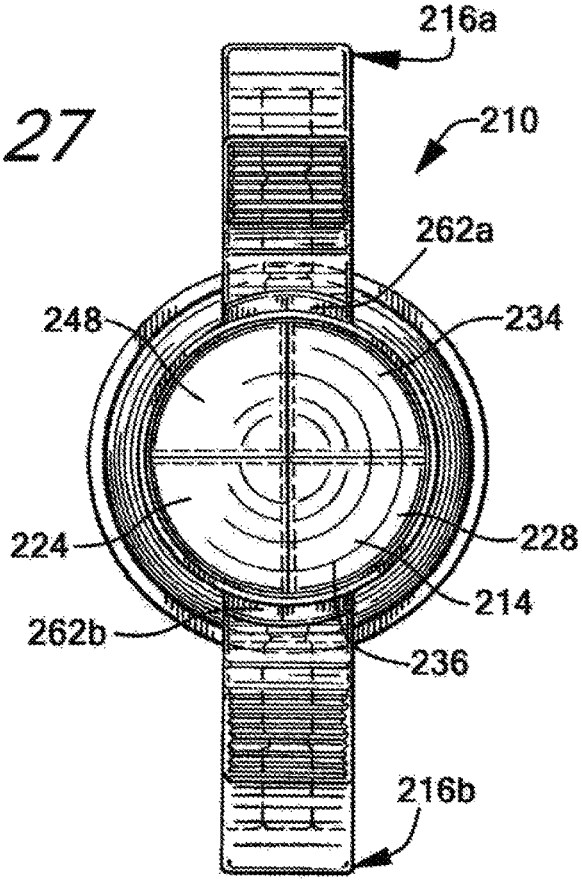
FIG. 27 is an end view of the dispenser of FIG. 24 and having an applicator removed.

As further shown in FIGS. 28-29, the first rupturing mechanism 216*a* is positioned proximate the membrane 214 and at a first position on the container 212. The second rupturing mechanism 216*b* is positioned proximate the membrane 214 and at a second location on the container 212. In an exemplary embodiment, the second rupturing mechanism 216*b* is positioned generally opposite the first rupturing mechanism 216*a* (FIG. 27). The first rupturing mechanism 216*a* is positioned generally 180° from the second rupturing mechanism 216*b*, and generally in a diametrically opposed configuration. The first rupturing mechanism 216*a* and the second rupturing mechanism 216*b* may also be positioned and spaced at other radially locations about the container 212.

FIGS. 24-26 and 28 show the applicator 218. The applicator 218 is generally a porous member or sponge similar to the embodiments described above. Based on more viscous types of flowable materials M that could be used in this embodiment as described in greater detail below, the porous member can have certain modified features to enhance accommodation of more viscous materials. For example, the porous member may have a channel or hole defined through the applicator 218.

It is understood that the dispenser of FIGS. 24-39 is made in an injection molding process wherein the dispenser is of an integral one-piece construction. The description of the method of forming the dispenser discussed above is applicable to the method of forming the dispenser 210 of FIGS. 24-39. The mold 100 would be further configured, for example, to define structures for the second hinges 284*a*, 284*b*. The dispenser 210 may be filled with a flowable material M and sealed as described herein. It is understood that the flowable material M may be a surgical prep solution such as a CHG-based solution. It is further understood that in this embodiment, the flowable material M may be a more viscous material.

Figure 30:
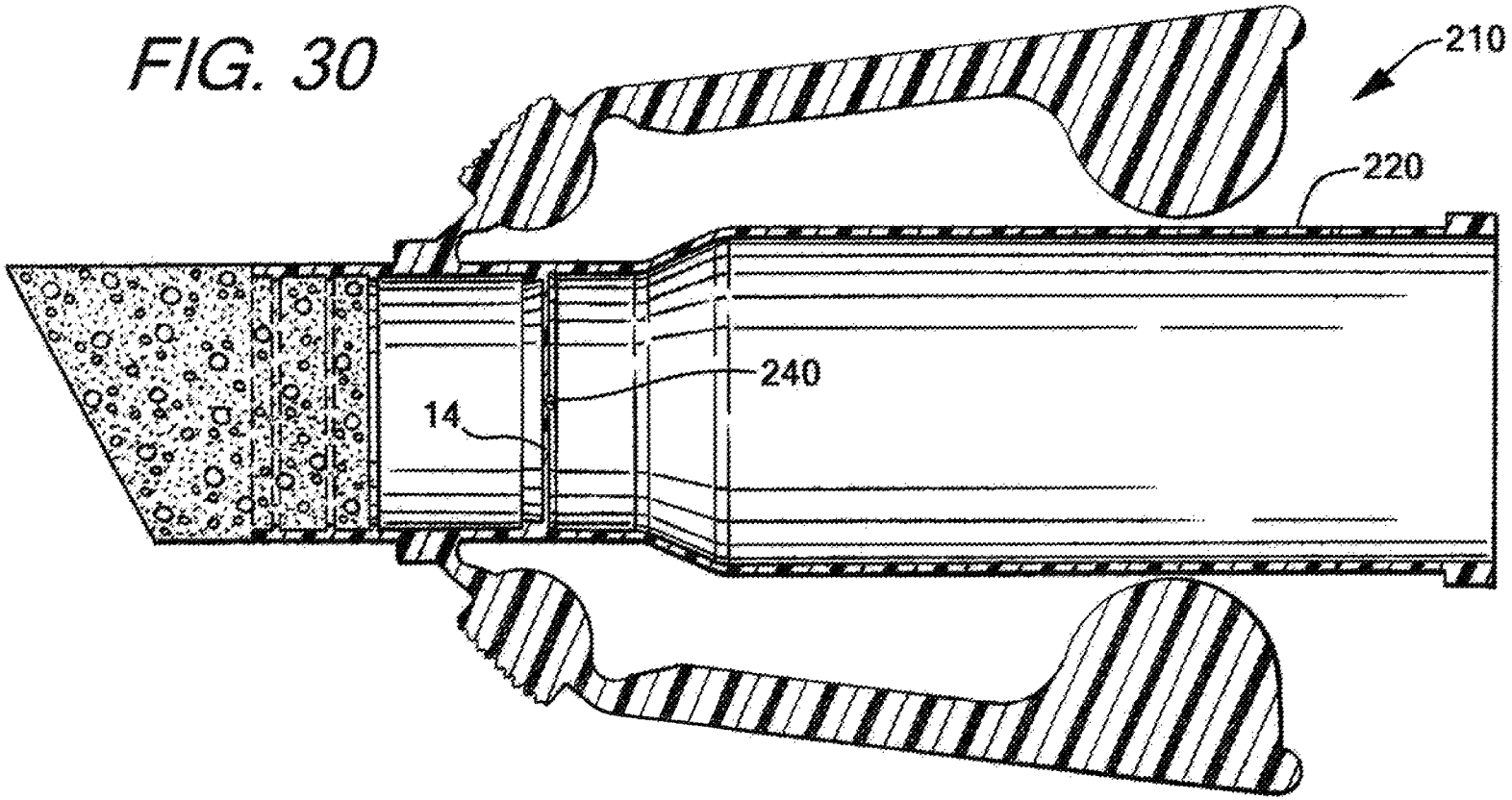
FIG. 30 is a cross-sectional view of an alternative embodiment of the dispenser and having a generally planar fracturable membrane.

FIGS. 24-29 show the dispenser 212 having the rupturable membrane 214 in an angled configuration. In this exemplary embodiment, the membrane 214 has a weld seam 240 and has a generally conical configuration. It is understood that the rupturable membrane 214 can take other forms. For example, as shown in FIG. 30, the dispenser 210 can be formed having the rupturable membrane 214 in a generally planar or flat configuration as shown in other figures. It is understood that other structures and operation of the dispenser 212 are generally identical as described herein.

Figure 31:
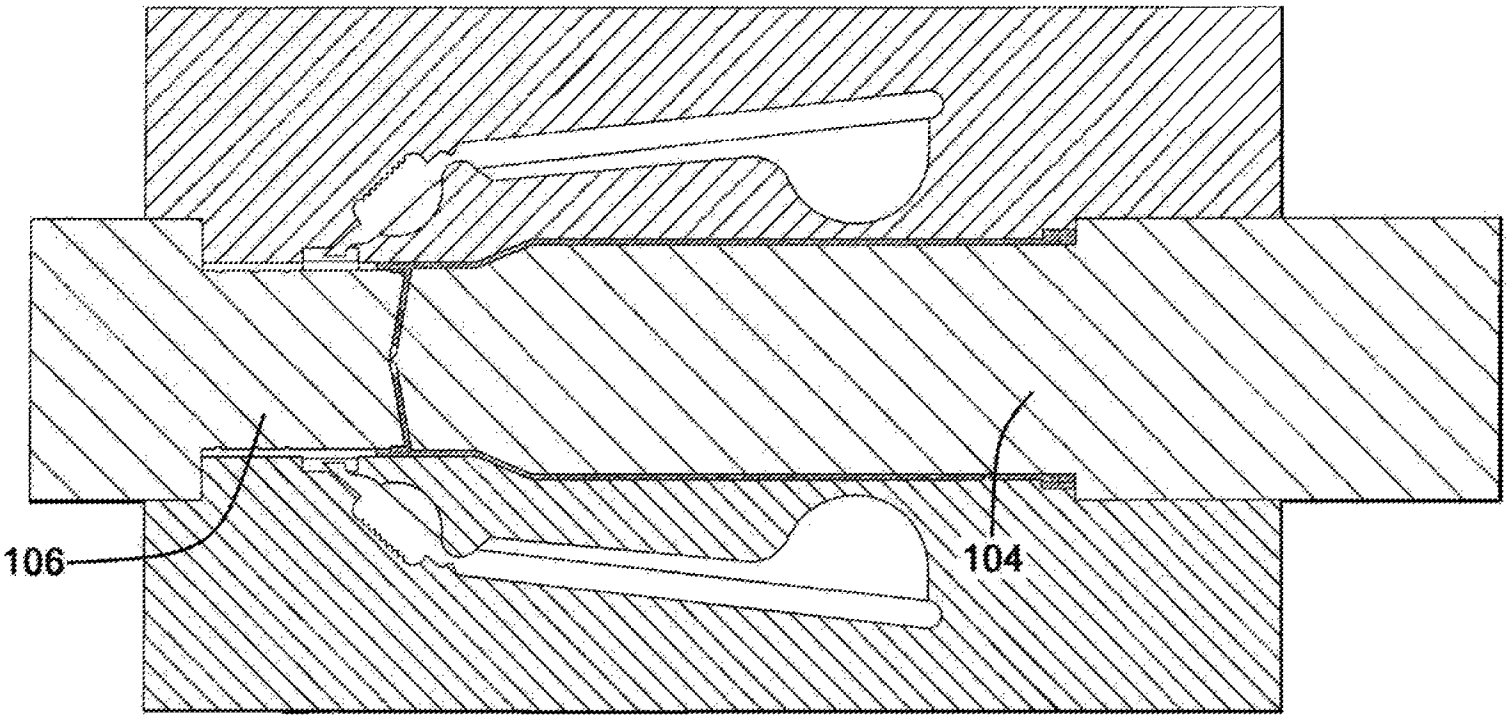
FIG. 31 is a schematic cross-sectional view of a mold and a portion of the material for forming the dispenser of FIG. 24.

The dispenser 200 of FIGS. 24-29 is formed in an injection molding process similar as described above with respect to FIGS. 1-23. FIG. 31 shows a schematic cross-sectional view of a mold used to form the dispenser 200. FIG. 31 shows schematically, injection molded material injected into the mold cavity.

Figure 33:
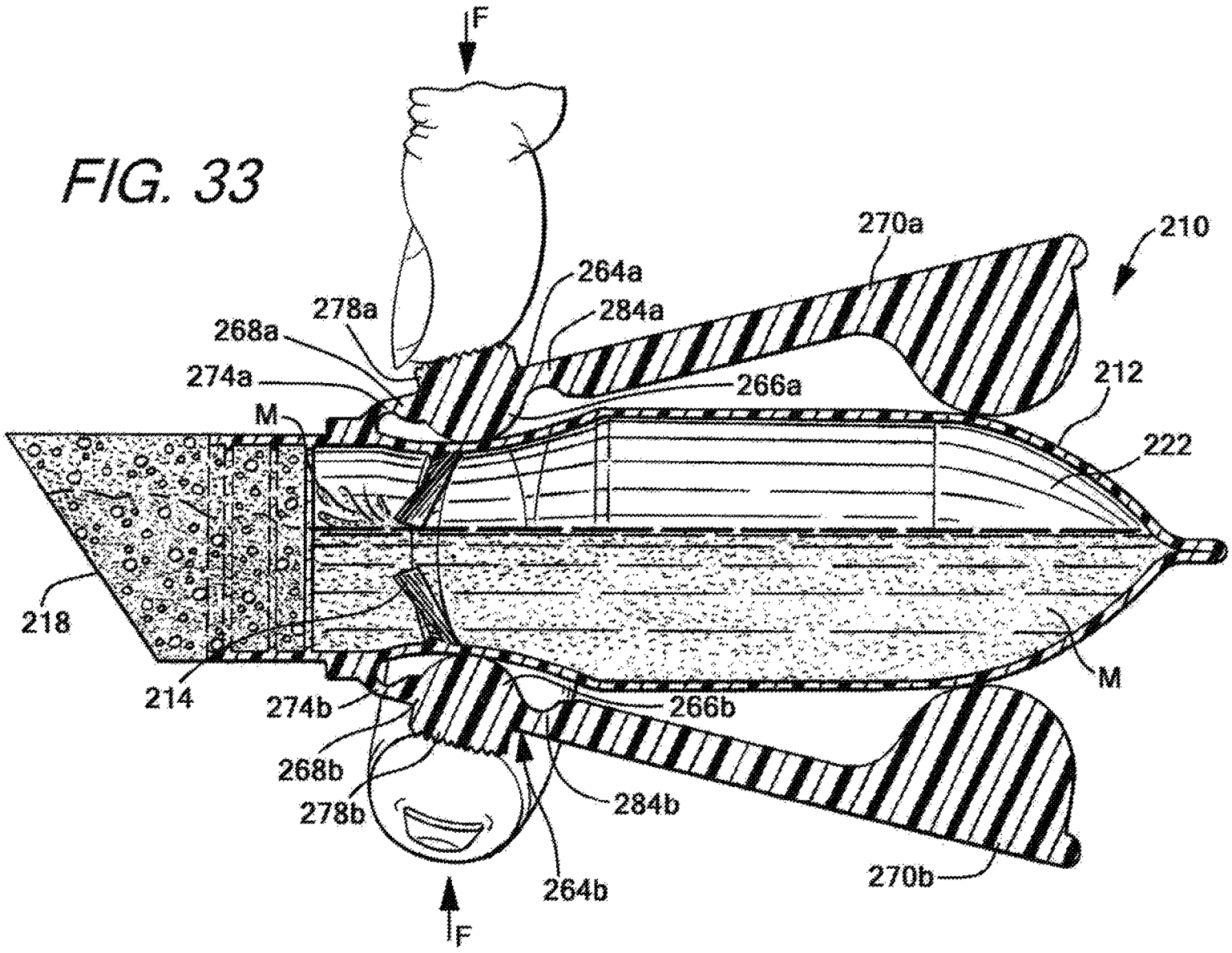
FIG. 33 is a cross-sectional view of the dispenser of FIG. 24 and showing a user fracturing the membrane of the dispenser.
Figure 34:
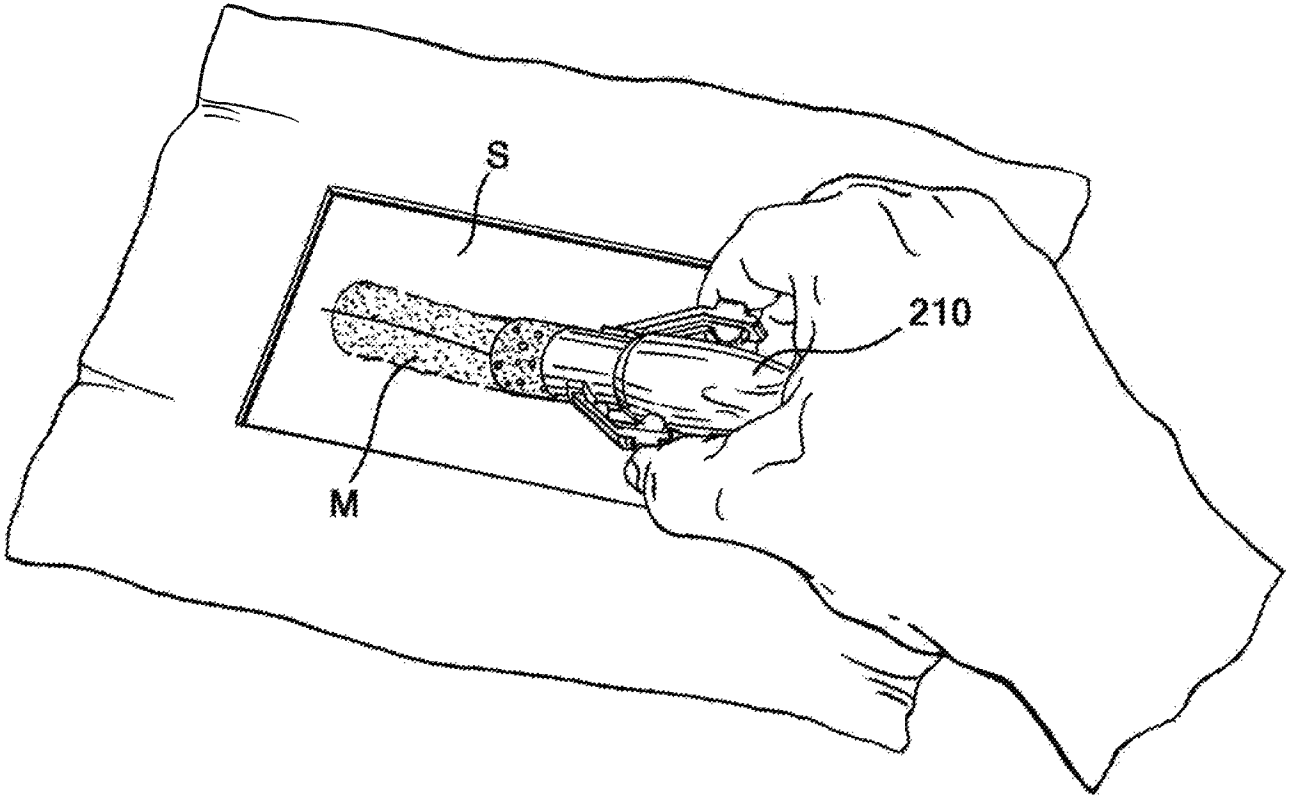
FIG. 34 is a perspective view of a user dispensing the flowable material onto a surface.
Figure 35:
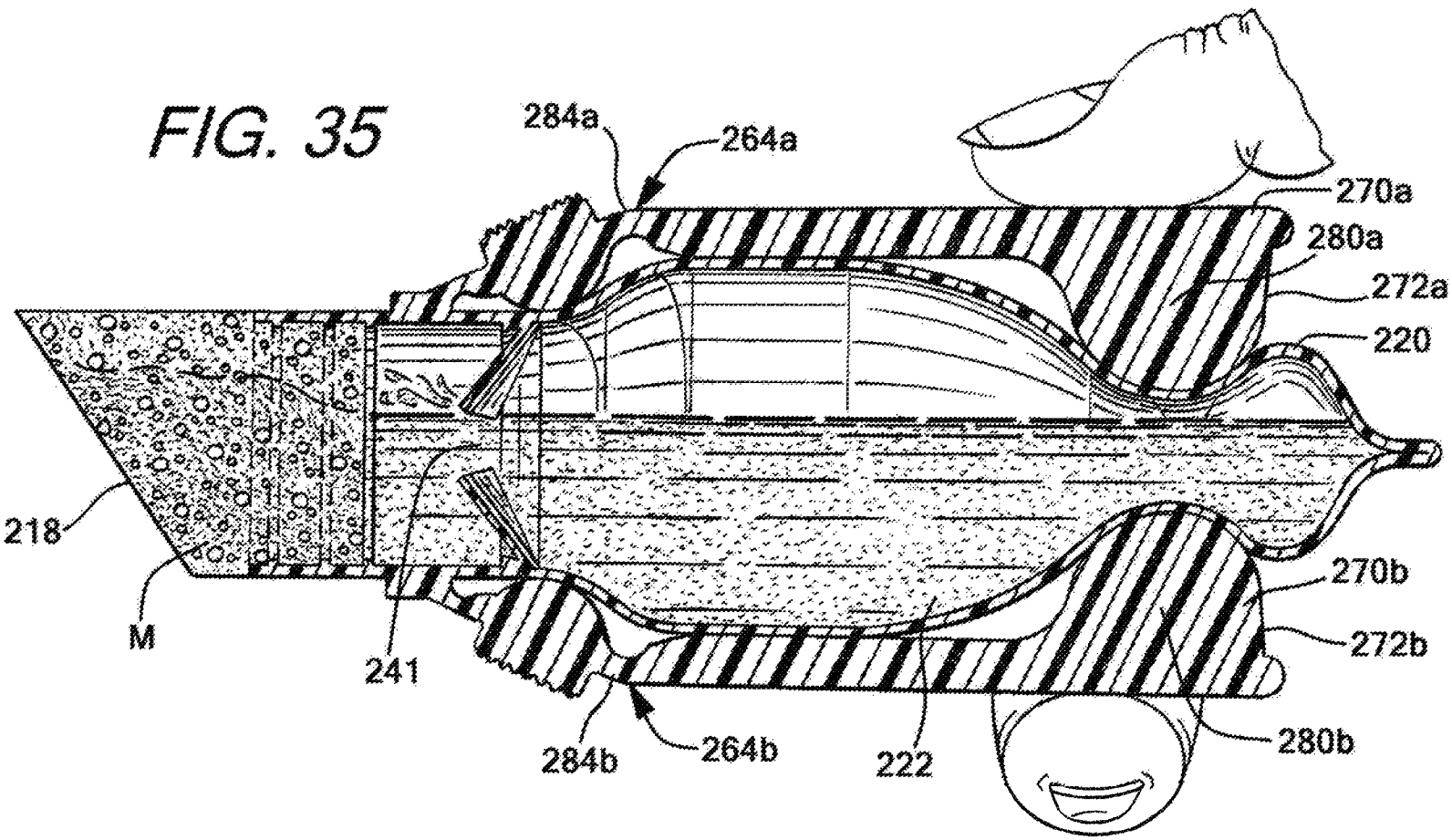
FIG. 35 is a cross-sectional view of the dispenser of the present invention and showing a user further manipulating the flowable material through the membrane.

Operation of the dispenser 210 can be understood from FIGS. 33-35. A user grasps the container 212 where a thumb is positioned on the first extending member 264*a* and a finger such as a forefinger is positioned on the second extending member 264*b*. The user squeezes the thumb and forefinger to apply force to the membrane 214. In particular, the user places a thumb on the first segment 268*a* or the second segment 270*a* of the first extending member 264*a* and a finger is positioned on the first segment 268*b* or the second segment 270*b* of the second extending member 264*b*. (The user can engage the second segments 270*a*,270*b* if desired.) In the particular example shown in FIG. 33, the user places the thumb on the first segment 268*a* of the first extending member 264*a* and specifically on the first engagement pad 278*a*. The user also places a finger(s) underneath the dispenser 210 and on the first segment 268 of the second extending member 264*b* and specifically on the second engagement pad 278*b*. In response to the squeezing motion of the user, the first projection 266*a* and the second projection 266*b* move towards one another to a second position wherein a force F is applied to the membrane 214 wherein the weld seams 240 rupture to provide an opening through the membrane 214. The first hinge 274*a* assists in the pivoting motion of the first segment 268*a* of the first extending member 264*a*, and the first hinge 274*b* assists in the pivoting motion of the first segment 268*b* of the second extending member 264*b*. The flowable material M passes through the membrane 214 and saturates the applicator 218 wherein the user can apply the flowable material M to a desired location. FIG. 34 shows the user dispensing the flowable material M from the dispenser and on to a receiving surface. The structures of the dispenser 210 help assure that the projections 266*a*,266*b* properly engage the outer wall 220 to fractionate the membrane 214. It is understood that the user could use the entire hand to perform the squeezing action on the dispenser 210.

It is understood that the dispenser 210 may be used to dispense a surgical prep solution as described herein. The structures of the first extending member 264*a* and the second extending member 264*b* allow for enhanced operation such as when the flowable material M is a more viscous material that may not freely flow past the membrane 214 and through the applicator 218. The second segment 270*a* of the first extending member 264*a* and the second segment 270*b* of the second extending member 264*b* can be used to assist in forcing the flowable material from the first chamber 222 and ultimately through the applicator 218. As can be appreciated from FIG. 35, the user can further press on the second segments 270*a*,270*b* such as proximate the distal ends 272*a*,272*b* of the extending members 264*a*,264*b* to contact opposite portions of the outer wall 220 of the container 212 and deflect the outer wall portions inwards towards one another. In such movements, the first depending rib 280*a* of the second segment 270*a* and the first depending rib 280*b* of the second segment 270*b* engage the outer wall 220 of the container 212 to deflect portions of the outer wall 220 toward one another. Such deflection of the outer wall 220 reduces the volume of a segment of the first chamber 222 proximate the membrane 214 thus forcing the flowable material M past the membrane 214 and through the applicator 218. The user can continue to press on the extending members 264*a*,264*b* to manipulate the outer wall 220 of the container 212 and force the flowable material M from the dispenser 210. It is understood that the second hinge can be dimensioned and structured to more easily deflect to allow the second segments 270*a*,270*b* to be more easily manipulated by the user. The flexibility of the first hinge and second hinge can be controlled as desired for a particular application.

Figure 36:
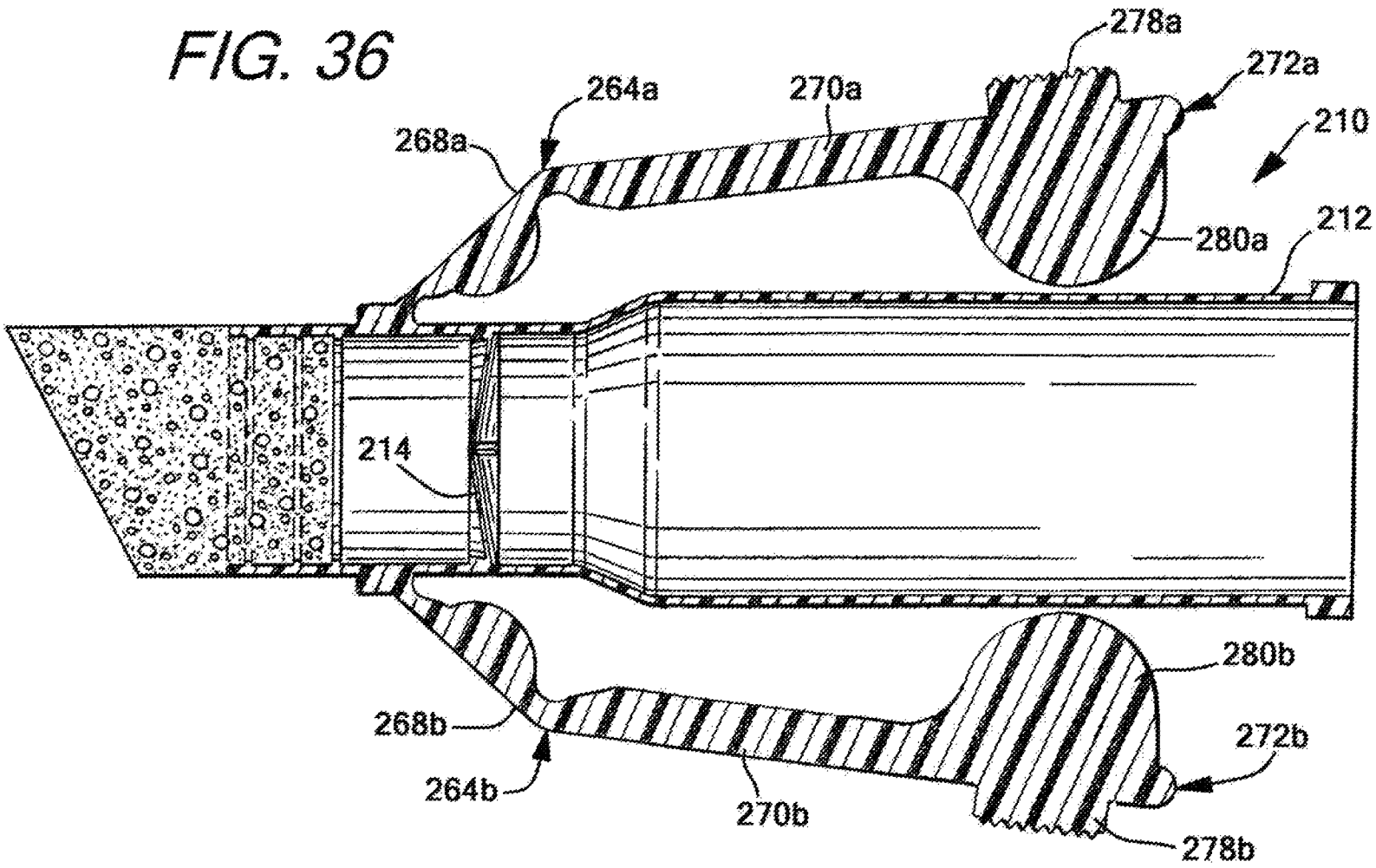
FIG. 36 is cross-sectional view of an alternative embodiment of the dispenser of the present invention.

FIG. 36 shows an alternative embodiment of the dispenser 210. The dispenser 210 in FIGS. 24-35 shows the first engagement pad 278*a* positioned on the first segment 268*a* of the first extending member 264*a*, as well as the first engagement pad 278*b* positioned on the first segment 268*b* of the second extending member 264*b*. The positioning of the first engagement pad 278*a* can vary. As shown in FIG. 36, the first engagement pad 278*a* can be alternatively positioned such as on the second segment 270*a* of the first extending member 264*a*, and on the second segment 270*b* on the second extending member 270*b*. More particularly, the first engagement pad 278*a* is positioned proximate the distal end 272*a* of the second segment 270*a* and generally opposite the first depending rib 280*a*. Likewise, the first engagement pad 278*b* is also positioned proximate the distal end 272*b* of the second segment 270*b* and generally opposite the second depending rib 280*b*. Similar to the previous embodiments, the first engagement pad 278*a* has a plurality of ridges to enhance engagement by the user. The first engagement pads 278*a* provide an indication on engagement locations for the user. It is understood that the first engagement pads 278*a*,278*b* can also be positioned at other locations on the first segments 268*a*,268*b* and the second segments 270*a*,270*b*.

Figure 37:
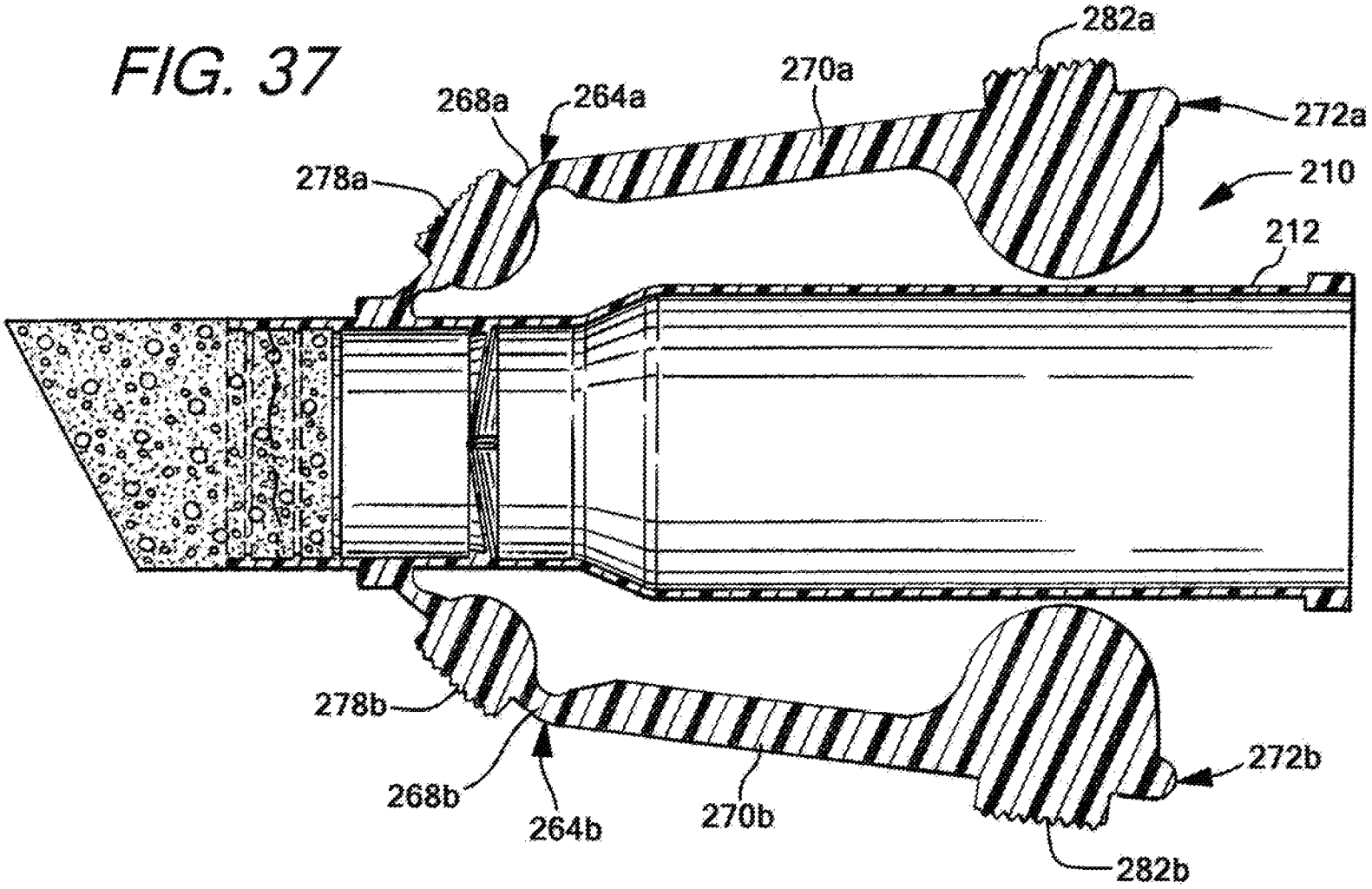
FIG. 37 is cross-sectional view of an alternative embodiment of the dispenser of the present invention.

FIG. 37 discloses another alternative embodiment of the dispenser 210. This dispenser 210 utilizes the first engagement pad 278*a* and a second engagement pad 282*a*. The first engagement pads 278*a*,278*b* are positioned as in the embodiment of FIGS. 24-35. The second engagement pads 282*a*,282*b* are positioned similar to the pads in FIG. 36. Thus, the first extending member 264*a* has the first engagement pad 272*a* positioned on the first segment 268*a* and the second engagement pad 282*a* on the second segment 270*a*. Similarly, the second extending member 264*b* has the first engagement pad 272*b* positioned on the first segment 268*b* and the second engagement pad 282*b* on the second segment 270*b*. Thus, the user engages the first engagement pads 278*a*,278*b* when fracturing the membrane 214 and engages the second engagement pads 282*a*,282*b* when further manipulating the flowable material M through the membrane 214.

Figure 38:
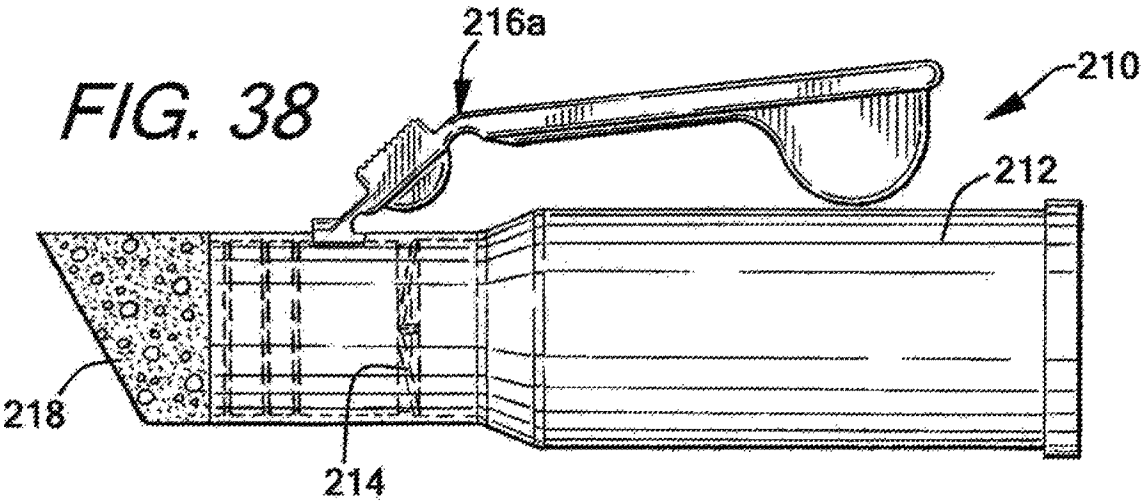
FIG. 38 is a side elevation view of an alternative embodiment of the dispenser of the present invention.

FIGS. 24-37 disclose the dispenser 210 having the first fracturing mechanism 216*a* and the second fracturing mechanism 216*b*. The dispenser 210 could also have an alternative configuration utilizing a single fracturing mechanism. For example as shown in FIG. 38, the dispenser 210 has only the first fracturing mechanism 216*a*. Other structures are generally identical. In operation, it is understood that a user would press the first rupturing mechanism 216*a* with a thumb while fingers or other portions of the hand wrap around a bottom portion of the container 212 opposite the first rupturing mechanism 216*a*. This pressing action results in fractionating the membrane 214 wherein the flowable material M can be dispensed from the dispenser 210.

Figure 39:
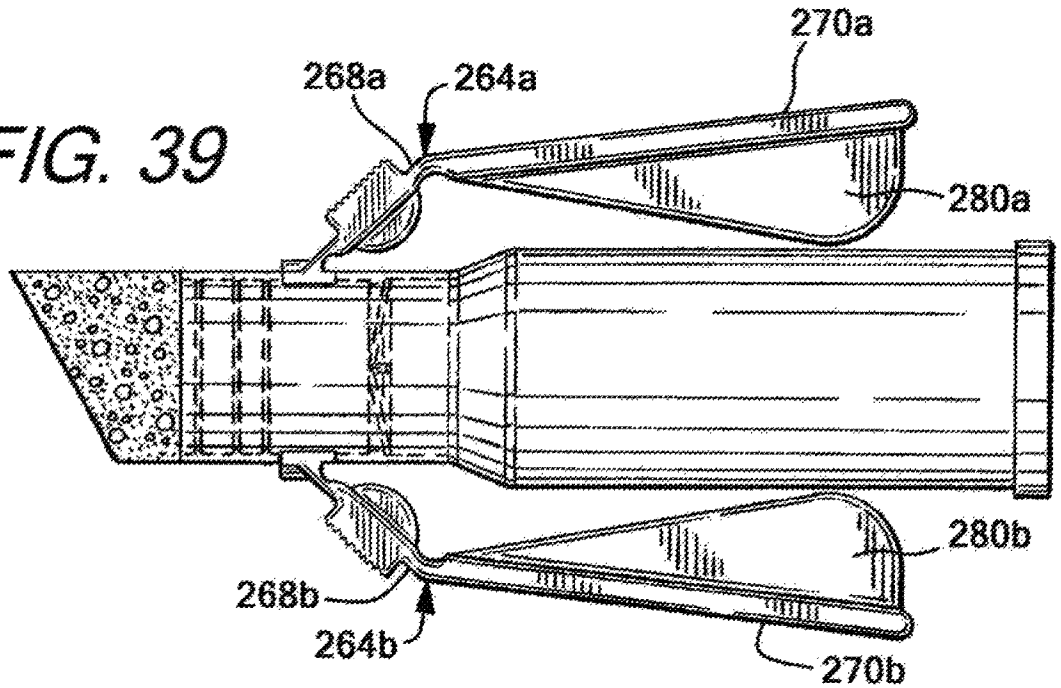
FIG. 39 is side elevation view of another alternative embodiment of the dispenser of the present invention.
Figure 39A:
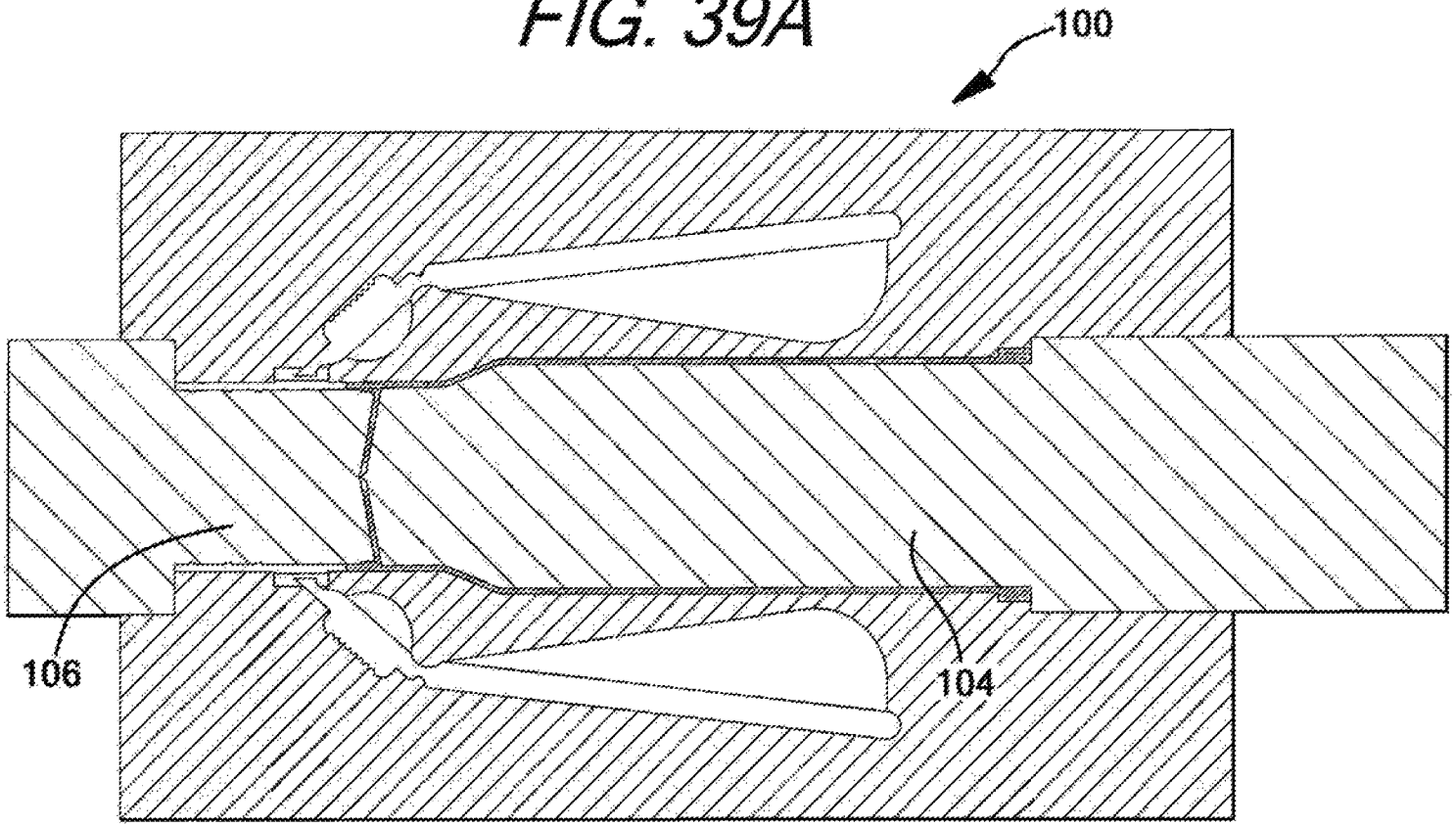
FIG. 39A is a schematic cross-sectional view of a mold and a portion of the material for forming the dispenser of FIG. 39; and, FIG. 39B is a side elevation view of another alternative embodiment of the dispenser of the present invention.

FIG. 39 shows another alternative embodiment of the dispenser 210. The dispenser of FIG. 39 is generally similar to the previous embodiments but the depending ribs 280*a*, 280*b* have a tapered configuration. The depending ribs 280*a*,280*b* have a greater dimension towards a distal end of the second segments 270*a*,270*b*. The depending ribs 280*a*, 280*b* gradually taper to a smaller dimension towards the first segments 268*a*,268*b*. Operation of the dispenser 210 of FIG. 39 is similar as described above. The depending ribs 280*a*, 280*b* are dimensioned to further assist in forcing the flowable material from the container 212 wherein the ribs 280*a*,280*b* engage and further deflect the outer wall 222 of the container 212 to help force the flowable material M from the dispenser 210. FIG. 39A shows a schematic cross-sectional view of a mold used to form the dispenser 210 of FIG. 39.

Figure 39B:
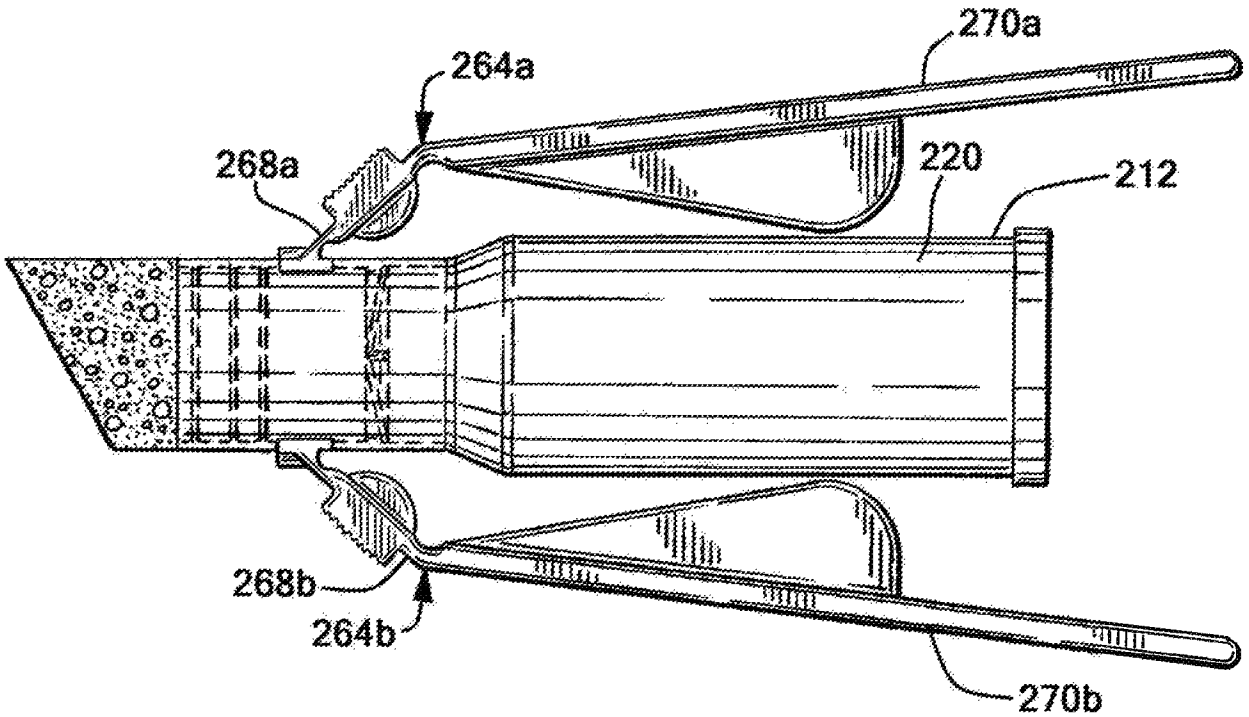

FIG. 39B shows another alternative embodiment of the dispenser 210. The dispenser of FIG. 39B is generally similar to the previous embodiments and the prior descriptions and operations are generally applicable. In this embodiment, the second segments 70*a*,70*b* of the first and second extending members 64*a*,64*b* are further extended. In one exemplary embodiment, the second segments 270*a*, 270*b* extend past the distal end of the container 212. This further extended configuration allows the extending members 264*a*,264*b* to provide even more mechanical advantage/leverage when pressing the members 264*a*,264*b* against the outer wall 220 of the container 212 to manipulate the flowable material from the dispenser 210. This extended configuration of the extending members 264*a*,264*b* could also be utilized in the other embodiments of the present invention.

As discussed, because of the unique formulation used to injection mold the dispensers 10,210, the dispensers 10,210 are capable of containing a CHG-based solution to be used in surgical preparation settings. It is understood that the dispenser 10,210 is filled with the CHG-based solution wherein a distal end of the dispenser 10,210 is sealed. It is further understood that the dispenser 10,210 with the CHG-based solution is appropriately sterilized. The dispenser 10,210 is used in a surgical setting wherein a patient's skin in prepared for an incision by a surgeon. The membrane 14,214 of the dispenser 10,210 is ruptured by a medical worker as described with respect to FIGS. 19-22 and 33-35. As shown in FIGS. 21 and 34, the applicator 218 is pressed against a patient's skin S all around the incision location. The flowable material M is deposited onto the patient's skin S as shown wherein the skin S is sanitized in preparation for surgery. It is understood that the dispenser 10,210 may utilize a colorant, or dye, wherein medical personnel will be able to decipher where the flowable material M has been deposited. The colorant can be introduced into the CHG solution in different ways. The colorant could be impregnated into the applicator 18. The colorant could also take the form of a powder or pellet and positioned in the second chamber 224. A multiple chambered dispenser could also be utilized wherein the colorant is stored separately from the CHG solution. Once the flowable material M is deposited, the patient is ready for an incision by the surgeon. In certain other embodiments, the dispensers can contain a CHG-based solution that also incorporates a skin adhesive. One type of such solution is a cyano-acrylic chlorhexidine gluconate solution (CACHG). In such embodiments, this particular CHG-based solution having the skin adhesive is used to prepare the skin as well as assist in sealing out potential contaminants. This dispenser application could also be used in other medical applications such as in an intravenous application or a catheter application.

It is understood that other components can be incorporated into the dispensers disclosed herein. Filter elements could be disposed between the membrane and applicator.

Other types of applicators could also be used with the dispenser. The dispenser could also be incorporated into further structures if desired.

It is understood that the dispensers disclosed herein could also be part of a kit. The kit could contain multiple dispensers with different compositions to be dispensed. The kit could also contain other components for achieving a desired result. For example, the kit could include a gelling agent component.

It is understood that the "first" and "second" designations for the dispenser of the present invention can be reversed as desired. It is further understood that the term "outer" when describing the outer wall of the dispenser is a relative term. It is understood that the dispenser of the present invention could be incorporated into other structures that may encompass the outer wall. The outer wall of the dispenser of the present invention, cooperates with the membrane and dividing wall in certain embodiments to define the chambers of the dispenser.

As explained in greater below, the present design utilizing a generally conical membrane having a weld seam unexpectedly yielded a design that would rupture upon the application of force F, wherein the force F was less than the force required to fracture or rupture the membrane disclosed in the '319 patent discussed above. This provides additional options for the dispenser 10,210 such as a membrane that is more easily rupturable or a membrane that has a thickened weld seam 40,240 but that still allows easy rupture via finger pressure. As the rupturing mechanism 16,216 provides additional leverage for applying force F to the membrane 14,214 to fracture, membranes 14,214 and weld seams 40,240 having increased dimensions are also possible as described in greater detail below. Additional material options also become possible with the conical membrane 14,214 as well as any combinations of the membranes 14,214, the fracturing mechanism 16 and the materials used to injection mold the dispensers 10,210.

The structures of the present invention provide several further benefits both individually and in combination. The conical membrane structure provides enhanced fracturability. The fracturing mechanism further enhances the ability of a user to fracture the membrane. This has also allowed the dispenser to be formed from new material formulations that has increased the applications and uses for the dispenser 10.

In addition, forming the membrane 14,214 into an angled, conical or spherical shape provides certain advantages. Less force can be applied to the membrane 14,214 in order to rupture the weld seam 40,240 thereby making it easier for a user to break the weld seam 40,240 to dispense the flowable substance in the dispenser 10,210. This can be useful in applications where users have difficulty providing a greater rupturing force via finger pressure. With less force required for rupture of the weld seam 40,240, the weld seam 40,240 can also be molded having a thicker dimension $t_2$ if desired. With a thicker dimension, the typical force required for rupturing the membrane 40,240 can be maintained if desired. With a thicker dimension, vapor passage of the flowable substance through the weld seam 40,240 is minimized. Weld seams 40,240 having minimal thicknesses are more susceptible to vapor passage therethrough, which affects the expected concentration of the flowable substance contained in the dispenser 10,210. This can also increase chances of contamination. As the membrane thickness increases, more materials are suitable for forming the membrane 14,214, thereby increasing the flexibility of uses for the dispenser 10,210 as the dispenser 10,210 can be used with more flowable substances. The angled membrane 14,214 also provides for a distinct audible "pop," as it is ruptured. This is desirable such that the user then has a definitive indication that the weld seam 40,240 has ruptured.

The inventors note that the angled membrane disclosed herein was previously arrived at after investigation and considerable testing and discovery. When considering membranes of other shapes, the inventors originally did not consider that an angled or conical membrane would properly function. It was expected that such a design would not rupture and instead, merely fold upon itself. To the contrary as explained herein, the angled or conical membrane provided unexpected results and enhanced benefits.

The rupturable membrane having a weld seam disclosed in U.S. Pat. No. 6,641,319 ("the '319 patent) provides significant advancement over the prior art. This rupturable membrane disclosed in the '319 patent is generally a planar membrane and positioned within the dispenser in a straight configuration wherein the membrane is generally transverse to the outer wall of the dispenser. This design provides a membrane that generally consistently ruptures upon the application of force (such as by fingers pressing at the membrane) proximate the membrane as discussed in the '319 patent. Over time, it was discovered that in rare circumstances, certain users of the dispenser disclosed in the '319 patent could not rupture the membrane. In such occurrences, the membrane would deflect but the weld seams tended to act similar to a living hinge and would not break. Upon further study of these rare occurrences, it was found that users were at times applying force too slowly than what most users applied with general finger pressure. When applying force more slowly, the molecular structures of the weld seam had time to realign such that rupture along the weld seam would not occur. Although these occurrences were rare, it prompted further study to determine if other membrane shapes could provide additional solutions or rupture with the application of more slowly-applied forces. Other membrane shapes were considered including an angled type membrane and, in particular, a conical membrane.

In the course of the studies relating to the rupturable membrane of the '319 patent, it was already recognized that the weld seam, formed from segments of abutting plastic injection molded material, would rupture along the weld seam when subjected to force proximate the weld seam. Also in the course of these studies, it was discovered that the weld seam of the membrane was subjected to tensile stresses when rupturing. This provided greater understanding of the rupturable membrane of the '319 patent. In view of this finding, when considering an angled or conical membrane, it was then considered that such a design may provide an enhanced state for rupturing. This was contrary to original considerations by the inventors herein that such a membrane would merely fold upon itself and not rupture. Further investigation and testing of an angled or conical membrane having a weld seam showed that the membrane did not fold upon itself but did indeed rupture along the weld seam. Upon further detailed testing, it was found that the conical membrane required less force to rupture the weld seam than the membrane having a weld seam of the '319 patent. This provided additional options if a lesser rupture force was desired. This also allowed for thickening the weld seam and membrane to such that the weld seam in a conical membrane would rupture upon application of the same amount of force as typical with the membrane of the '319 patent. As a result, molding of the membrane can be made easier and less costly because the membrane and weld seam are thicker wherein broader tolerances are possible resulting in less rejected parts. In addition, vapor passage through the thickened weld seam was decreased allowing for an increased number of flowable materials that could be contained by a dispenser having such a membrane. As an example, one exemplary embodiment of a membrane of the '319 patent may have a weld seam thickness of approximately 0.0035 inches. A weld seam of such a membrane design will rupture at approximately 8 psi applied, for example, via finger pressure. This value was determined to be a typically desirable force that most users could apply to the membrane. With a conical membrane having a weld seam of approximately 0.0035 inches, detailed testing showed that the weld seam ruptured at approximately 5.5 psi. Thus, a lower rupture value was achieved. Further testing then showed that the weld seam thickness in a conical membrane could be increased to approximately 0.006 inches and would rupture at approximately 8 psi. Accordingly, the weld seam could be thickened. Such results also showed that a dispenser could be manufactured having a lesser force required for rupture, e.g. 5.5 psi for a weld seam thickness of 0.0035 inches, such as for users having an arthritic condition where it was more difficult to provide a suitable rupturing force. Such findings also showed that a dispenser having a conical membrane and weld seam could be made with additional blends of polyethylene and polypropylene as the weld seam would rupture and not be too stiff thus resisting rupture. In prior designs, if the membrane material was too stiff, the membrane was not suitably rupturable via the fingers of a user which was not practical.

Upon further study of the straight or planar membrane of the '319 patent, it was discovered that when force is applied proximate the membrane, the force must first overcome the buckling resistance of the membrane sections adjacent the weld seam, as the membrane sections are generally aligned with the direction of the force applied. Once the force tends to buckle these sections, the weld seam is placed in tension and upon sufficient application of further force, the weld seam ruptures providing an opening in the membrane. Because of the shape of the angled or conical membrane of the present invention, the force applied proximate the membrane is not generally aligned with the membrane sections. Consequently, the force applied does not need to first overcome the buckle resistance of the membrane sections. The force is generally immediately directed on the weld seam wherein the weld seam is placed further in tension and ruptures. As a result, less force is required to rupture the angled or conical membrane than is required in the membrane of the '319 patent. As discussed above, with less force required to rupture the membrane, the membrane and weld seam could be constructed in a thicker construction while still allowing rupture. With a thicker weld seam, less vapor passage occurs through the weld seam improving the performance of the dispenser container and allowing the container to contain a wider variety of materials such that concentrations of the flowable materials are better maintained. In addition, other materials could now be used to form the membrane and container. These materials included more chemically-resistant materials that further allowed an increase in the number of flowable materials that could be contained and dispensed from the container. Such an angled or conical membrane design further allows the dispenser to be made from other thermoplastic engineering materials and combinations thereof. Such materials include those that provide better chemical resistance and less vapor and oxygen transmission that could not be used in prior designs because such materials are too stiff to rupture the membrane with typical force provided by finger pressure. In one example, a blend of materials can now be used that includes a greater percentage of polypropylene. While such a blend provides more stiffness, the conical membrane will still rupture via finger pressure. The increased amount of polypropylene also provides a dispenser have greater chemical resistant properties. In another example, a dispenser having a conical membrane can be formed solely from nylon.

The fracturing mechanism of the dispenser 10,210 provides additional benefits. The fracturing mechanism provides greater leverage for the user in fracturing the weld seams of the membrane. This allows for the weld seam dimension to be increased or having the thinner weld seam dimension wherein a lesser force is required to fracture the membrane. As discussed above, weld seam thicknesses $t_2$ are possible in the approximate range of 0.003 inch to 0.015 inch. Such weld seam thicknesses $t_2$ were not previously possible as a user could not fracture the membrane 14 via normal finger pressure. With the fracturing mechanism 16,216, additional force from increased leverage can be applied to the membrane 14 wherein thicker weld seams can be fractured via finger pressure. Furthermore, with thicker weld seams, shelf-life of the dispensers 10,210 holding certain contents can be significantly increased. The weld seam structure is typically one of the thinnest portions of the dispenser and therefore, it is at this location wherein contents of the dispenser can leach through the weld seam thus reducing the potency of the stored contents. With thicker weld seams, it becomes more difficult for the stored contents to leach through the weld seams. This allows for increased shelf-life of the dispensers. With the benefits the fracturing mechanism provides, additional applications are possible with the dispenser.

As further discussed above, the fracturing mechanism includes the extending members that are dimensioned to capable of engaging the outer walls of the dispenser. A user can engage the extending members to deform the outer wall of the container to assist in forcing the stored contents from the dispenser. This allows the dispenser to be ideal for use in storing thicker, more viscous, flowable materials. Accordingly, this increases the amount of applications wherein the dispenser can be used.

The dispenser can be subjected to various forces during handling such as during the filling or packaging processes which could inadvertently deflect the extending members and lead to accidental fracturing of the membrane. The fracturing mechanism further provides the gap G between the projections and the outer wall of the container. The gap G assists in minimizing inadvertent fracturing of the membrane 14 as there is a distance (the gap G) that the extending members can move before the outer wall is engaged at the membrane. Thus, fracturing the membrane 14 requires a more deliberate action by the user, thus minimizing accidental activation of the dispenser. The base of the fracturing mechanism further provides support for extending members. In particular, when the extending member is pivoted to fracture the membrane and manipulate flowable material through the membrane, the base provides rigidity to minimize any deflection or warping of the outer wall which could affect operability of the dispenser such as adversely impacting the operable connection of the applicator in the opening.

As discussed, the dispenser can be formed from the unique formulation of polypropylene and polyvinylidene fluoride (PVDF) resin. This formulation provides several benefits. This material formulation provides for greater chemical resistance while still allowing for rupturing of the weld seams in the membrane. The increased chemical resistance allows the dispenser to contain the CHG-based flowable material in commercial applications such as for surgical preparation applications. The formulation allows the dispensers containing CHG solution to have an acceptable shelf-life wherein the strength and potency of the CHG does not dissipate too quickly to unacceptable levels. In addition, the membrane construction and configuration along with the rupturing mechanism further allows the dispenser to be used for dispensing a CHG-based solution as in surgical prep setting. This dispenser could also be formed only from polyvinylidene fluoride (PVDF) resin. This provides a dispenser having enhanced chemical resistance properties along with more robust, thicker weld seams and a fracturing mechanism capable of fracturing the thicker weld seams. Because of the chemical properties involved, CHG-based applications have typically required utilizing glass containers such as glass ampoules. The present invention provides for eliminating glass containers wherein the CHG-based solution is stored in the plastic ampoule dispenser of the present invention. Additional benefits are also realized.

There are multiple embodiments of the dispenser according to the present invention disclosed herein. The dispensers of the present invention can be formed in an injection molding process from several different material formulations as discussed above. In one exemplary embodiment, a polymeric material formulation is used having a predetermined percentage of polyvinylidene fluoride. In a further exemplary embodiment, the material formulation may be a blend of a predetermined proportion of polypropylene and a predetermined proportion of polyvinylidene fluoride. It is understood that any of the dispensers disclosed above can be made with such formulation.

Using dispensers made from the material formulation having polyvinylidene fluoride provides several benefits. Such benefits are also provided in dispensers made entirely of polyvinylidene fluoride, or nylon or polypropylene. The material formulation allows the dispensers to be used to contain certain antiseptic solutions to be used as surgical prep solutions. In one exemplary embodiment, the surgical prep solution contains chlorhexidine gluconate (CHG). Considerable testing performed by the inventors has determined that the dispensers can suitably contain CHG-based solutions for extended periods of time without an undue degradation of the strength of the CHG-based solution. Thus, dispensers made from this material formulation and containing CHG-based solution have a sufficiently long shelf-life to be used in commercial settings such as in a hospital or surgery centers to prepare incision sites for patients undergoing surgery. In prior embodiments, because of the CHG-based solution, the dispensers were required to be glass ampoule containers, which presented other challenges such as the danger of glass shards injuring medical personnel.

Because of the stability of the dispensers made from the unique materials as well as the unique structures of the dispensers, additional surgical prep solutions that are different from CHG-based solutions can also be used. In certain exemplary embodiments, the dispensers can contain a CHG-based solution that also incorporates a skin adhesive. One type of such solution is a cyano-acrylic chlorhexidine gluconate solution (CACHG). Thus, it is understood that any exemplary embodiment described herein that utilizes CHG, could also use a CACHG-based solution. The dispensers could also possibly contain alcohol-based antiseptics.

Furthermore, in other dispenser applications where the dispenser is made from materials other than polyvinylidene fluoride, the dispensers can be used to contain additional types of flowable materials. For example, the dispensers can be used to contain acetone-based automotive products including windshield primer. The dispensers can also be used to contain hexane-based products for medical or automotive applications. This was not possible prior to the present invention as polymeric based dispensers were not capable of containing certain material formulations. In sum, the various features of the dispensers including the formulation of the materials used to injection mold the dispenser, the membrane structure and the use and operation of the fracturing mechanism provide enhanced operability and increased applications for the dispensers not possible until the present invention.

Several exemplary embodiments of the dispensers according to the present invention have been disclosed herein. The dispensers have multiple structural features and can be made from a variety of different materials or unique combination of materials. It is understood that the various structural features and material combinations can be used in other combinations in additional exemplary embodiments.

The dispenser of the present invention is designed to primarily contain and dispense flowable materials that are fluids. Other flowable materials can also be dispensed. For example, the flowable material could be a liquid, powder, gel or other type of flowable substance or flowable material. Also, in other embodiments such as dispensers containing multiple chambers for different flowable materials, the flowable materials M1, M2 could both be fluids. In another embodiment, the first flowable material M1 could be a liquid, and the second flowable material M2 could be a powder to be mixed with the fluid. Other combinations depending on the use are also permissible.

This permits the dispenser 10 to be used in a wide variety of uses and applications, and contain and dispense a large variety of fluids and other flowable substances. The following is a non-exhaustive discussion regarding the many possible uses for the dispenser of the present invention, and in particular, the types of materials that are capable of being contained in the dispensers and dispensed therefrom. It is understood that related uses to those described below are also possible with the dispenser. It is also understood that the following discussion of potential uses is applicable to any of the dispenser embodiments disclosed and discussed herein.

In one example, the dispenser of the present invention can be used in medical applications. In one particular exemplary embodiment, the dispenser may contain a surgical antiseptic such as for cleaning and preparing a body area for incision, and sometimes referred to as a surgical prep solution. One type of antiseptic may be chlorohexidine gluconate (CHG). This CHG-based antiseptic could also be combined with a medical sealant such as cyano-acrylic wherein the dispenser is used to contain and dispense cyano-acrylic chlorohexidine gluconate (CACHG). Other types of medical sealants could also be used. Other types of antiseptics could be iodine-based such as iodophoric skin tinctures, which are commercially available. Other antiseptics and antimicrobial agents could also include other iodine-based complexes, alcohol-based complexes or peroxides. Additional additives may also be used with the antiseptic such as colorants. A single chamber dispenser may be used in such an application, but a multi-chamber dispenser such as disclosed herein may also be used.

In another example, the dispenser of the present invention can be used in adhesive-type applications. The dispenser can dispense a flowable material or mixture that is an adhesive, epoxy, or sealant, such as an epoxy adhesive, craft glue, non-medical super glue and medical super glue. The dispenser could also be used with shoe glue, ceramic epoxy and formica repair glue. The dispenser could further be used for a variety of other adhesive dispensing applications, mastic-related resins or the like.

In another example, the dispenser of the present invention can be used in automotive applications. The dispenser can dispense a flowable material or mixture that is an automotive product, such as a rear view mirror repair kit, a vinyl repair kit, auto paints, an auto paint touch up kit, a window replacement kit, a scent or air freshener, a windshield wiper blade cleaner, a lock de-icer, a lock lubricant, a liquid car wax, a rubbing compound, a paint scratch remover, a glass/mirror scratch remover, oils, radiator stop-leak, a penetrating oil, or a tire repair patch adhesive. Additional automotive applications could be for general auto/motorcycle or bicycle repair kits including chain oils.

In another example, the dispenser of the present invention can be used in chemistry-related applications. The dispenser can dispense a flowable material or mixture that is a chemistry material such as a laboratory chemical, a buffer solution, a rehydration solution of bacteria, a biological stain, or a rooting hormone. The dispenser may also be used as a chemical tester. In one such application, the dispenser can be used for testing drinks for various "date rape" drugs. Other types of chemical testers are also possible. The dispenser could be used to contain various types of chemicals including solvents. In a particular application, the additional material formulations used to form the dispenser allow the dispenser to store and dispense methyl ethyl ketone.

In another example, the dispenser of the present invention can be used to dispense a flowable material or mixture is a cosmetic and beauty supply/toiletry product. For example, the dispenser can be used for a nail polish, lip gloss, body cream, body gel, body paints, hand sanitizer, nail polish remover, liquid soaps, skin moisturizers, skin peels, tooth whiteners, hotel samples, mineral oils, toothpastes, mouthwash or sunscreens. The flowable material could also be a fragrance such as women's perfume or men's cologne. The flowable material could also be tattoo inks. The flowable material could be used for solutions for treating and/or removing tattoo ink.

The cosmetic applications could also include hair care type applications. In another particular example, the dispenser of the present invention can be used in a hair dye kit. Certain hair dye kits come in multiple components that are separately stored wherein the dispenser embodiment disclosed herein having a dividing wall that cooperates to define separate chambers can be utilized. Thus, the dispenser of the present invention can be used in a two-part hair care product such as a hair dye kit. A first flowable substance of the hair dye kit can be carried in the first chamber, and a second flowable substance of the hair dye kit can be carried in the second chamber. The membrane is ruptured wherein the two flowable substances can be mixed together to form a mixture or solution. The mixture or solution can then be dispensed from the dispenser onto the hair of a user. The dispenser can also dispense a flowable material or mixture in other hair care products, such as hair bleaches, hair streaking agent, hair highlighter, shampoos, other hair colorants, conditioners, hair gels, mousse, hair removers, or eyebrow dye.

In another example, the dispenser of the present invention can be used in crafting applications or stationary products. The dispenser can also dispense a large variety of stationery or craft products, such as magic markers, glitter gels, glitter markers, glitter glues, gel markers, craft clues, fabric dyes, fabric paints, permanent markers, dry erase markers, dry eraser cleaner, glue sticks, rubber cement, typographic correction fluids, ink dispensers and refills, paint pens, counterfeit bill detection pen, envelope squeeze moisturizers, adhesive label removers, highlighters, and ink jet printer refills.

In another example, the dispenser of the present invention can also dispense a flowable material or mixture that is an electronics-related product. For example, the electronics product could be a cleaning compound, a telephone receiver sanitizer, cell phone cleaner or protectants, a keyboard cleaner, a cassette recorder cleaner, audio/video disc cleaner, a mouse cleaner, or a liquid electrical tape.

In another example, the dispenser of the present invention can dispense a flowable material or mixture in food product applications. For example, the food product may be food additives, food colorings, coffee flavorings, cooling oils, spices, flavor extracts, food additives, drink additives, confections, cake gel, pastry gel, frostings, sprinkles, breath drops, condiments, sauces, liquors, alcohol mixes, energy drinks, or herbal teas and drinks.

In another example, the dispenser of the present invention can be used in home repair product and home improvement applications. The dispenser can also dispense a flowable material that is a home repair product, such as a caulking compounds or materials, a scratch touch up kit, a stain remover, a furniture repair product, a wood glue, a patch lock, screw anchor, wood tone putty or porcelain touch-up. The dispenser could also dispense a plumbing flux applicator, rust remover and tree wound treatment. In certain home repair or home improvement applications, the dispenser can be used in paint applications. The dispenser can dispense a variety of paint products such as general paints including interior/exterior paints, novelty paints, paint additives, wood stain samples, varnishes, stains, lacquers, caulk, paint mask fluid or paint remover.

In another example, the dispenser of the present invention can be used in household related products. For example, the dispenser could be used for cleaning agents, pest control products, a fish tank sealant or a fish tank treatment, a leak sealant, a nut/bolt locker, screw tightener/gap filler, a super glue remover or goo-b-gone. The dispenser could also be used for a colorant dispenser, or disinfectants, a plant food, fertilizers, bug repellants or a cat litter deodorant. The dispenser could also dispense toilet dyes and treatments, eyeglass cleaners, shoe polishes, clothing stain removers, carpet cleaners and spot removers, multi-purpose oils, and ultrasonic cleaner concentrate. The household product could include a variety of pet-related products including but not limited to an animal medicine dispenser, pet medications, animal measured food dispenser, pet shampoos or odor eliminator liquids. A large variety of pest control products can be dispensed by the dispenser, including insect attractants, pesticides, pet insect repellants, pest sterilizers, insect repellants, lady bug attractant and fly trap attractant. The household product could also include various types of polishes, reagents, indicators and other products.

In another example, the dispenser of the present invention can be used in lubricant applications. The dispenser can dispense a large variety of lubricants including industrial lubricants, oils, greases, graphite lubricants or a dielectric grease.

The dispenser of the present invention can also be used in other medical applications including medical related products, medicinal products and medicaments. Additional medical related product applications can include skin adhesive kits to be used in place of traditional stitching products. As discussed, the dispenser could also be used with topical antiseptics, antimicrobials and surgical scrub products. In addition, the dispenser 10 can dispense a large variety of medicinal products, such as blister medicines, cold sore treatments, insect sting and bite relief products, skin cleaning compounds, skin sealing solutions, skin rash lotions, nasal sanitizers, nasal medications, tissue markers, topical antimicrobials, topical demulcent, treatments for acne such as acne medications, umbilical area antiseptics, cough medicines, waterless hand sanitizers, toothache remedies, cold medicines, sublingual dosages or wart treatments. The dispenser could also be used to dispense compositions for treating various skin conditions. The dispenser could also be used in conjunction with a medical device product. Other medical related applications could include various types of dental related products including different types of compounds and treatments applied to a patients' teeth. The dispenser could also be used in veterinary related products.

In another example, the dispenser of the present invention can be used in novelty products. For example, the dispenser can contain materials in a glow-stick device. In such instance, the dispenser is a container that may contain multiple components separately stored until activation to create a glowing state in response to mixture of the components. Furthermore, the dispenser can dispense a flowable material or mixture that is a chemiluminescent light, a Christmas tree scent, a glitter gel, and a face paint. Other types of novelty paints could also be used with the dispenser.

In another example, the dispenser of the present invention can be used in sports products. The dispenser can dispense a variety of sports products including sports eye black, football hand glue, and baseball glove conditioner and pine tar. The dispenser can also dispense wildlife lures. The dispenser can be used in various camping related applications including portable lighting fuels for camp lights or other devices and tent repair kits. The dispenser can also be used in bingo or other game markers.

In another example, the dispenser of the present invention can be used in test kit applications. The dispenser can dispense a flowable material or mixture that is a test kit, such as a lead test kit, a drug kit, a radon test kit, a narcotic test kit, a swimming pool test kit (e.g., chlorine, pH, alkalinity etc.), a home water quality tester, a soil test kit, a gas leak detection fluid, a pregnancy tester, or a respirator test kit. The dispenser can also dispense a flowable material or mixture that as part of a medical device test kit, such as a culture media, a drug monitoring system, a microbiological reagent, a *streptococcus* test kit, or a residual disinfectant tester. The dispenser may also be used in diagnostic testing kits, explosive testing kits or other test kits. The dispenser can be used in breathalyzer tests, culture media samples and drug test kits.

In another example, the dispenser of the present invention can be used in personal care products or wellness-related products. The dispenser can also dispense a flowable material or mixture that is a personal care product, such as shaving cream or gel, aftershave lotion, skin conditioner, skin cream, skin moisturizer, petroleum jelly, insect repellant, personal lubricant, ear drops, eye drops, nose drops, corn medications, nail fungal medication, aging liquids, acne cream, contact lens cleaner, denture repair kit, finger nail repair kit, liquid soaps, sun screen, lip balm, tanning cream, self-tanning solutions, eye wash solution finger nail repair kits. The dispenser can also be used with aroma therapy products and homeopathic preparations. The dispenser can also dispense various vitamins, minerals, supplements and pet vitamins.

The dispenser can also dispense a flowable material or mixture in a variety of other miscellaneous applications. Such miscellaneous applications may include, but not be limited to use in connection with a suction device for culture sampling, taking various liquid samples or taking various swabbing samples. The dispenser could also be used for float and sinker devices, dye markers, microbiological reagents, and also for manufacturing parts assembly liquids and irrigation solutions. The dispenser may also be used as a chalk dispenser such as in construction applications.

Thus, the dispenser can be used in many different applications including mechanical, chemical, electrical or biomedical uses. The dispenser can dispense any variety of flowable materials including liquids and powders, and further including a liquid and a powder, two or more powders, or two or more liquids. The dispenser may be used as part of 2-part system (mix before use) including a liquid with a powder, a liquid with a liquid, a powder with a powder, or sealed inside another tube or product container or partially sealed, connected or attached to another container. The dispenser may also be used as part of a plunger dispensing system.

While the invention has been described in its preferred embodiments, it is to be understood that the words which have been used are words of description rather than limitation and that changes may be made within the purview of the appended claims without departing from the true scope and spirit of the invention in its broader aspects.

What is claimed is:

1. A dispenser for dispensing a flowable material, the dispenser comprising:

a container having an outer wall and membrane collectively defining a first chamber configured to contain the flowable material, the membrane having a thickness and a weld seam, the weld seam having a thickness less than the thickness of the membrane, wherein the weld seam has a thickness in the range of 0.010 inches to 0.014 inches; and a fracturing mechanism operably connected to the container, the fracturing mechanism having an extending member projecting from the outer wall of the container, the extending member having a projection positioned proximate the membrane, wherein in response to deflection of the extending member, the projection deflects the outer wall proximate the membrane wherein the weld seam fractures creating an opening through the membrane configured to allow the flowable material to pass therethrough and from the dispenser, wherein the fracturing mechanism comprises a first fracturing mechanism and a second fracturing mechanism, the first fracturing mechanism and the second fracturing mechanism positioned on the container in opposed relation.

2. The dispenser of claim 1 wherein the projection is spaced from the outer wall prior to deflection of the extending member.

3. The dispenser of claim 1 wherein the projection depends from an underside of the extending member.

4. The dispenser of claim 1 wherein the projection has a length that extends beyond the membrane.

5. The dispenser of claim 1 wherein the projection has a contoured surface, the contoured surface deflecting the outer wall in response to the deflection of the extending member.

6. The dispenser of claim 1 wherein the projection is dimensioned such that in response to deflection of the extending member, a central portion of the projection engages and deflects the outer wall proximate where the membrane meets the outer wall.

7. The dispenser of claim 1 wherein the extending member has a cut-out portion proximate an end of the extending member that projects from the outer wall, the cut-out portion defining a hinge wherein the extending member deflects about the hinge.

8. The dispenser of claim 7 wherein the cut-out portion is in an underside of the extending member.

9. The dispenser of claim 8 wherein the cut-out portion is a notch.

10. The dispenser of claim 1 wherein the extending member has a base, the base connected to the outer wall of the container.

11. The dispenser of claim 1 wherein the extending member has a first segment and a second segment, the first segment projecting from the outer wall.

12. The dispenser of claim 11 wherein the dispenser has a longitudinal axis, the second segment extending generally parallel to the longitudinal axis.

13. The dispenser of claim 11 wherein the second segment has a rib depending therefrom, the depending rib being capable of further deflecting the outer wall of the container to force the flowable material through the membrane.

14. The dispenser of claim 11 wherein an interface area is defined between the first segment and the second segment wherein the interface area has a second cut-out portion defining a second hinge wherein the second segment is capable of pivoting about the second hinge towards the outer wall.

15. The dispenser of claim 14 wherein the second cut-out portion has a contoured shape.

16. The dispenser of claim 14 wherein the cut-out portion is on an underside of the extending member.

17. The dispenser of claim 14 wherein the cut-out portion is on an exterior surface of the extending member.

18. The dispenser of claim 17 wherein the cut-out portion is a notch.

19. The dispenser of claim 1 wherein the membrane extends from the outer wall at an angle.

20. The dispenser of claim 19 wherein the angle is in the range from 19° to 25°.

21. The dispenser of claim 1 wherein the membrane has a generally conically-shaped configuration.

22. The dispenser of claim 1 wherein the membrane has a generally planar configuration.

23. The dispenser of claim 1 wherein the outer wall defines a second chamber positioned adjacent to the membrane, the second chamber defining an opening, wherein the flowable material passes through the membrane and into and from the second chamber.

24. The dispenser of claim 23 further comprising an applicator positioned in the opening of the second chamber, the flowable material being dispensed onto a receiving surface from the applicator.

25. The dispenser of claim 24 wherein the applicator is a porous member.

26. The dispenser of claim 1 wherein the dispenser is formed of a predetermined amount of polyvinylidene fluoride.

27. The dispenser of claim 1 wherein the dispenser is formed entirely of polyvinylidene fluoride.

28. A dispenser for dispensing a flowable material, the dispenser comprising:

a container having an outer wall and membrane collectively defining a first chamber and a second chamber, the first chamber configured to contain the flowable material, the second chamber defining an opening, the membrane having a thickness and a weld seam, the weld seam having a thickness less than the thickness of the membrane; and a fracturing mechanism operably connected to the container, the fracturing mechanism comprising:

a first extending member projecting from a first base positioned on the outer wall of the container, the first extending member having a first segment and a second segment, the first segment connected to the first base and having a cut-out portion defining a first hinge allowing the first segment to pivot about the first base, the first segment having a first projection positioned proximate the membrane, the first segment having a first position wherein the first projection is spaced from the outer wall, the second segment connected to the first segment at a first interface area, the first interface area having a cut-out portion defining a second hinge allowing the second segment to pivot about the first segment, the second segment having a first depending rib;

a second extending member projecting from a second base positioned on the outer wall of the container, the second extending member positioned on the container generally in opposed relation to the first extending member, the second extending member having a first segment and a second segment, the first segment connected to the second base and having a cut-out portion defining a third hinge allowing the first segment to pivot about the second base, the first segment having a second projection positioned proximate the membrane, the first segment having a first position wherein the second projection is spaced from the outer wall, the second segment connected to the first segment at a second interface area, the second interface area having a cut-out portion defining a fourth hinge allowing the second segment to pivot about the first segment, the second segment having a second depending rib; and, a porous member positioned in the opening defined by the second chamber, wherein in response to a user deflecting the first segment of the first extending member and the first segment of the second extending member towards one another about the respective first hinge and second hinge to respective deflected positions wherein the first projection deflects the outer wall proximate the membrane and wherein the second projection deflects the outer wall proximate the membrane wherein the weld seam fractures creating an opening through the membrane configured to allow the flowable material to pass from the first chamber, past the membrane, and into the second chamber, wherein the flowable material is configured to contact the porous member and be dispensed from the porous member, wherein in response to a user deflecting the second segment of the first extending member and the second segment of the second extending member about the respective third and fourth hinges to respective deflected positions, the first depending rib and the second depending rib deflect the outer wall proximate the first chamber to force further flowable material from the first chamber and into the second chamber to be dispensed from the porous member.

29. A dispenser for dispensing a flowable material, the dispenser comprising:

a container having an outer wall and membrane collectively defining a first chamber configured to contain the flowable material, the container defining a longitudinal axis, the membrane having a thickness and a weld seam, the weld seam having a thickness less than the thickness of the membrane; and a fracturing mechanism operably connected to the container, the fracturing mechanism having an extending member having a first segment and a second segment, the first segment projecting from the outer wall of the container, the first segment having a projection positioned proximate the membrane, the second segment extending from the first segment generally parallel to the longitudinal axis, wherein an interface area is defined between the first segment and the second segment, the interface area having a cut-out portion defining a hinge wherein the second segment is capable of pivoting about the hinge towards the outer wall, the second segment having a rib depending therefrom, wherein in response to deflection of the extending member, the projection deflects the outer wall proximate the membrane wherein the weld seam fractures creating an opening through the membrane configured to allow the flowable material to pass therethrough and from the dispenser, wherein in response to the second segment pivoting about the hinge, the depending rib is capable of further deflecting the outer wall of the container to force the flowable material through the membrane.

30. A dispenser for dispensing a flowable material, the dispenser comprising:

a container having an outer wall and membrane collectively defining a first chamber configured to contain the flowable material, the membrane having a thickness and a weld seam, the weld seam having a thickness less than the thickness of the membrane; and a fracturing mechanism operably connected to the container, the fracturing mechanism having an extending member having a first segment and a second segment, the first segment projecting from the outer wall of the container, the first segment having a projection positioned proximate the membrane, wherein the first segment has a first cut-out portion proximate an end of the first segment that projects from the outer wall, the first cut-out portion defining a first hinge wherein the first segment deflects about the first hinge, the second segment extending from the first segment, wherein an interface area is defined between the first segment and the second segment, the interface area having a second cut-out portion defining a second hinge wherein the second segment is capable of pivoting about the second hinge towards the outer wall, the second segment having a rib depending therefrom, wherein in response to the first segment pivoting about the first hinge, the projection deflects the outer wall proximate the membrane wherein the weld seam fractures creating an opening through the membrane configured to allow the flowable material to pass therethrough and from the dispenser, wherein in response to the second segment pivoting about the second hinge, the depending rib is capable of further deflecting the outer wall of the container to force the flowable material through the membrane.

31. A dispenser for dispensing a flowable material, the dispenser comprising:

a container having an outer wall and membrane collectively defining a first chamber configured to contain the flowable material, the membrane having a thickness and a weld seam, the weld seam having a thickness less than the thickness of the membrane, wherein the weld seam has a thickness in the range of 0.010 inches to 0.014 inches; and a fracturing mechanism operably connected to the container, the fracturing mechanism having an extending member projecting from the outer wall of the container, the extending member having a projection positioned proximate the membrane, wherein in response to deflection of the extending member, the projection deflects the outer wall proximate the membrane wherein the weld seam fractures creating an opening through the membrane configured to allow the flowable material to pass therethrough and from the dispenser.

* * * * *